US007434919B2

(12) United States Patent
Hawkins et al.

(10) Patent No.: US 7,434,919 B2
(45) Date of Patent: Oct. 14, 2008

(54) INK JET BREAK-OFF LENGTH MEASUREMENT APPARATUS AND METHOD

(75) Inventors: Gilbert A. Hawkins, Mendon, NY (US); Michael J. Piatt, Dayton, OH (US); John C. Brazas, Hilton, NY (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 139 days.

(21) Appl. No.: 11/229,454

(22) Filed: Sep. 16, 2005

(65) Prior Publication Data

US 2007/0064037 A1 Mar. 22, 2007

(51) Int. Cl.
*B41J 2/07* (2006.01)

(52) U.S. Cl. ..... 347/74

(58) Field of Classification Search ..... 347/73–83
See application file for complete search history.

(56) References Cited

U.S. PATENT DOCUMENTS

| | | | | |
|---|---|---|---|---|
| 3,373,437 A | | 3/1968 | Sweet | 347/74 |
| 3,560,641 A | * | 2/1971 | Taylor et al. | 358/296 |
| 3,596,275 A | | 7/1971 | Sweet | 347/74 |
| 3,596,276 A | * | 7/1971 | Lovelady et al. | 347/76 |
| 3,739,393 A | | 6/1973 | Lyon et al. | 347/75 |
| 3,877,036 A | | 4/1975 | Loeffler et al. | 347/77 |
| 3,878,519 A | | 4/1975 | Eaton | 347/75 |
| 3,886,564 A | | 5/1975 | Naylor et al. | 347/81 |
| 3,960,324 A | | 6/1976 | Titus et al. | 239/4 |
| 4,067,019 A | * | 1/1978 | Fleischer et al. | 347/81 |
| 4,135,197 A | | 1/1979 | Stoneburner | 347/94 |

(Continued)

OTHER PUBLICATIONS

D.J. Drake, Binary Continuous Thermal Ink Jet Break Off Length Modulation, Xerox Disclosure Journal, Xerox Corporation, Stamford, Conn., vol. 14, No. 3, May 1, 1989, pp. 95-100, XP000027460.

*Primary Examiner*—Matthew Luu
*Assistant Examiner*—Justin Seo
(74) *Attorney, Agent, or Firm*—Stephen Pond Consulting

(57) ABSTRACT

A jet break-off length measurement apparatus for a continuous liquid drop emission system is provided. The jet break-off length measurement apparatus comprises a liquid drop emitter containing a positively pressurized liquid in flow communication with at least one nozzle for emitting a continuous stream of liquid. Heater resistor apparatus is adapted to transfer pulses of thermal energy to the liquid in flow communication with the at least one nozzle sufficient to cause the break-off of the at least one continuous stream of liquid into a stream of drops of predetermined volumes. A sensing apparatus adapted to detect the stream of drops of predetermined volumes is provided. A control apparatus is adapted to determine a characteristic of the stream of drops of predetermined volumes that is related to the break-off length. Further apparatus is adapted to inductively charge at least one drop and to cause electric field deflection of charged drops. Jet stimulation apparatus comprising a plurality of transducers corresponding to the plurality of nozzles and adapted to transfer pulses of energy to the liquid sufficient to cause the break-off of the plurality of continuous streams of liquid into a plurality of streams of drops of predetermined volumes is also disclosed. Methods of measuring the jet break-off length using phase sensitive amplification circuitry are disclosed.

21 Claims, 37 Drawing Sheets

U.S. PATENT DOCUMENTS 4,136,345 A * 1/1979 Neville et al. ..... 347/81
4,198,643 A 4/1980 Cha et al. ..... 347/75
4,220,958 A 9/1980 Crowley ..... 347/75
4,255,754 A 3/1981 Crean et al. ..... 347/81
4,303,927 A 12/1981 Tsao ..... 347/40
4,350,986 A * 9/1982 Yamada ..... 347/75
4,417,256 A 11/1983 Fillmore et al. ..... 347/78
4,638,325 A * 1/1987 Schneider et al. ..... 347/75
4,638,328 A * 1/1987 Drake et al. ..... 347/75
5,224,843 A 7/1993 van Lintel ..... 417/413.2
6,435,645 B1 8/2002 Falinski ..... 347/19
6,450,619 B1 9/2002 Anagnostopoulos et al. .. 347/59
6,474,784 B1 11/2002 Fujii et al. ..... 347/54
6,474,794 B1 11/2002 Anagnostopoulos et al. .. 347/74
6,491,385 B2 12/2002 Anagnostopoulos et al. .. 347/73
6,561,627 B2 5/2003 Jarrold et al. ..... 347/54
7,249,830 B2 * 7/2007 Hawkins et al. ..... 347/78

* cited by examiner

INK JET BREAK-OFF LENGTH MEASUREMENT APPARATUS AND METHOD

CROSS REFERENCE TO RELATED APPLICATION

Reference is made to and priority claimed from U.S. Provisional Application Ser. No., filed, entitled.

FIELD OF THE INVENTION

This invention relates generally to continuous stream type ink jet printing systems and more particularly to printheads which stimulate the ink in the continuous stream type ink jet printers by individual jet stimulation apparatus, especially using thermal energy pulses.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. This form of ink jet is commonly termed "thermal ink jet (TIJ)." Other known drop-on-demand droplet ejection mechanisms include piezoelectric actuators, such as that disclosed in U.S. Pat. No. 5,224,843, issued to van Lintel, on Jul. 6, 1993; thermo-mechanical actuators, such as those disclosed by Jarrold et al., U.S. Pat. No. 6,561,627, issued May 13, 2003; and electrostatic actuators, as described by Fujii et al., U.S. Pat. No. 6,474,784, issued Nov. 5, 2002.

The second technology, commonly referred to as "continuous" ink jet printing, uses a pressurized ink source that produces a continuous stream of ink droplets from a nozzle. The stream is perturbed in some fashion causing it to break up into uniformly sized drops at a nominally constant distance, the break-off length, from the nozzle. A charging electrode structure is positioned at the nominally constant break-off point so as to induce a data-dependent amount of electrical charge on the drop at the moment o break-off. The charged droplets are directed through a fixed electrostatic field region causing each droplet to deflect proportionately to its charge. The charge levels established at the break-off point thereby cause drops to travel to a specific location on a recording medium or to a gutter for collection and recirculation.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a jet of diameter, $d_j$, moving at a velocity, $v_j$. The jet diameter, $d_j$, is approximately equal to the effective nozzle diameter, $d_n$, and the jet velocity is proportional to the square root of the reservoir pressure, P. Rayleigh's analysis showed that the jet will naturally break up into drops of varying sizes based on surface waves that have wavelengths, $\lambda$, longer than $\pi d_j$, i.e. $\lambda \geqq \pi d_j$. Rayleigh's analysis also showed that particular surface wavelengths would become dominate if initiated at a large enough magnitude, thereby "synchronizing" the jet to produce mono-sized drops. Continuous ink jet (CIJ) drop generators employ some periodic physical process, a so-called "perturbation" or "stimulation", that has the effect of establishing a particular, dominate surface wave on the jet. This results in the break-off of the jet into mono-sized drops synchronized to the frequency of the perturbation.

The drop stream that results from applying a Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal may be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present inventions and is not considered to obviate the fact that the drop sizes have been predetermined by the synchronizing energy signals used in the present inventions. Thus the phrase "predetermined volume" as used to describe the present inventions should be understood to comprehend that some small variation in drop volume about a planned target value may occur due to unpredictable satellite drop formation.

Commercially practiced CIJ printheads use a piezoelectric device, acoustically coupled to the printhead, to initiate a dominant surface wave on the jet. The coupled piezoelectric device superimposes periodic pressure variations on the base reservoir pressure, causing velocity or flow perturbations that in turn launch synchronizing surface waves. A pioneering disclosure of a piezoelectrically-stimulated CIJ apparatus was made by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure.

Sweet '275 disclosed several approaches to providing the needed periodic perturbation to the jet to synchronize drop break-off to the perturbation frequency. Sweet '275 discloses a magnetostrictive material affixed to a capillary nozzle enclosed by an electrical coil that is electrically driven at the desired drop generation frequency, vibrating the nozzle, thereby introducing a dominant surface wave perturbation to the jet via the jet velocity. Sweet '275 also discloses a thin ring-electrode positioned to surround but not touch the unbroken fluid jet, just downstream of the nozzle. If the jetted fluid is conductive, and a periodic electric field is applied between the fluid filament and the ring-electrode, the fluid jet may be caused to expand periodically, thereby directly introducing a surface wave perturbation that can synchronize the jet break-off. This CIJ technique is commonly called electrohydrodynamic (EHD) stimulation.

Sweet '275 further disclosed several techniques for applying a synchronizing perturbation by superimposing a pressure variation on the base liquid reservoir pressure that forms the jet. Sweet '275 disclosed a pressurized fluid chamber, the drop generator chamber, having a wall that can be vibrated mechanically at the desired stimulation frequency. Mechanical vibration means disclosed included use of magnetostrictive or piezoelectric transducer drivers or an electromagnetic moving coil. Such mechanical vibration methods are often termed "acoustic stimulation" in the CIJ literature.

The several CIJ stimulation approaches disclosed by Sweet '275 may all be practical in the context of a single jet system However, the selection of a practical stimulation mechanism for a CIJ system having many jets is far more complex. A pioneering disclosure of a multi-jet CIJ printhead has been made by Sweet et al. in U.S. Pat. No. 3,373,437, issued Mar. 12, 1968, Sweet '437 hereinafter. Sweet' 437 discloses a CIJ printhead having a common drop generator chamber that communicates with a row (an array) of drop emitting nozzles. A rear wall of the common drop generator chamber is vibrated by means of a magnetostrictive device, thereby modulating the chamber pressure and causing a jet velocity perturbation on every jet of the array of jets.

Since the pioneering CIJ disclosures of Sweet '275 and Sweet '437, most disclosed multi-jet CIJ printheads have employed some variation of the jet break-off perturbation means described therein. For example, U.S. Pat. No. 3,560,641 issued Feb. 2, 1971 to Taylor et al. discloses a CIJ printing apparatus having multiple, multi-jet arrays wherein the drop break-off stimulation is introduced by means of a vibration device affixed to a high pressure ink supply line that supplies the multiple CIJ printheads. U.S. Pat. No. 3,739,393 issued Jun. 12, 1973 to Lyon et al. discloses a multi-jet CIJ array wherein the multiple nozzles are formed as orifices in a single thin nozzle plate and the drop break-off perturbation is provided by vibrating the nozzle plate, an approach akin to the single nozzle vibrator disclosed by Sweet '275. U.S. Pat. No. 3,877,036 issued Apr. 8, 1975 to Loeffler et al. discloses a multi-jet CIJ printhead wherein a piezoelectric transducer is bonded to an internal wall of a common drop generator chamber, a combination of the stimulation concepts disclosed by Sweet '437 and '275

Unfortunately, all of the stimulation methods employing a vibration some component of the printhead structure or a modulation of the common supply pressure result is some amount of non-uniformity of the magnitude of the perturbation applied to each individual jet of a multi-jet CIJ array. Non-uniform stimulation leads to a variability in the break-off length and timing among the jets of the array. This variability in break-off characteristics, in turn, leads to an inability to position a common drop charging assembly or to use a data timing scheme that can serve all of the jets of the array. As the array becomes physically larger, for example long enough to span one dimension of a typical paper size (herein termed a "page wide array"), the problem of non-uniformity of jet stimulation becomes more severe. Non-uniformity in jet break-off length across a multi-jet array causes unpredictable drop arrival times leading to print quality defects in ink jet printing systems and ragged layer edges or misplaced coating material for other uses of CIJ liquid drop emitters.

Many attempts have been made to overcome the problem of non-uniform CIJ stimulation based on vibrating structures. U.S. Pat. No. 3,960,324 issued Jun. 1, 1976 to Titus et al. discloses the use of multiple, discretely mounted, piezoelectric transducers, driven by a common electrical signal, in an attempt to produce uniform pressure stimulation at the nozzle array. U.S. Pat. No. 4,135,197 issued Jan. 16, 1979 to L. Stoneburner discloses means of damping reflected acoustic waves set up in a vibrated nozzle plate. U.S. Pat. No. 4,198,643 issued Apr. 15, 1980 to Cha, et al. disclosed means for mechanically balancing the printhead structure so that an acoustic node occurs at the places where the printhead is clamped for mounting. U.S. Pat. No. 4,303,927 issued Dec. 1, 1981 to S. Tsao discloses a drop generator cavity shape chosen to resonate in a special mode perpendicular to the jet array direction, thereby setting up a dominate pressure perturbation that is uniform along the array.

U.S. Pat. No. 4,417,256 issued Nov. 22, 1983 to Fillmore, et al., (Fillmore '256 hereinafter) discloses an apparatus and method for balancing the break-off lengths in a multi-jet array by sensing the drop streams and then adjusting the magnitude of the excitation means to adjust the spread in break-off lengths. Fillmore '256 teaches that for the case of a multi-jet printhead driven by a single piezoelectric "crystal", there is an optimum crystal drive voltage that minimizes the break-off length for each individual jet in the array. The jet break-off lengths versus crystal drive voltage are determined for the "strongest" and "weakest" jets, in terms of stimulation efficiency. An operating crystal voltage is then selected that is in between optimum for the weakest and strongest jets, that is, higher than the optimum voltage of the strongest jet and lower than optimum voltage for the weakest jet. Fillmore '256 does not contemplate a system in which the break-off lengths could be adjusted to a desired operating length by means of stimulation means that are separately adjustable for each stream of the array.

Many other attempts to achieve uniform CIJ stimulation using vibrating devices, similar to the above references, may be found in the U.S. patent literature. However, it appears that the structures that are strong and durable enough to be operated at high ink reservoir pressures contribute confounding acoustic responses that cannot be totally eliminated in the range of frequencies of interest. Commercial CIJ systems employ designs that carefully manage the acoustic behavior of the printhead structure and also limit the magnitude of the applied acoustic energy to the least necessary to achieve acceptable drop break-off across the array. A means of CIJ stimulation that does not significantly couple to the printhead structure itself would be an advantage, especially for the construction of page wide arrays (PWA's) and for reliable operation in the face of drifting ink and environmental parameters.

The electrohydrodynamic (EHD) jet stimulation concept disclosed by Sweet '275 operates on the emitted liquid jet filament directly, causing minimal acoustic excitation of the printhead structure itself, thereby avoiding the above noted confounding contributions of printhead and mounting structure resonances. U.S. Pat. No. 4,220,958 issued Sep. 2, 1980 to Crowley discloses a CIJ printer wherein the perturbation is accomplished an EHD exciter composed of pump electrodes of a length equal to about one-half the droplet spacing. The multiple pump electrodes are spaced at intervals of multiples of about one-half the droplet spacing or wavelength downstream from the nozzles. This arrangement greatly reduces the voltage needed to achieve drop break-off over the configuration disclosed by Sweet '275.

While EHD stimulation has been pursued as an alternative to acoustic stimulation, it has not been applied commercially because of the difficulty in fabricating printhead structures having the very close jet-to-electrode spacing and alignment required and, then, operating reliably without electrostatic breakdown occurring. Also, due to the relatively long range of electric field effects, EHD is not amenable to providing individual stimulation signals to individual jets in an array of closely spaced jets.

An alternate jet perturbation concept that overcomes all of the drawbacks of acoustic or EHD stimulation was disclosed for a single jet CIJ system in U.S. Pat. No. 3,878,519 issued Apr. 15, 1975 to J. Eaton (Eaton hereinafter). Eaton discloses the thermal stimulation of a jet fluid filament by means of localized light energy or by means of a resistive heater located at the nozzle, the point of formation of the fluid jet. Eaton explains that the fluid properties, especially the surface tension, of a heated portion of a jet may be sufficiently changed with respect to an unheated portion to cause a localized change in the diameter of the jet, thereby launching a dominant surface wave if applied at an appropriate frequency.

Eaton mentions that thermal stimulation is beneficial for use in a printhead having a plurality of closely spaced ink streams because the thermal stimulation of one stream does not affect any adjacent nozzle. However, Eaton does not teach or disclose any multi-jet printhead configurations, nor any practical methods of implementing a thermally-stimulated multi-jet CIJ device, especially one amenable to page wide array construction. Eaton teaches his invention using calculational examples and parameters relevant to a state-of-the-art ink jet printing application circa the early 1970's, i.e. a drop frequency of 100 KHz and a nozzle diameter of ~25 microns leading to drop volumes of ~60 picoLiters (pL). Eaton does not teach or disclose how to configure or operate a thermally-stimulated CIJ printhead that would be needed to print drops an order of magnitude smaller and at substantially higher drop frequencies.

U.S. Pat. No. 4,638,328 issued Jan. 20, 1987 to Drake, et al. (Drake hereinafter) discloses a thermally-stimulated multi-jet CIJ drop generator fabricated in an analogous fashion to a thermal ink jet device. That is, Drake discloses the operation of a traditional thermal ink jet (TIJ) edgeshooter or roofshooter device in CIJ mode by supplying high pressure ink and applying energy pulses to the heaters sufficient to cause synchronized break-off but not so as to generate vapor bubbles. Drake mentions that the power applied to each individual stimulation resistor may be tailored to eliminate non-uniformities due to cross talk. However, the inventions claimed and taught by Drake are specific to CIJ devices fabricated using two substrates that are bonded together, one substrate being planar and having heater electrodes and the other having topographical features that form individual ink channels and a common ink supply manifold.

Also recently, microelectromechanical systems (MEMS), have been disclosed that utilize electromechanical and thermomechanical transducers to generate mechanical energy for performing work. For example, thin film piezoelectric, ferroelectric or electrostrictive materials such as lead zirconate titanate (PZT), lead lanthanum zirconate titanate (PLZT), or lead magnesium niobate titanate (PMNT) may be deposited by sputtering or sol gel techniques to serve as a layer that will expand or contract in response to an applied electric field. See, for example Shimada, et al. in U.S. Pat. No. 6,387,225, issued May 14, 2002; Sumi, et al., in U.S. Pat. No. 6,511,161, issued Jan. 28, 2003; and Miyashita, et al., in U.S. Pat. No. 6,543,107, issued Apr. 8, 2003. Thermomechanical devices utilizing electroresistive materials that have large coefficients of thermal expansion, such as titanium aluminide, have been disclosed as thermal actuators constructed on semiconductor substrates. See, for example, Jarrold et al., U.S. Pat. No. 6,561,627, issued May 13, 2003. Therefore electromechanical devices may also be configured and fabricated using microelectronic processes to provide stimulation energy on a jet-by-jet basis.

Consequently there is a need for a break-off length measurement and control system that is generally applicable to a thermally stimulated continuous liquid drop emission system, whether or not charged drops are utilized for drop selection purposes. There is an opportunity to effectively employ the extraordinary capability of thermal stimulation to change the break-up process of multiple jets individually, without causing jet-to-jet interactions, and to change the break-up process within an individual jet in ways that simplify the sensing apparatus and methods needed for feedback control. There is also an opportunity to utilize other electromechanical transducers to provide individual jet stimulation in a fashion similar to thermal stimulation. Further there is a need for an approach that may be economically applied to a liquid drop emitter having a very large number of jets.

SUMMARY OF THE INVENTION

It is therefore an object of the present invention to provide a jet break-off length measurement apparatus that advantageously employs the characteristics of thermal stimulation for a traditional charged-drop CIJ system.

It is an object of the present invention to provide a jet break-off length measurement apparatus that advantageously employs the characteristics of microelectromechanical stimulation of individual jets for a traditional charged-drop CIJ system.

It is also an object of the present invention to provide a jet break-off length measurement apparatus that can be employed with a liquid drop emission system that does not used drop charging.

It is also an object of the present invention to provide a jet break-off length measurement apparatus that is cost effective by making use of electronics integration among sub-functions of the apparatus.

Further it is an object of the present invention to provide methods for measuring jet break-off lengths for liquid drop emitters employing thermal stimulation utilizing phase sensitive amplification circuitry.

The foregoing and numerous other features, objects and advantages of the present invention will become readily apparent upon a review of the detailed description, claims and drawings set forth herein. These features, objects and advantages are accomplished by constructing a jet break-off length measurement apparatus for a continuous liquid drop emission system comprising a liquid drop emitter containing a positively pressurized liquid in flow communication with at least one nozzle for emitting a continuous stream of liquid. Resistive heater apparatus is adapted to transfer pulses of thermal energy to the liquid in flow communication with the at least one nozzle sufficient to cause the break-off of the at least one continuous stream of liquid into a stream of drops of predetermined volumes. A sensing apparatus adapted to detect the stream of drops of predetermined volumes is provided. The jet break-off length measurement apparatus further comprises a control apparatus adapted to determine a characteristic of the stream of drops of predetermined volumes that is related to the break-off length.

The present inventions are also configured to measure the break-off length for at least one continuous stream of a continuous liquid drop emission having apparatus that is adapted to inductively charge at least one drop and further for systems having electric field deflection apparatus adapted to generate a Coulomb force on an inductively charged drop.

The present inventions are additionally configured to measure break-off lengths for a plurality of streams of drops of predetermined volumes by determining a plurality of characteristics that are related to a plurality break-off lengths.

The present inventions further include methods of measuring the jet break-off length by applying a break-off test sequence of electrical pulses to resistive heater apparatus causing at least one continuous stream of liquid to break up into drops of predetermined volumes; detecting arrival times of the drops; calculating a characteristic of the at least one stream of drops; and calculating a characteristic of the at least one stream of drops of predetermined volumes that is related to the plurality break-off lengths.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. Functional elements and features have been given the same numerical labels in the figures if they are the same element or perform the same function for purposes of understanding the present inventions. It is to be understood that elements not specifically shown or described may take various forms well known to those skilled in the art.

Figure 1A:
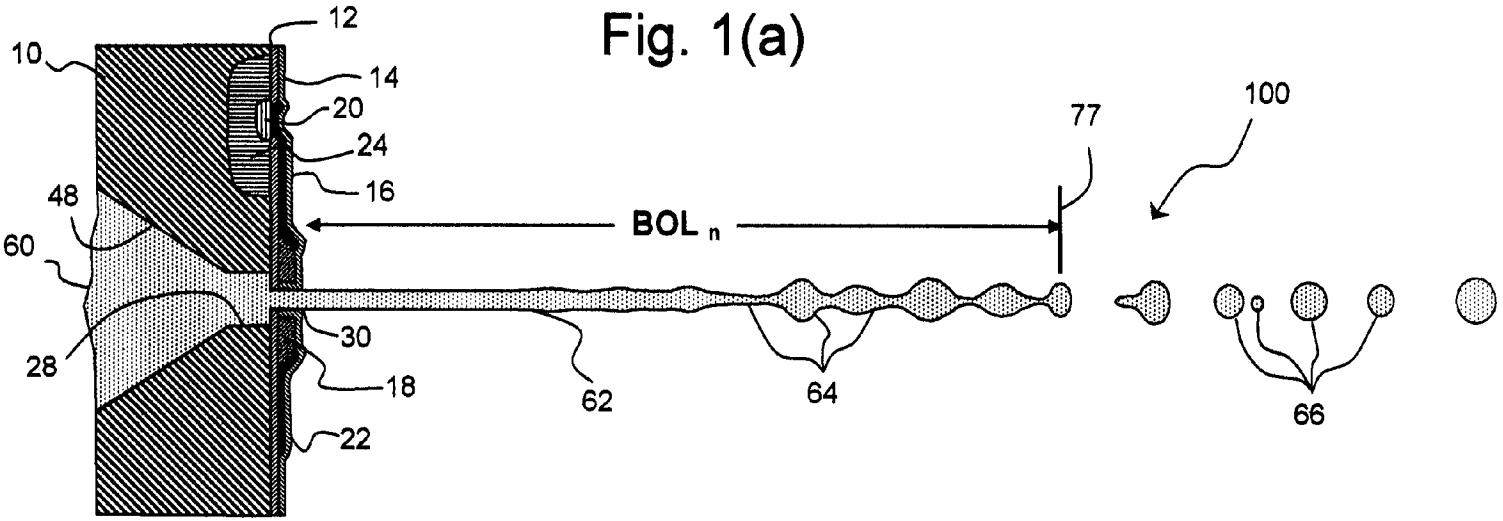
FIGS. 1(*a*) and 1(*b*) are side view illustrations of a continuous liquid stream undergoing natural break up into drops and thermally stimulated break up into drops of predetermined volumes respectively.
Figure 1B:
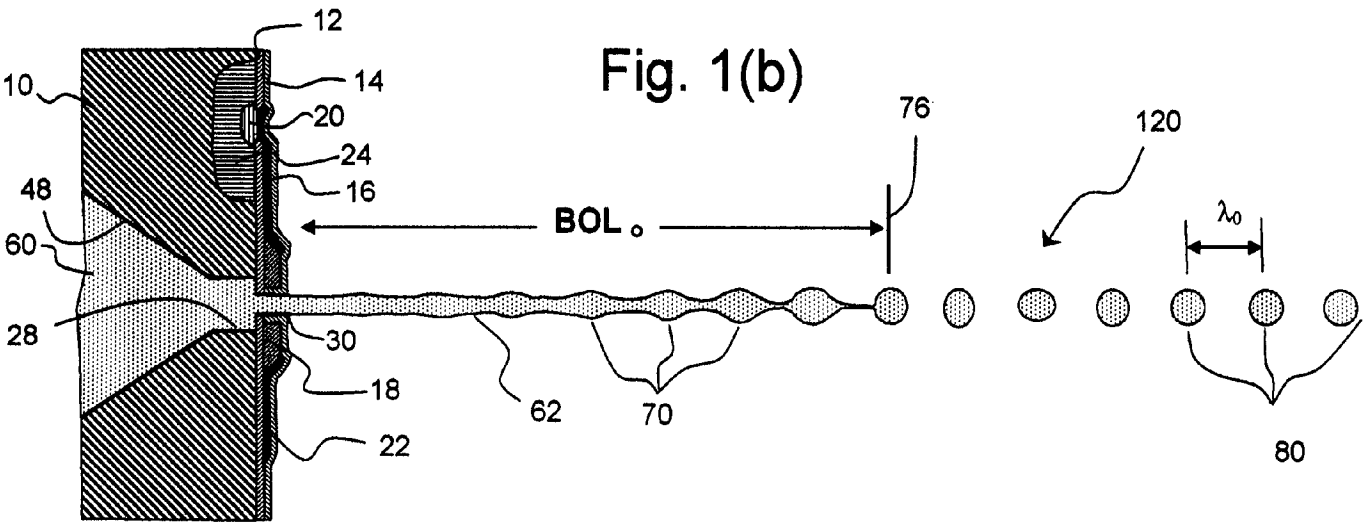

Referring to FIGS. 1(*a*) and 1(*b*), there is shown a portion of a liquid emission apparatus wherein a continuous stream of liquid 62, a liquid jet, is emitted from a nozzle 30 supplied by a liquid 60 held under high pressure in a liquid emitter chamber 48. The liquid stream 62 in FIG. 1(*a*) is illustrated as breaking up into droplets 66 after some distance 77 of travel from the nozzle 30. The liquid stream illustrated will be termed a natural liquid jet or stream of drops of undetermined volumes 100. The travel distance 77 is commonly referred to as the break-off length (BOL). The liquid stream 62 in FIG. 1(*a*) is breaking up naturally into drops of varying volumes. As noted above, the physics of natural liquid jet break-up was analyzed in the late nineteenth century by Lord Rayleigh and other scientists. Lord Rayleigh explained that surface waves form on the liquid jet having spatial wavelengths, $\lambda$, that are related to the diameter of the jet, $d_j$, that is nearly equal to the nozzle 30 diameter, $d_n$. These naturally occurring surface waves, $\lambda_n$, have lengths that are distributed over a range of approximately, $\pi d_j \leqq \lambda_n \leqq 10 d_j$.

Natural surface waves 64 having different wavelengths grow in magnitude until the continuous stream is broken up in to droplets 66 having varying volumes that are indeterminate within a range that corresponds to the above remarked wavelength range. That is, the naturally occurring drops 66 have volumes $V_n \approx \lambda_n (\pi d_j^2/4)$, or a volume range: $(\pi^2 d_j^3/4) \leqq V_n \leqq (10\pi d_j^3/4)$. In addition there are extraneous small ligaments of fluid that form small drops termed "satellite" drops among main drop leading to yet more dispersion in the drop volumes produced by natural fluid streams or jets. FIG. 1(*a*) illustrates natural stream break-up at one instant in time. In practice the break-up is chaotic as different surfaces waves form and grow at different instants. A break-off length for the natural liquid jet 100, $BOL_n$, is indicated; however, this length is also highly time-dependent and indeterminate within a wide range of lengths.

FIG. 1(*b*) illustrates a liquid stream 62 that is being controlled to break up into drops of predetermined volumes 80 at predetermined intervals, $\lambda_0$. The break-up control or synchronization of liquid stream 62 is achieved by a resistive heater apparatus adapted to apply thermal energy pulses to the flow of pressurized liquid 60 immediately prior to the nozzle 30. One embodiment of a suitable resistive heater apparatus according to the present inventions is illustrated by heater resistor 18 that surrounds the fluid 60 flow. Resistive heater apparatus according to the present inventions will be discussed in more detail herein below. The synchronized liquid stream 62 is caused to break up into a stream of drops of predetermined volume, $V_0 \approx \lambda_0 (\pi d_j^2/4)$ by the application of thermal pulses that cause the launching of a dominant surface wave 70 on the jet. To launce a synchronizing surface wave of wavelength $\lambda_0$ the thermal pulses are introduced at a frequency $f_0 = v_{j0}/\lambda_0$, where $v_{j0}$ is the desired operating value of the liquid stream velocity.

FIG. 1(*b*) also illustrates a stream of drops of predetermined volumes 120 that is breaking off at 76, a predetermined, preferred operating break-off length distance, $BOL_0$. While the stream break-up period is determined by the stimulation wavelength, the break-off length is determined by the intensity of the stimulation. The dominant surface wave initiated by the stimulation thermal pulses grows exponentially until it exceeds the stream diameter. If it is initiated at higher amplitude the exponential growth to break-off can occur within only a few wavelengths of the stimulation wavelength. Typically a weakly synchronized jet, one for which the stimulation is just barely able to become dominate before break-off occurs, break-off lengths of $\sim 12\lambda_0$ will be observed. The preferred operating break-off length illustrated in FIG. 1(*b*) is $8\lambda_0$. Shorter break-off lengths may be chosen and even $BOL \sim 1\lambda_0$ is feasible.

Achieving very short break-off lengths may require very high stimulation energies, especially when jetting viscous liquids. The stimulation structures, for example, beater resistor 18, may exhibit more rapid failure rates if thermally cycled to very high temperatures, thereby imposing a practical reliability consideration on the break-off length choice. For prior art CIJ acoustic stimulation, it is exceedingly difficult to achieve highly uniform acoustic pressure over distances greater than a few centimeters.

The known factors that are influential in determining the break-off length of a liquid jet include the jet velocity, nozzle shape, liquid surface tension, viscosity and density, and stimulation magnitude and harmonic content. Other factors such as surface chemical and mechanical features of the final fluid passageway and nozzle exit may also be influential. When trying to construct a liquid drop emitter comprised of a large array of continuous fluid streams of drops of predetermined volumes, these many factors affecting the break-off length lead to a serious problem of non-uniform break-off length among the fluid streams. Non-uniform break-off length, in turn, contributes to an indefiniteness in the timing of when a drop becomes ballistic, i.e. no longer propelled by the reservoir and in the timing of when a given drop may be selected for deposition or not in an image or other layer pattern at a receiver.

Figure 2:
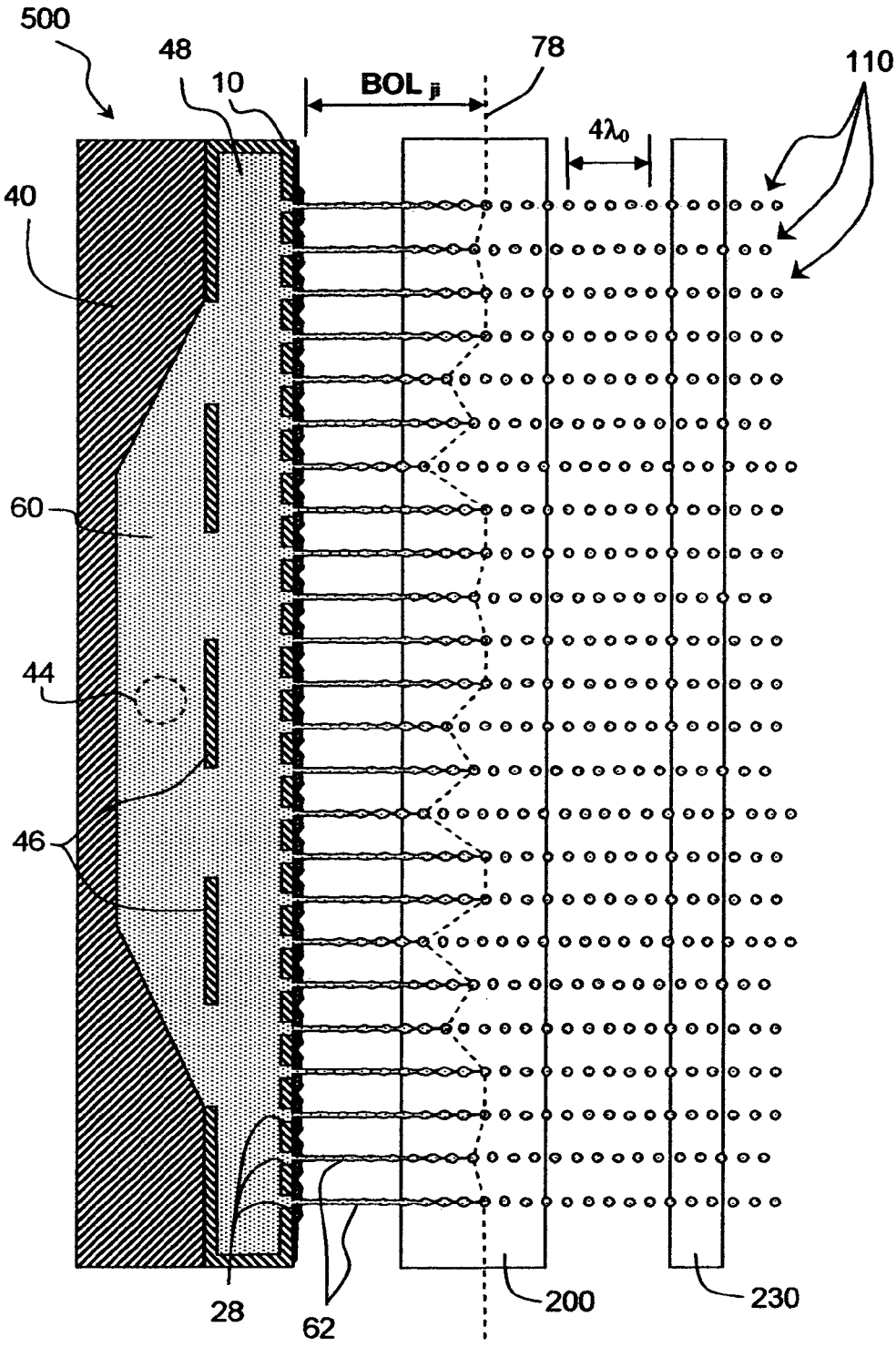
FIG. 2 is a top side view illustration of a liquid drop emitter having a plurality of liquid streams breaking up into drops of predetermined volumes wherein the break-off lengths are not controlled to an operating length.

FIG. 2 illustrates a top view of a multi-jet liquid drop emitter 500 employing thermal stimulation to synchronize all of the streams to break up into streams of drops of predetermined volumes 110. However, the break-off lengths 78 of the plurality of jets are not equal. The break-off length is designated $BOL_{ji}$ to indicate that this is the break-off length of the $j^{th}$ jet in an initial state, before BOL control according to the present inventions has brought each jet to the chosen operating break-off length $BOL_0$ as shown below in FIG. 3. The dashed line 78 identifying the position of break-off into drops across the array highlights a BOL variation of several wavelengths, $\lambda_0$, as may be understood by noting that the spacing between drops in each stream 110 is the same, $\lambda_0$. All streams are being synchronized to the same frequency, $f_0$, however some are receiving more stimulation magnitude or exhibiting differences in nozzle flow velocity, nozzle shape, or other of the factors previously noted.

Liquid drop emitter 500 is illustrated in partial sectional view as being constructed of a substrate 10 that is formed with thermal stimulation elements surrounding nozzle structures as illustrated in FIGS. 1(*a*) and 1(*b*). Substrate 10 is also configured to have flow separation regions 28 that separate the liquid 60 flow from the pressurized liquid supply chamber 48 into streams of pressurized liquid to individual nozzles. Pressurized liquid supply chamber 48 is formed by the combination of substrate 10 and pressurized liquid supply manifold 40 and receives a supply of pressurized liquid via inlet 44 shown in phantom line. In many preferred embodiments of the present inventions substrate 10 is a single crystal semiconductor material having MOS circuitry formed therein to support various transducer elements of the liquid drop emission system. Strength members 46 are formed in the substrate 10 material to assist the structure in withstanding hydrostatic liquid supply pressures that may reach 100 psi or more.

For applications wherein the liquid drop emission system is writing a pattern of liquid, the time period. $\tau_0=1/f_0$, between drops within a stream, represents the smallest unit of time addressability, and, hence, spatial addressability in forming the desired liquid pattern. The spatial addressability at the pattern receiver location, $\delta_m$, is the product of the drop period $\tau_0$ and the velocity of relative movement between drop emitter 500 and a receiver location, $v_m$, i.e. $\delta_m \approx \tau_0\ v_m$. The BOL variation 78 illustrated in FIG. 2 will therefore reduce the amount of addressability that can be reliably utilized to no smaller than the number of drop wavelength units of BOL variation. In FIG. 2 the BOL variation is illustrated as $\sim 3\lambda_0$, so the minimum spatial addressability is compromised by a factor of 3, i.e. $\delta m \geqq 3\tau_0\ v_m$. This reduction in addressability causes a corresponding reduction in the accuracy and fineness of detail that may be reliably achieved using the liquid drop emission system to write a desired pattern, for example an image or a layer of material for electronic device fabrication.

Break-off length variation also complicates the selection process between drops that are deposited to form the desired pattern and drops that are captured by a gutter. For example, a drop charging apparatus 200 is schematically indicated in FIG. 2 as being located adjacent the break-off point for the plurality of streams 110. Drops are charged by inducing charge on each stream by the application of a voltage to an induction electrode near to each stream. When a drop breaks off the induced charge is "trapped" on the drop. Variation of break-off length causes the local induction electric field to be different stream-to-stream, causing a variation in drop charging for a given applied voltage. This charge variation, in turn, results in different amounts of deflection in a subsequent electrostatic deflection zone used to differentiate between deposited and guttered drops. Even in the case wherein no drop charging is used or no electrostatic deflection is used, the varying break-off points lead to differing amounts of drop-to-drop aerodynamic and Coulomb interaction forces that lead to varying flight trajectories and hence, to drop placement errors at the deposition target.

Element 230 in FIG. 2 is a schematic representation of a drop sensing apparatus that detects the arrival of drops in some non-contact fashion, i.e. electrostatically or optically. It may be understood from FIG. 2 that if one can mark the time of break-off of a drop and "tag" the drop in a way detectable by drop sensing apparatus 230, then sensing apparatus 230 may be used to detect the differing arrival times caused by the different flight lengths of drops of different streams 110. Drop arrival times for each stream may be used to calculate the break-off lengths of each stream.

Figure 3:
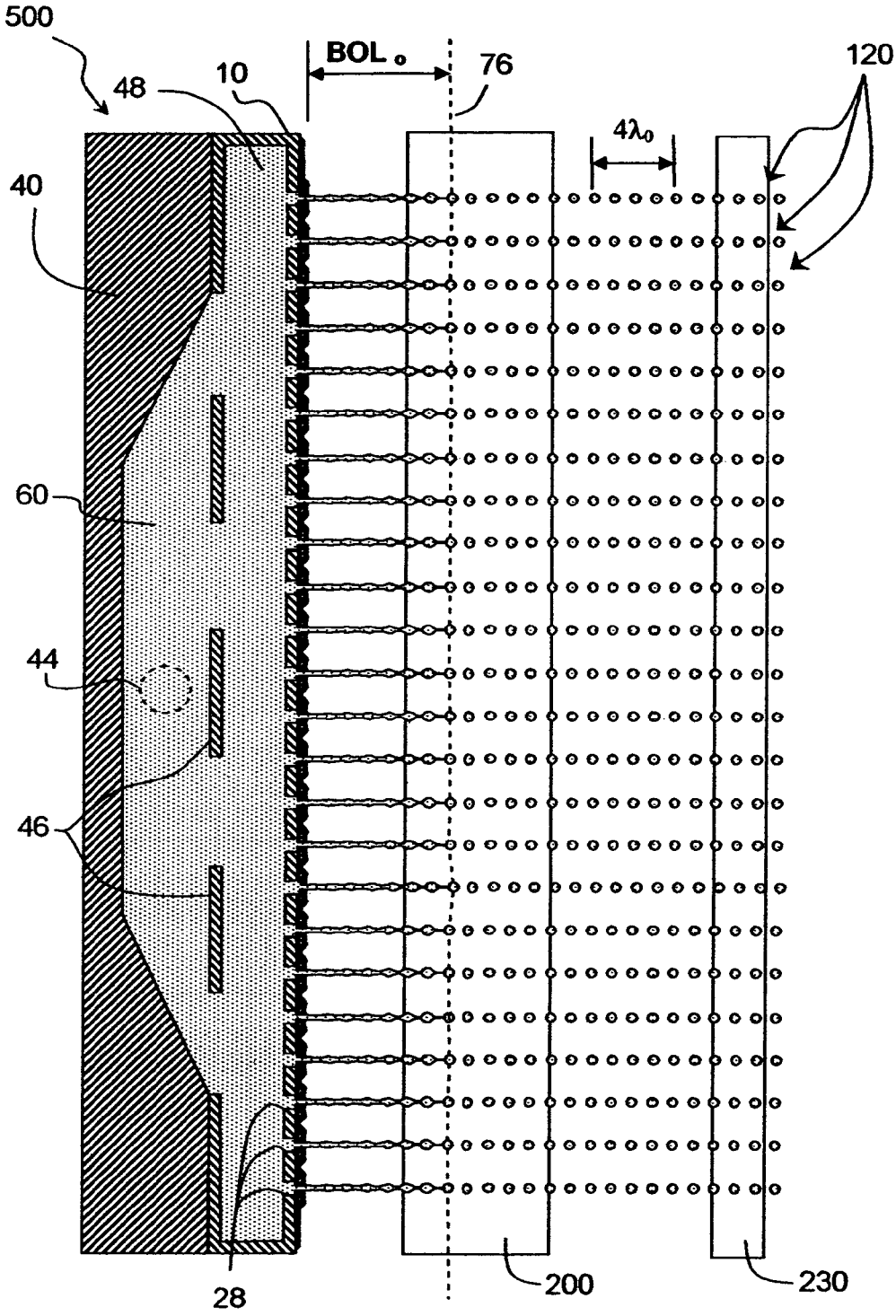
FIG. 3 is a top side view illustration of a liquid drop emitter system having a plurality of liquid streams breaking up into drops of predetermined volumes wherein the break-off lengths are controlled to an operating length according to the present inventions.

FIG. 3 illustrates a multi-jet liquid drop emitter 500 employing thermal stimulation to synchronize all of the streams to break up into streams of drops of predetermined volumes 120. However, in this case the break-off lengths 76 of the plurality of jets have been controlled to be substantially equal by adjusting the thermal stimulation energy applied to each jet individually to compensate for the factors causing the variation illustrated in FIG. 2. The dashed line 76 identifying the position of break-off into drops across the array illustrates uniform break-off at a selected operating value $BOL_0$. FIG. 3 illustrates an important object of the present inventions, break-off length control to a chosen operating length, $BOL_0$, and uniformity of break-off length for an array of a plurality of jets.

In some applications of the liquid drop emission system of the present inventions it may not be important to control the BOL to a particular value, merely to the substantially the same value within an acceptable range. However in systems employing drop deflection to multiple positions it is useful that the deflection trajectories have a known beginning point established by a know BOL. In these cases the BOL control apparatus and methods of the present invention are set up to control BOL both across an array of jets and to a certain value within an acceptable tolerance based on system requirements for drop placement accuracy at a receiver location. The tolerance to which BOL may be controlled depends on the tolerance to which drop arrival times may be sensed. It is intended that the sensing apparatus be capable of drop arrival time detection at least to within one unit of drop generation, i.e. to less than $\tau_0$.

Figure 4:
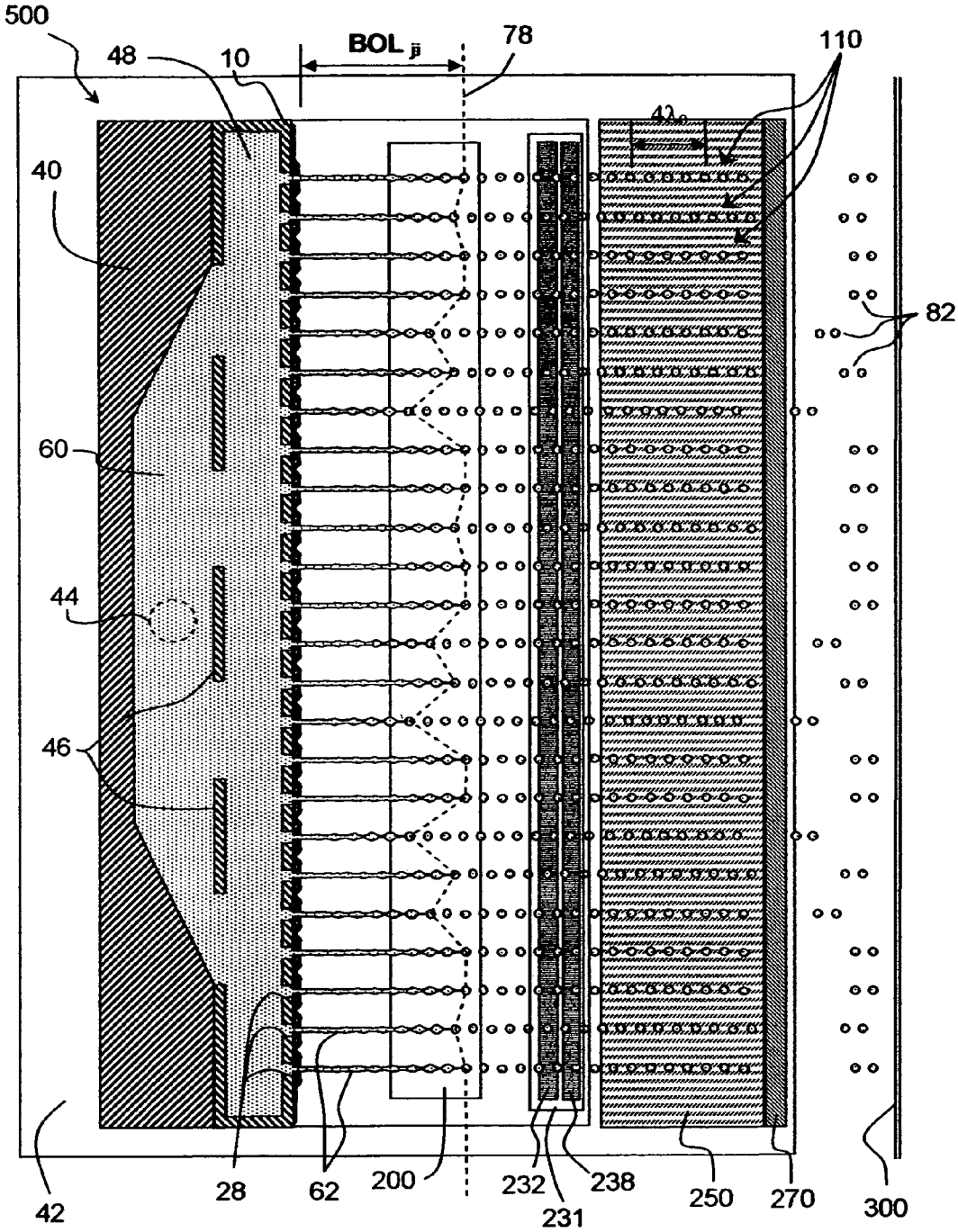
FIG. 4 is a top side view illustration of a liquid drop emitter system having a plurality of liquid streams and having drop charging, sensing, deflection and gutter drop collection apparatus according to the present inventions.

The liquid drop emission system of FIG. 4 illustrates a drop emitter 500 having thermally stimulated streams of liquid drops of predetermined volumes in a state wherein BOL 78 is not yet under control as is illustrated in FIG. 3. Additional system apparatus elements are indicated as a schematic drop charging apparatus 200, a two-electrode, differential electrostatic drop sensing apparatus 231, a deflection apparatus 250 and a drop guttering element 270. The several system apparatus elements are assembled on a d supported by support structure 42. The receiver location 300 is indicated by a double line. The receiver location is the media print plane for the case of an inkjet printer. For other applications of a liquid drop emission system the receiver location may be a substrate such as a printed circuit board, a flat panel display, a chemical sensor matrix array, or the like.

Electrodes 232 and 238 of drop sensing apparatus 231 are positioned adjacent to the plurality of drop streams 110. Electrostatic charged drop detectors are known in the prior art; for example, see U.S. Pat. No. 3,886,564 to Naylor, et al. and U.S. Pat. No. 6,435,645 to M. Falinski. As depicted in FIG. 4, drops of predetermined volume, $V_0$, are being generated at wavelength $\lambda_0$ from all drop streams 110; however the break-off lengths 78 vary from stream to stream. In the illustration of FIG. 4 most of the drops being generated are being inductively charged and subsequently deflected by deflection apparatus 250 into gutter 270. Pairs of drops 82 are not charged and not deflected and are illustrated flying towards the receiver location 300. The spatial scatter of drop pairs 82 from stream to stream replicates the variation in BOL 78. Electrodes 232 and 238 of electrostatic drop sensing apparatus 231 are illustrated as spanning the plurality of jets and have a small gap, less than $\lambda_0$ in order to be able to discriminate the passage of individual charged drops.

The break-off length of an individual stream is determined in the example configuration of FIG. 4 by selecting an individual stream for measurement, causing a pair of uncharged drops to be generated at a particular pair of drop break-off times, and then measuring the time of passage of the uncharged drops as an absence of signal. A pair of drops is employed so that the signal electronics associated with sensing apparatus 231 may be better tuned to discriminate the small signal of the missing charged drops. Other configurations of the sensing apparatus according to the present inventions will be discussed herein below. Measurement of the break-off length of individual streams in a liquid emission system utilizing charged drops and electrostatic deflection into a gutter is more efficiently accomplished with a sensing apparatus having an individual sensing element per stream in lieu of the array-wide sensor illustrated in FIG. 4.

Figure 5:
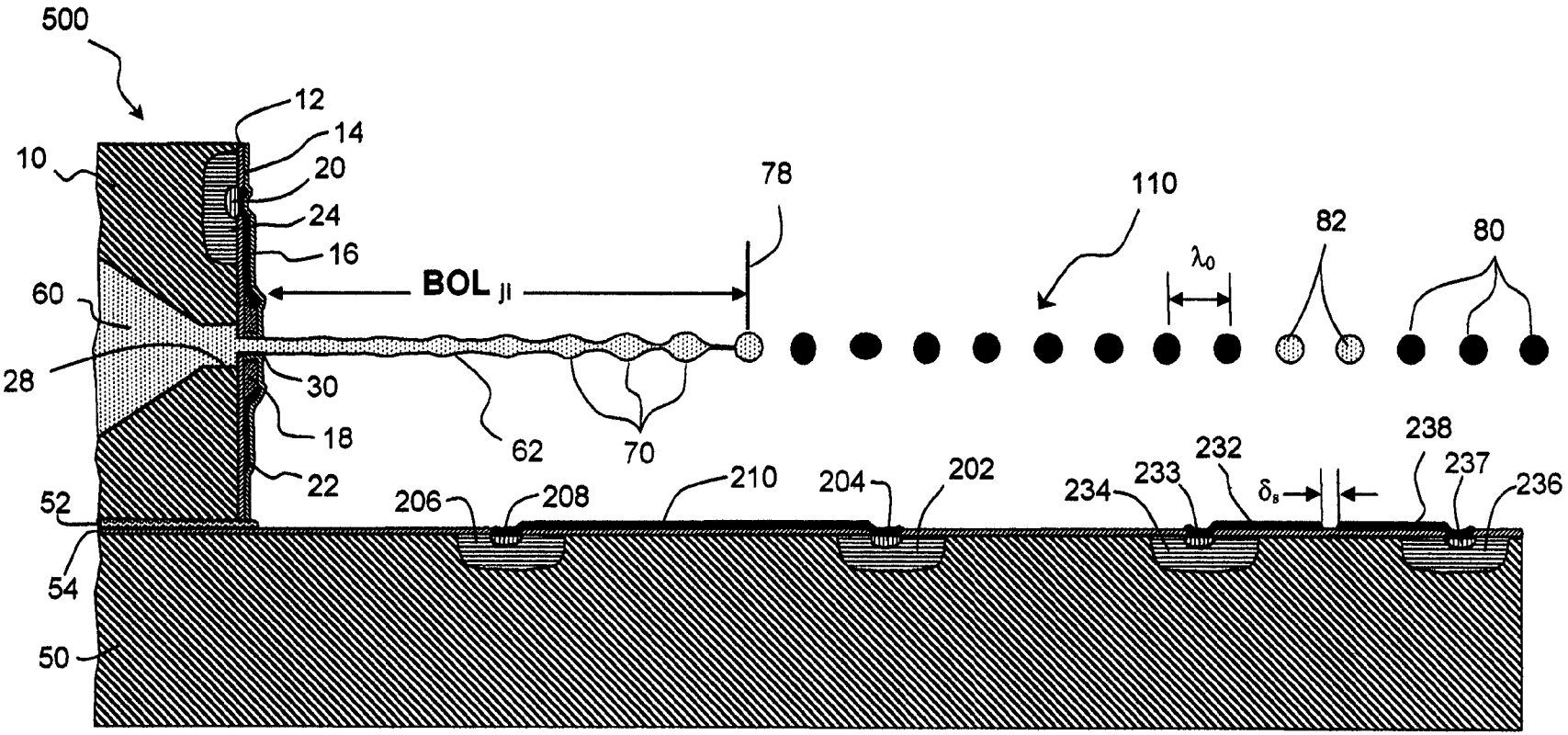
FIG. 5 is a side view illustration of a continuous liquid stream undergoing thermally stimulated break up into drops of predetermined volumes further illustrating integrated drop charging and sensing apparatus according to the present inventions.

FIG. 5 illustrates in side view a preferred embodiment of the present inventions that is constructed of a multi jet drop emitter 500 assembled to a common substrate 50 that is provided with inductive charging and electrostatic drop sensing apparatus. Only a portion of the drop emitter 500 structure is illustrated and FIG. 5 may be understood to also depict a single jet drop emitter according to the present inventions as well as one jet of a plurality of jets in multi-jet drop emitter 500. Substrate 10 is comprised of a single crystal semiconductor material, typically silicon, and has integrally formed heater resistor elements 18 and MOS power drive circuitry 24. MOS circuitry 24 includes at least a power driver circuit or transistor and is attached to resistor 18 via a buried contact region 20 and interconnection conductor run 16. A common current return conductor 22 is depicted that serves to return current from a plurality of heater resistors 18 that stimulate a plurality of jets in a multi-jet array. Alternately a current return conductor lead could be provided for each heater resistor. Layers 12 and 14 are electrical and chemical passivation layers.

The drop emitter functional elements illustrated herein may be constructed using well known microelectronic fabrication methods. Fabrication techniques especially relevant to the CIJ stimulation heater and MOS circuitry combination utilized in the present inventions are described in U.S. Pat. Nos. 6,450,619; 6,474,794; and 6,491,385 to Anagnostopoulos, et al., assigned to the assignees of the present inventions.

Substrate 50 is comprised of either a single crystal semiconductor material or a microelectronics grade material capable of supporting epitaxy or thin film semiconductor MOS circuit fabrication. An inductive drop charging apparatus in integrated in substrate 50 comprising charging electrode 210, buried MOS circuitry 206, 202 and contacts 208, 204. The integrated MOS circuitry includes at least amplification circuitry with slew rate capability suitable for inductive drop charging within the period of individual drop formation, $\tau_0$. While not illustrated in the side view of FIG. 5, the inductive charging apparatus is configured to have an individual electrode and MOS circuit capability for each jet of multi-jet liquid drop emitter 500 so that the charging of individual drops within individual streams may be accomplished.

Integrated drop sensing apparatus comprises a dual electrode structure depicted as dual electrodes 232 and 238 having a gap $\delta_s$ therebetween along the direction of drop flight. The dual electrode gap $\delta_s$ is designed to be less than a drop wavelength $\lambda_0$ to assure that drop arrival times may be discriminated with accuracies better than a drop period, $\tau_0$. Integrated sensing apparatus MOS circuitry 234, 236 is connected to the dual electrodes via connection contacts 233, 237. The integrated MOS circuitry comprises at least differential amplification circuitry capable of detecting above the noise the small voltage changes induced in electrodes 232, 238 by the passage of charged drops 84. In FIG. 5 a pair of uncharged drops 82 is detected by the absence of a two-drop voltage signal pattern within the stream of charged drops.

Layer 54 is a chemical and electrical passivation layer. Substrate 50 is assembled and bonded to drop emitter 500 via adhesive layer 52 so that the drop charging and sensing apparatus are properly aligned with the plurality of drop streams.

Figure 6:
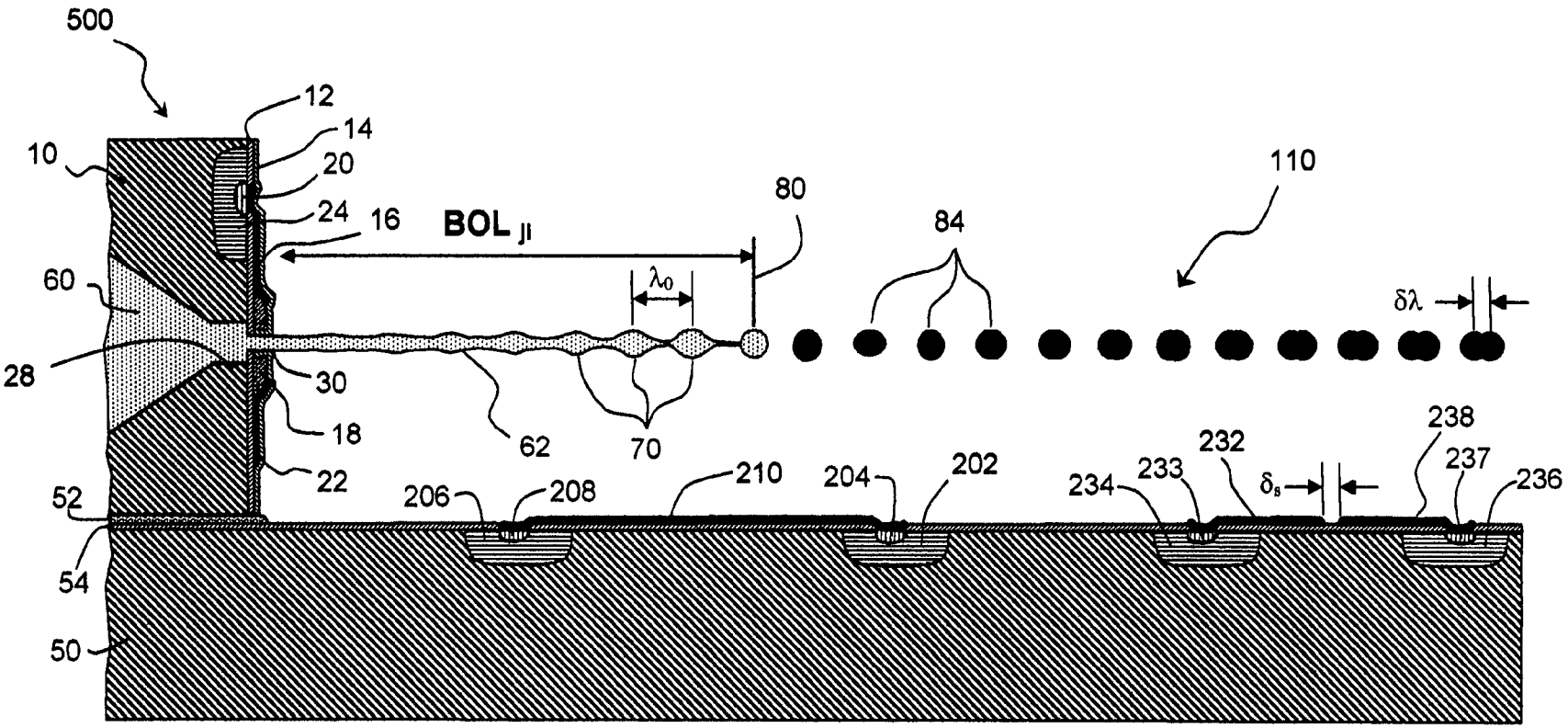
FIG. 6 is a side view illustration of a continuous liquid stream undergoing thermally stimulated break up into drops of predetermined volumes further illustrating a characteristic of the drop stream according to the present inventions.

FIG. 6 illustrates the same drop emitter 500 set-up as is shown in FIG. 5. However, instead of measuring the pattern of two uncharged drops described with respect to FIG. 5, in FIG. 6 all drops 84 are charged and the arrival time or the time between adjacent drop arrivals is sensed in order to measure a characteristic of the stream 110. FIG. 6 depicts the positions of the drops the stream of drops as having some spread or deviation in wavelength, $\delta_\lambda$, that becomes more apparent as the stream is examined father from break-off point 78. It is observed with synchronized continuous streams that the break-off time or length becomes noisy about a mean value as the stimulation energy is reduced. When a stream is viewed using stroboscopic illumination pulsed at the synchronization frequency, $f_0$, this noise is apparent in the "fuzziness" of the drop images, termed drop jitter. If the stimulation intensity is increased, the break-off length shortens and the drop jitter reduces. Thus drop jitter is related to the BOL.

FIG. 6 depicts a break-off length control apparatus and method wherein the deviation in the period of drop arrival times, or the real-time wavelength, is measured as a characteristic of the stream of drops that relates directly to the break-off length of the stream. For example, the frequency content of the signal produced by the dual electrode sensing apparatus as charged drops pass over sensor gap $\delta_s$ may be analyzed for the width, $\delta f$, of the frequency peak at the stimulation frequency, $f_0$, i.e. the so-called frequency jitter. The break-off length may then be calculated or found in a look-up table of experimentally calibrated results relating frequency jitter, $\delta_f$, to stimulation intensity and thereby, break-off length.

One advantage of sensing frequency jitter (wavelength deviation) in order to calculate break-off length is that this measure may be performed without singling out a drop or a pattern of drops by either charging or by deflection along two pathways. All drops being generated may be charged identically and deflected to a gutter for collection and recirculation while making the break-off length calibration measurement. A common and constant voltage may be applied to all jets for this measurement provided the sensing apparatus has a sensor per jet. This may be useful for the situation wherein a jet has an excessively long break-off length extending to the outer edge of the charging electrode 210, or even somewhat beyond it, causing poor drop charging. The frequency jitter measurement may be made using highly sensitive phase locked loop noise discrimination circuitry locked to the stimulation frequency even if reduced drop charge levels have degraded the signal detected by sensing electrodes 232, 238.

Figure 7:
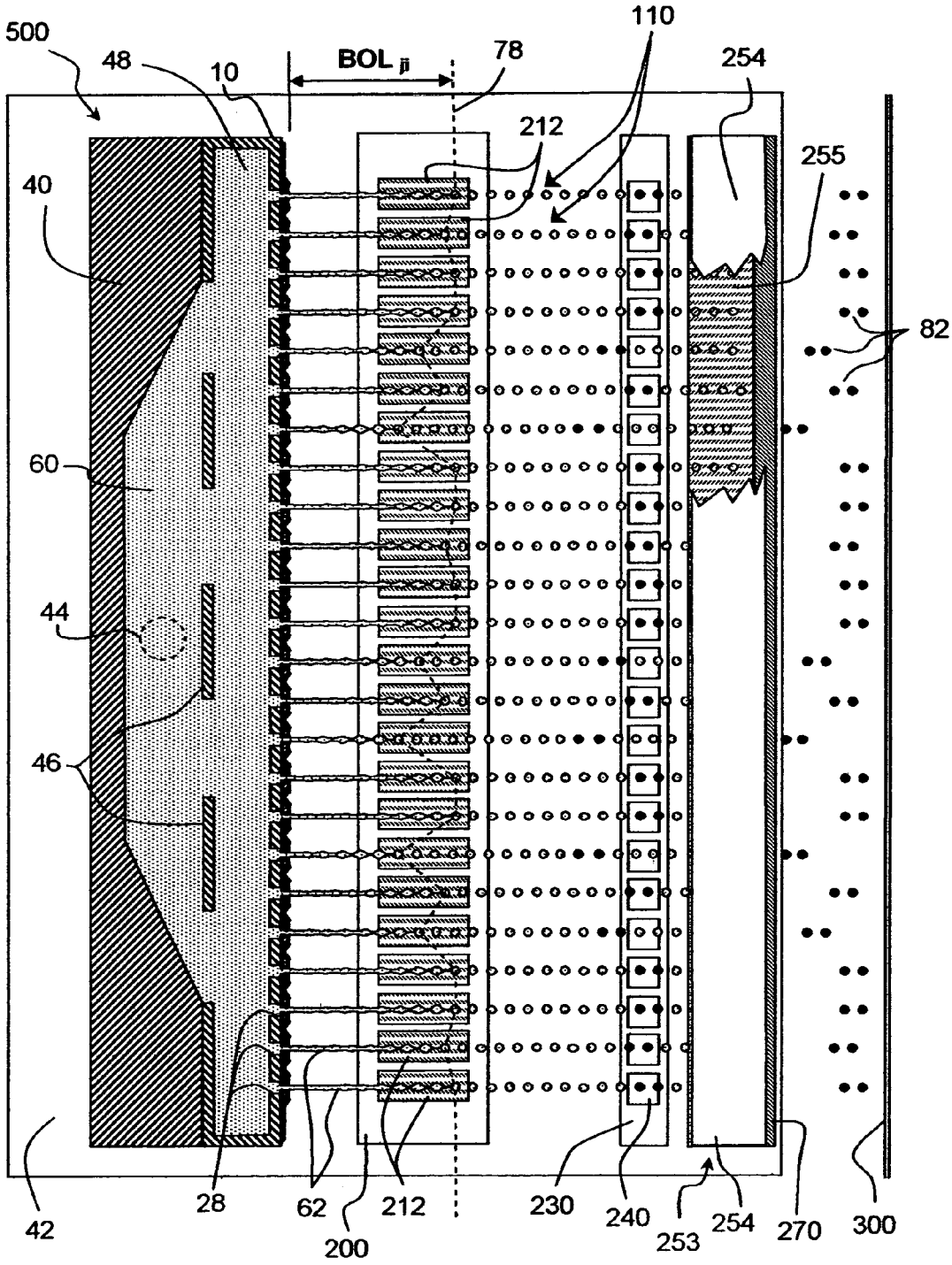
FIG. 7 is a top side view illustration of a liquid drop emitter system having a plurality of liquid streams and having individual drop charging and sensing apparatus for each jet according to the present inventions.

FIG. 7 depicts in top sectional view a liquid drop emission system according to the present inventions wherein the inductive charging apparatus 200 comprises a plurality of charging electrodes 212, one for each jet stream 110. Also provided is an electrostatic charge sensor 230 having a plurality of sensor site elements 240, one for each jet. This configuration allows the sensing of a characteristic of each drop stream 110 simultaneously.

Also depicted in FIG. 7 is a Coulomb force deflection apparatus 253 comprising a lower plate 255 held at ground potential and an upper plate 254 held at a positive high voltage. The lower plate 253 is revealed in cut-away view beneath the upper deflection plate 254. This deflection plate arrangement creates an electric field, $E_d$, that exerts a Coulomb force, $F_c=q_0E_d$, on drops having charge $q_0$ in a direction perpendicular to the initial stream trajectory, i.e. in a direction out of the plane of FIG. 7, toward the viewer. A gutter 270 is arranged to capture uncharged, undeflected drops; some of which are revealed in the area of cutaway of upper plate 254. Charged drops 84 are lifted by the Coulomb force above the lip of gutter 270 so that they fly to the receiver plane 300.

A pattern of two charged drops 82 is used to make a measurement of arrival time from the break-off point for each stream. This measurement may then be used to characterize each stream and then calculate the break-off lengths, $BOL_{ji}$. Alternatively, other patterns of charged and uncharged drops, including a single charged drop, may be used to sense and determine a stream characteristic related to break-off length.

The various component apparatus of the liquid drop emission system are not intended to be shown to relative distance scale in FIG. 7. In practice a Coulomb deflection apparatus such as the E-field type 253 illustrated, would be much longer relative to typical stream break-off lengths and charging apparatus in order to develop enough off axis movement to clear the lip of gutter 270.

Figure 8:
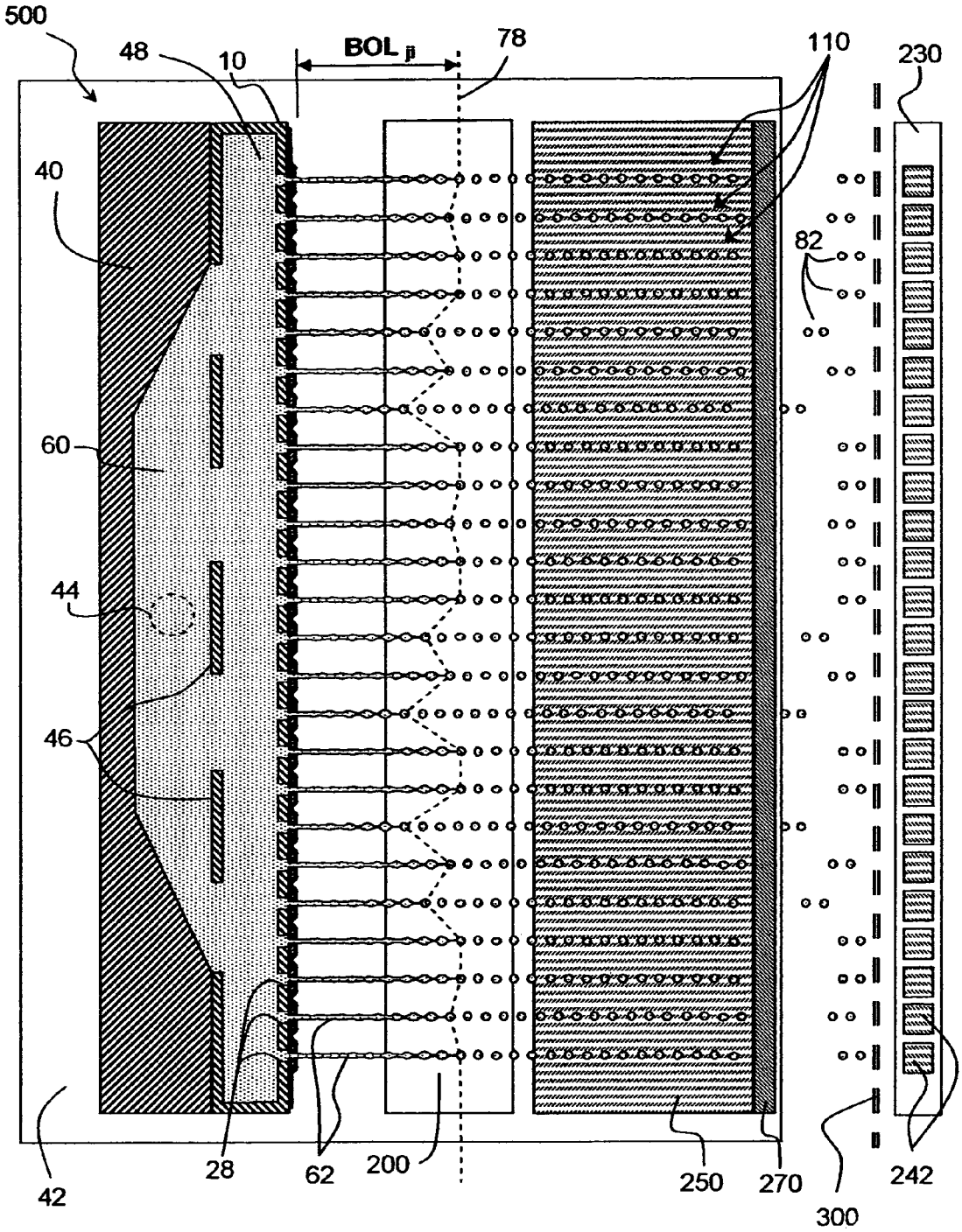
FIG. 8 is a top side view illustration of a liquid drop emitter system having a plurality of liquid streams and having individual drop sensing apparatus responsive to uncharged drops for each jet located after a drop deflection apparatus according to the present inventions.

FIG. 8 illustrates another of the preferred embodiments of the present inventions wherein the drop sensing apparatus 242 is positioned behind the receiver plane location 300 shown in phantom lines. A sensor in this position relieves the contention for space in the region between the liquid drop emitter 500 and gutter 270. As a practical matter it is desirable that the receiver plane 300 be as close to the drop emitter 500 nozzle face as is possible given the need for space for break-off lengths, inductive charging apparatus, drop deflection apparatus, drop guttering apparatus, and drop sensing apparatus. Drops emitted from different nozzles within a plurality of nozzles will not have precisely identical initial trajectories, i.e., will not have identical firing directions. The differences among firing directions therefore lead to an accumulation of spatial differences as the drops move farther and farther from the nozzle. Such spatial dispersion is another source of drop misplacement at the receiver location. Minimizing the nozzle-to-receiver plane distance, commonly termed the "throw distance", minimizes the drop placement errors arising from jet-to-jet firing direction non-uniformity.

Sensing apparatus 230 is illustrated having individual sensor sites 242, one per jet of the plurality of jets 110. Because the sensor is located behind the receiver location plane, it may only sense drops that follow a printing trajectory rather than a guttering trajectory. A variety of physical mechanisms could be used to construct sensor sites 242. If uncharged drops are used for printing or depositing the pattern at the receiver location then it is usefully to detect drops optically. If charged drops are used to print, then the sensor sites might also be based on electrostatic effects. Alternatively, sensing apparatus 230 could be positioned so that drops impact sensor sites 242. In this case physical mechanisms responsive to pressure, such as piezoelectric or electrostrictive transducers, are useful.

Figure 9:
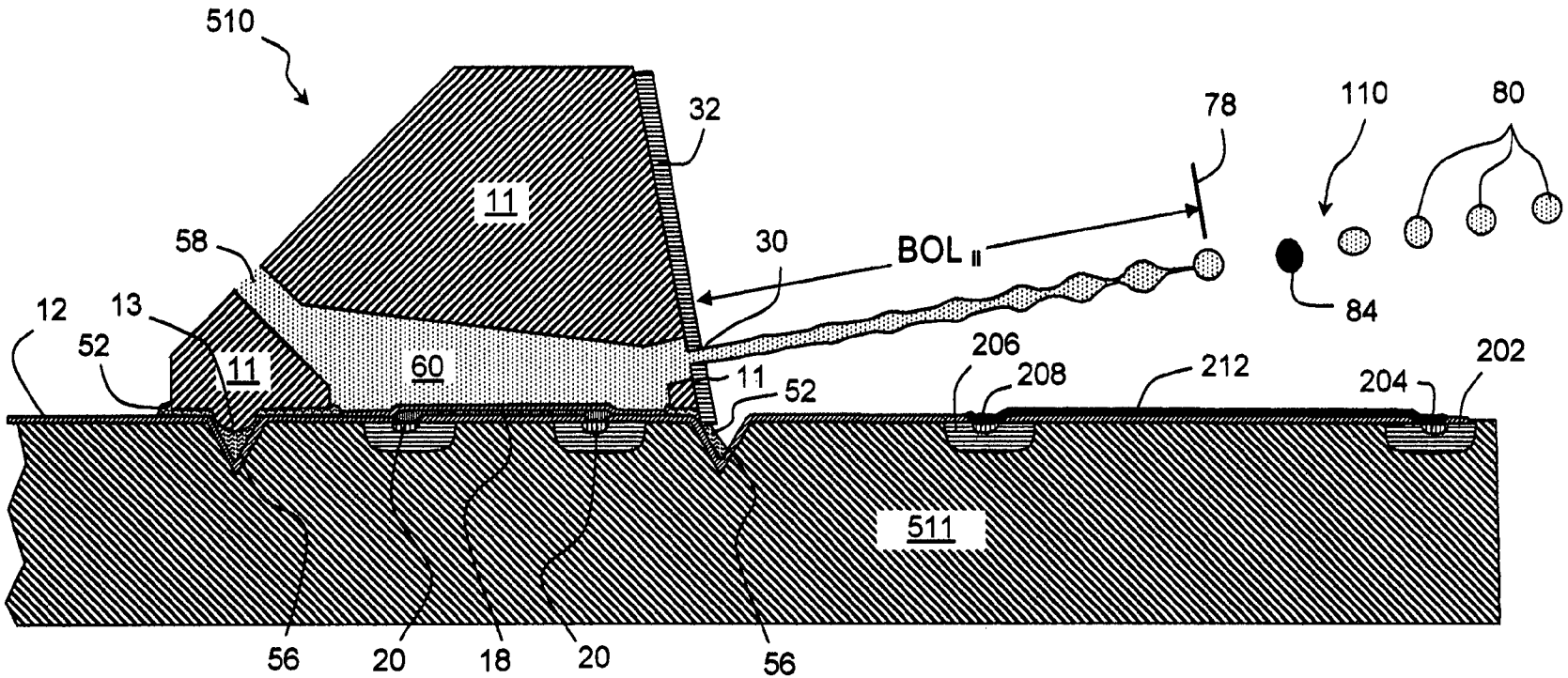
FIG. 9 is a side view illustration of an edgeshooter style liquid drop emitter undergoing thermally stimulated break up into drops of predetermined volumes further illustrating integrated resistive heater and drop charging apparatus according to the present inventions.

FIG. 9 illustrates in side view an alternate embodiment of the present inventions wherein the drop emitter 510 is constructed in similar fashion to a thermal ink jet edgeshooter style printhead. Drop emitter 510 is formed by bonding a semiconductor substrate 511 to a pressurized liquid supply chamber and flow separation member 11. Supply chamber member 11 is fitted with a nozzle plate 32 having a plurality of nozzles 30. Alignment groove 56 is etched into substrate 511 to assist in the location of the components forming the upper and lower portions of the liquid flow path, i.e. substrate 511, chamber member 11 and nozzle plate 32. Chamber member 11 is formed with a chamber mating feature 13 that engages alignment groove 56. A bonding and sealing material 52 completes the space containing high pressure liquid 60 supplied to nozzle 30 via a flow separation region 28 (shown below in FIG. 10) bounded on one side by heater resistor 18.

In contrast to the configuration of the drop emitter 500 illustrated in FIG. 5, drop emitter 510 does not jet the pressurized liquid from an orifice formed in or on substrate 511 but rather from an nozzle 30 in nozzle plate 32 oriented nearly perpendicular to substrate 511. Resistive heater 18 heats pressurized fluid only along one wall of a flow separation passageway 28 prior to the jet formation at nozzle 30. While somewhat more distant from the point of jet formation than for the drop emitter 500 of FIG. 5, the arrangement of heater resistor 18 as illustrated in FIG. 9 is still quite effective in providing thermal stimulation sufficient for jet break-up synchronization.

The edgeshooter drop emitter 510 configuration is useful in that the integration of inductive charging apparatus and resistive heater apparatus may be achieved in a single semiconductor substrate as illustrated. The elements of the resistive heater apparatus and inductive charging apparatus in FIG. 9 have been given like identification label numbers as the corresponding elements illustrated and described in connection with above FIG. 5. The description of these elements is the same for the edgeshooter configuration drop emitter 510 as was explained above with respect to the drop emitter 500.

The direct integration of drop charging and thermal stimulation functions assures that there is excellent alignment of these functions for individual jets. Additional circuitry may be integrated to perform jet stimulation and drop charging addressing for each jet, thereby greatly reducing the need for bulky and expensive electrical interconnections for multi-jet drop emitters having hundreds or thousands jets per emitter head.

Figure 10:
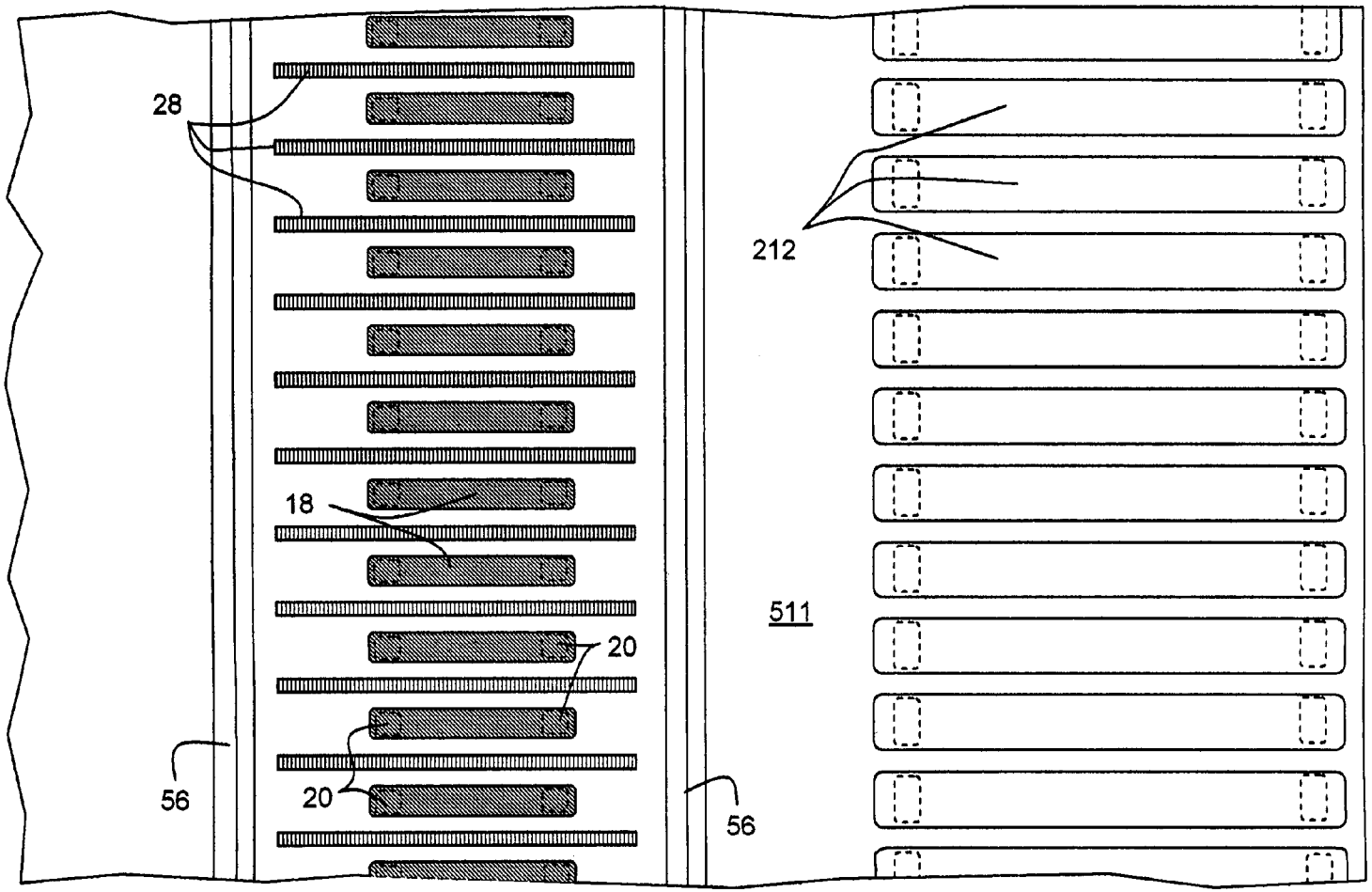
FIG. 10 is a plan view of part of the integrated heater and drop charger per jet array apparatus.

FIG. 10 illustrates in plan view a portion of semiconductor substrate 511 further illuminating the layout of fluid heaters 18, flow separation walls 28 and drop charging electrodes 212. The flow separation walls 28 are illustrated as being formed on substrate 511, for example using a thick photo-patternable material such as polyimide, resist, or epoxy. However, the function of separating flow to a plurality of regions over heater resistors may also be provided as features of the flow separation and chamber member 11, in yet another component layer, or via some combination of these components. Drop charging electrodes 212 are aligned with heaters 18 in a one-for-one relationship achieved by precision microelectronic photolithography methods. The linear extent of drop charging electrodes 212 is typically designed to be sufficient to accommodate some range of jet break-off lengths and still effectively couple a charging electric field to its individual jet. However, in some embodiments to be discussed below, shortened drop charging electrodes are used assist in break-off length measurement.

Figure 11A:
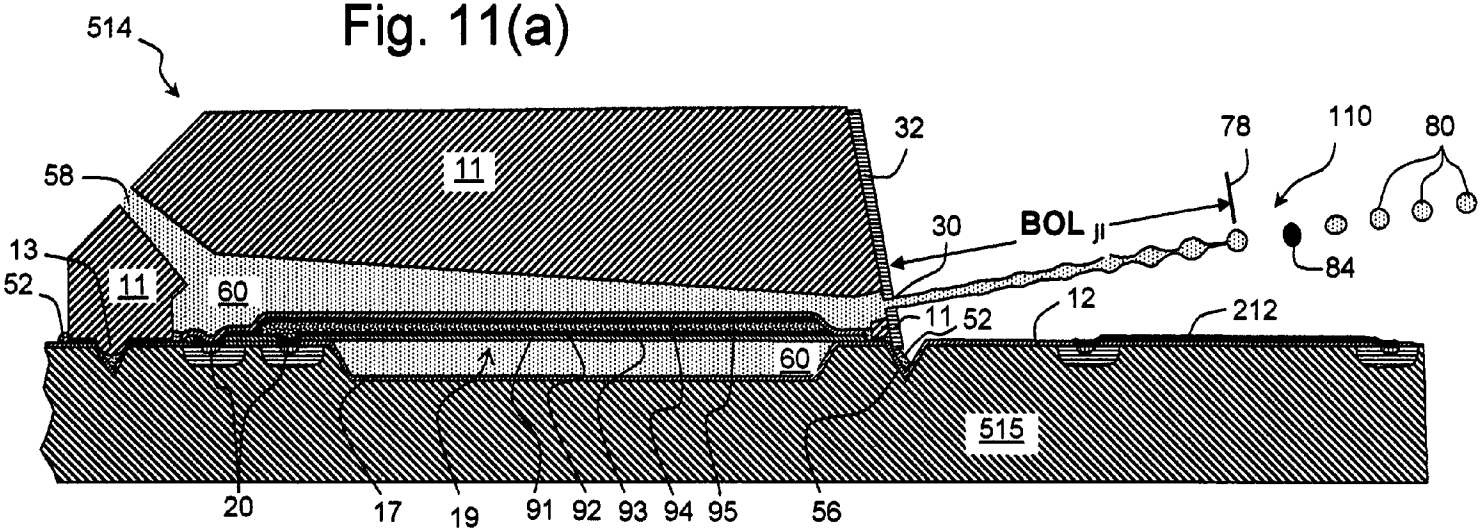
FIGS. 11(*a*) and 11(*b*) are side view illustrations of an edgeshooter style liquid drop emitter having an electromechanical stimulator for each jet.
Figure 11B:
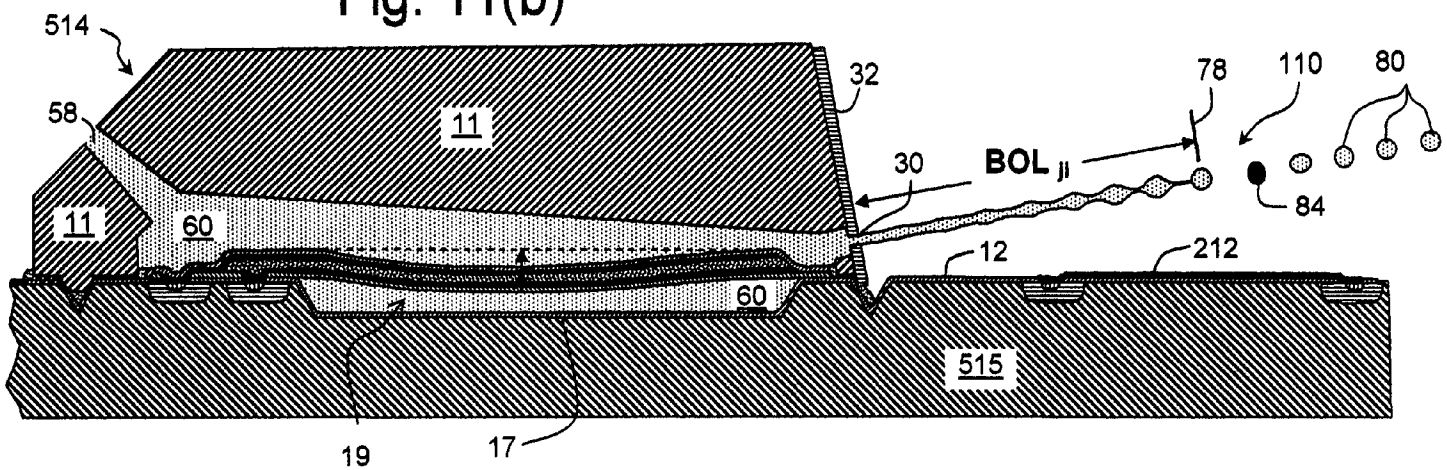
Figure 13A:
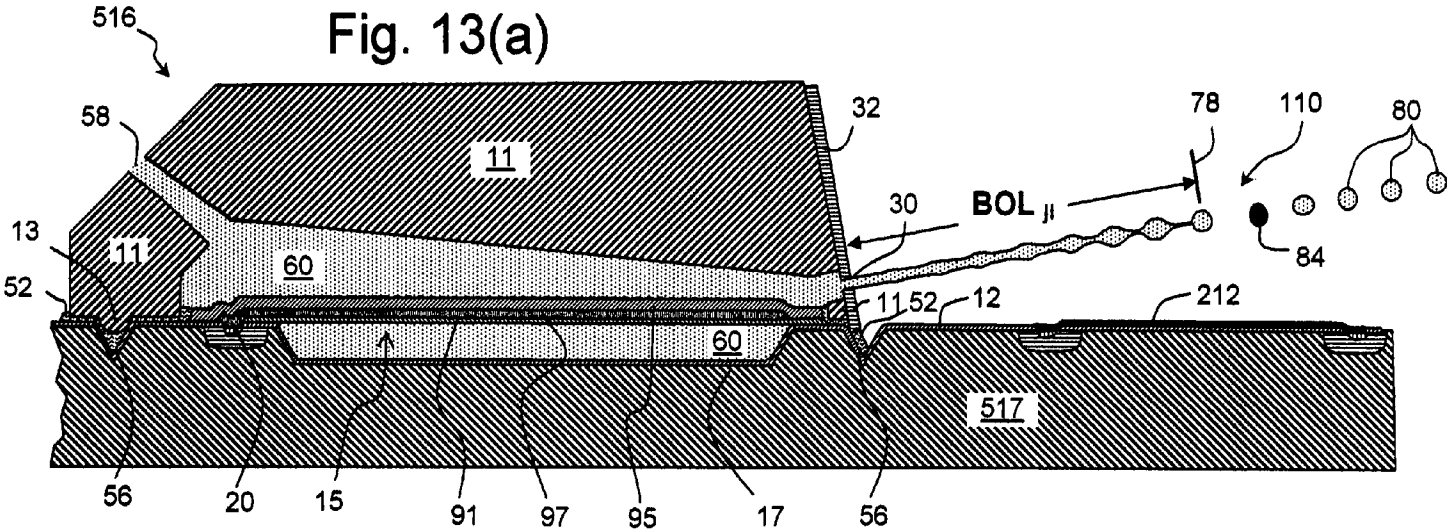
FIGS. 13(*a*) and 13(*b*) are side view illustrations of an edgeshooter style liquid drop emitter having a thermomechanical stimulator for each jet.
Figure 13B:
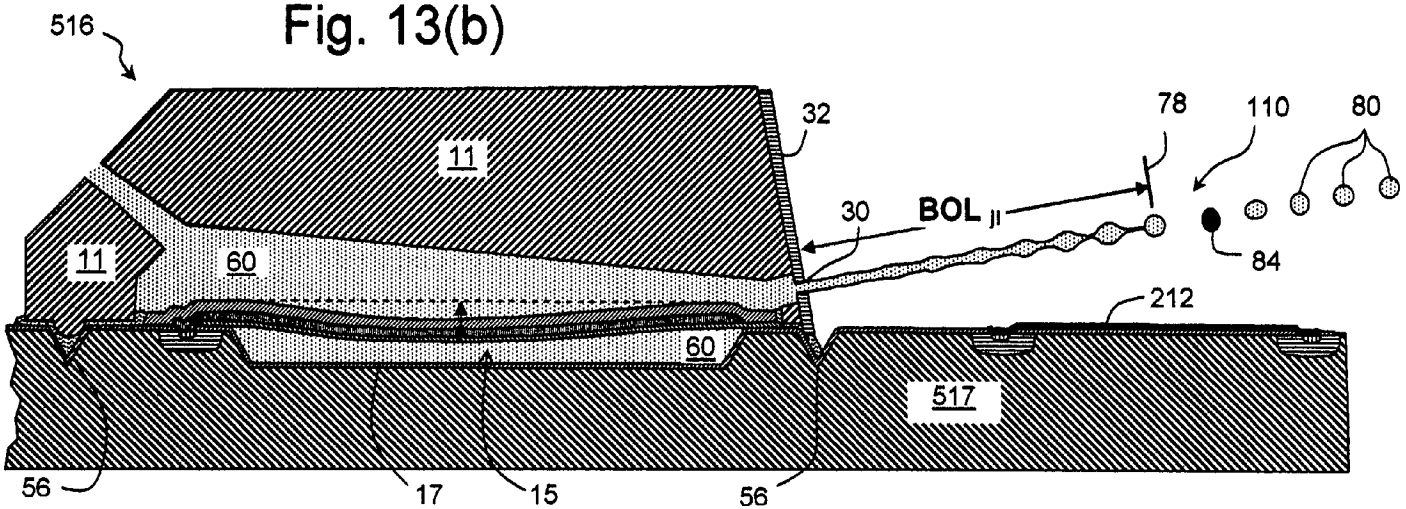

FIGS. 11(*a*) through 14 illustrate alternative embodiments of the present inventions wherein micromechanical transducers are employed to introduce Rayleigh stimulation energy to jets on an individual basis. The micromechanical transducers illustrated operate according to two different physical phenomena; however they all function to transduce electrical energy into mechanical motion. The mechanical motion is facilitated by forming each transducer over a cavity so that a flexing and vibrating motion is possible. FIGS. 11(*a*), 11(*b*) and 12 show jet stimulation apparatus based on electromechanical materials that are piezoelectric, ferroelectric or electrostrictive. FIGS. 13(*a*), 13(*b*) and 14 show jet stimulation apparatus based on thermomechanical materials having high coefficients of thermal expansion.

FIGS. 11(*a*) and 11(*b*) illustrate an edgeshooter configuration drop emitter 514 having most of the same functional elements as drop emitter 512 discussed previously and shown in FIG. 9. However, instead of having a resistive heater 18 per jet for stimulating a jet by fluid heating, drop emitter 512 has a plurality of electromechanical beam transducers 19. Semiconductor substrate 515 is formed using microelectronic methods, including the deposition and patterning of an electroactive (piezoelectric, ferroelectric or electrostrictive) material, for example PZT, PLZT or PMNT. Electromechanical beam 19 is a multilayered structure having an electroactive material 92 sandwiched between conducting layers 92, 94 that are, in turn, protected by passivation layers 91, 95 that protect these layers from electrical and chemical interaction with the working fluid 60 of the drop emitter 514. The passivation layers 91, 95 are formed of dielectric materials having a substantial Young's modulus so that these layers act to restore the beam to a rest shape.

A transducer movement cavity 17 is formed beneath each electromechanical beam 19 in substrate 515 to permit the vibration of the beam. In the illustrated configuration, working fluid 60 is allowed to surround the electromechanical beam so that the beam moves against working fluid both above and below its rest position (FIG. 11(*a*)), as illustrated by the arrow in FIG. 11(*b*). An electric field is applied across the electroactive material 93 via conductors above 94 and beneath 92 it and that are connected to underlying MOS circuitry in substrate 515 via contacts 20. When a voltage pulse is applied across the electroactive material 93, the length changes causing the electromechanical beam 19 to bow up or down. Dielectric passivation layers 91, 95 surrounding the conductor 92, 94 and electroactive material 93 layers act to restore the beam to a rest position when the electric field is removed. The dimensions and properties of the layers comprising electromechanical beam 19 may be selected to exhibit resonant vibratory behavior at the frequency desired for jet stimulation and drop generation.

Figure 12:
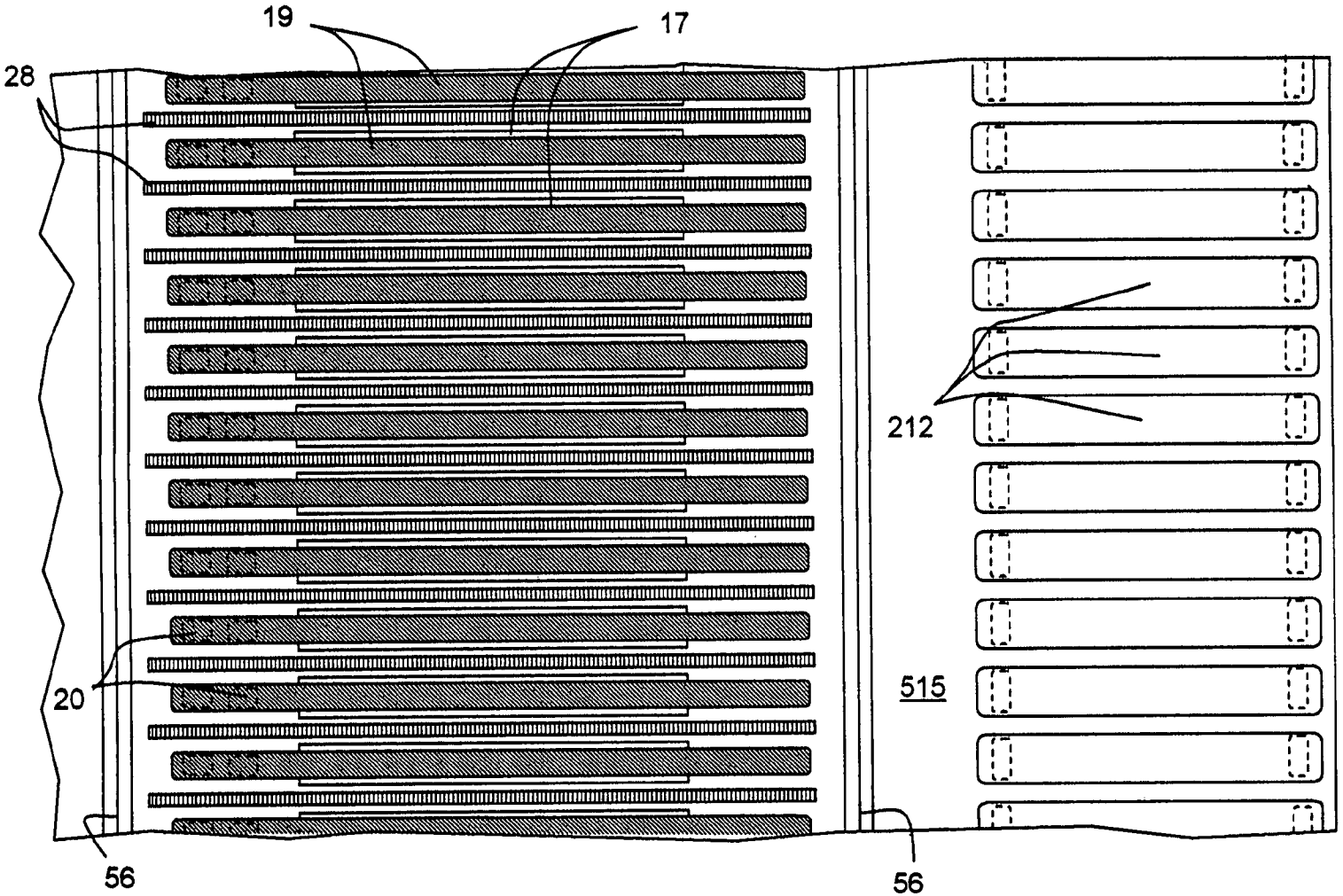
FIG. 12 is a plan view of part of the integrated electromechanical stimulator and drop charger per jet array apparatus.

FIG. 12 illustrates in plan view a portion of semiconductor substrate 515 further illuminating the layout of electromechanical beam transducers 19, flow separation walls 28 and drop charging electrodes 212. The above discussion with respect to FIG. 10, regarding the formation of flow separator walls 28 and positioning of drop charging electrodes 212, applies also to these elements present for drop emitter 514 and semiconductor substrate 515.

Transducer movement cavities 17 are indicated in FIG. 12 by rectangles which are largely obscured by electromechanical beam transducers 19. Each beam transducer 19 is illustrated to have two electrical contacts 20 shown in phantom lines. One electrical contact 20 attaches to an upper conductor layer and the other to a lower conductor layer. The central electroactive material itself is used to electrically isolate the upper conductive layer form the lower in the contact area.

FIGS. 13(*a*) and 13(*b*) illustrate an edgeshooter configuration drop emitter 516 having most of the same functional elements as drop emitter 512 discussed previously and shown in FIG. 9. However, instead of having a resistive heater 18 per jet for stimulating a jet by fluid heating, drop emitter 516 has a plurality of thermomechanical beam transducers 15. Semiconductor substrate 517 is formed using microelectronic methods, including the deposition and patterning of an electroresistive material having a high coefficient of thermal expansion, for example titanium aluminide, as is disclosed by Jarrold et al., U.S. Pat. No. 6,561,627, issued May 13, 2003, assigned to the assignee of the present inventions. Thermomechanical beam 15 is a multilayered structure having an electroresistive material 97 having a high coefficient of thermal expansion sandwiched between passivation layers 91, 95 that protect the electroresistive material layer 97 from electrical and chemical interaction with the working fluid 60 of the drop emitter 516. The passivation layers 91, 95 are formed of dielectric materials having a substantial Young's modulus so that these layers act to restore the beam to a rest shape. In the illustrated embodiment the electroresistive material is formed into a U-shaped resistor through which a current may be passed.

A transducer movement cavity 17 is formed beneath each thermomechanical beam in substrate 517 to permit the vibration of the beam. In the illustrated configuration, working fluid 60 is allowed to surround the thermomechanical beam 15 so that the beam moves against working fluid both above and below its rest position (FIG. 13(*a*)), as illustrated by the arrow in FIG. 13(*b*). An electric field is applied across the electroresistive material via conductors that are connected to underlying MOS circuitry in substrate 511 via contacts 20. When a voltage pulse is applied a current is established, the electroresistive material heats up causing its length to expand and causing the thermomechanical beam 17 to bow up or down. Dielectric passivation layers 91, 95 surrounding the electroresistive material layer 97 act to restore the beam 15 to a rest position when the electric field is removed and the beam cools. The dimensions and properties of the layers comprising thermomechanical beam 19 may be selected to exhibit resonant vibratory behavior at the frequency desired for jet stimulation and drop generation.

Figure 14:
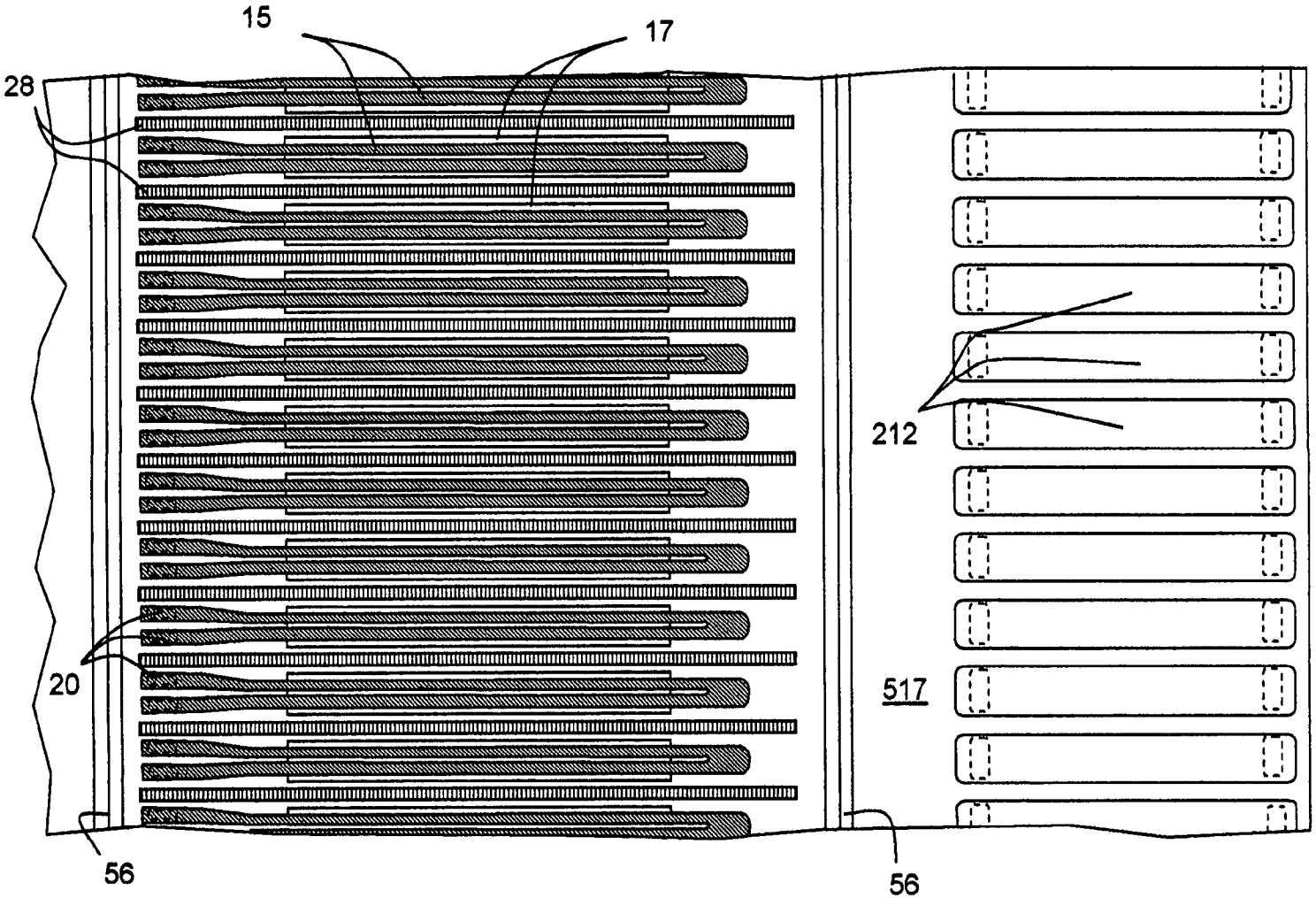
FIG. 14 is a plan view of part of the integrated thermomechanical stimulator and drop charger per jet array apparatus.

FIG. 14 illustrates in plan view a portion of semiconductor substrate 517 further illuminating the layout of thermomechanical beam transducers 15, flow separation walls 28 and drop charging electrodes 212. The above discussion with respect to FIG. 10, regarding the formation of flow separator walls 28 and positioning of drop charging electrodes 212, applies also to these elements present for drop emitter 516 and semiconductor substrate 517.

Transducer movement cavities 17 are indicated in FIG. 14 by rectangles which are largely obscured by U-shaped thermomechanical beam transducers 15. Each beam transducer 15 is illustrated to have two electrical contacts 20. While FIG. 14 illustrates a U-shape for the beam itself, in practice only the electroresistive material, for example titanium aluminide, is patterned in a U-shape by the removal of a central slot of material. Dielectric layers, for example silicon oxide, nitride or carbide, are formed above and beneath the electroresistive material layer and pattered as rectangular beam shapes without central slots. The electroresistive material itself is brought into contact with underlying MOS circuitry via contacts 20 so that voltage (current) pulses may be applied to cause individual thermomechanical beams 15 to vibrate to stimulate individual jets.

Figure 15:
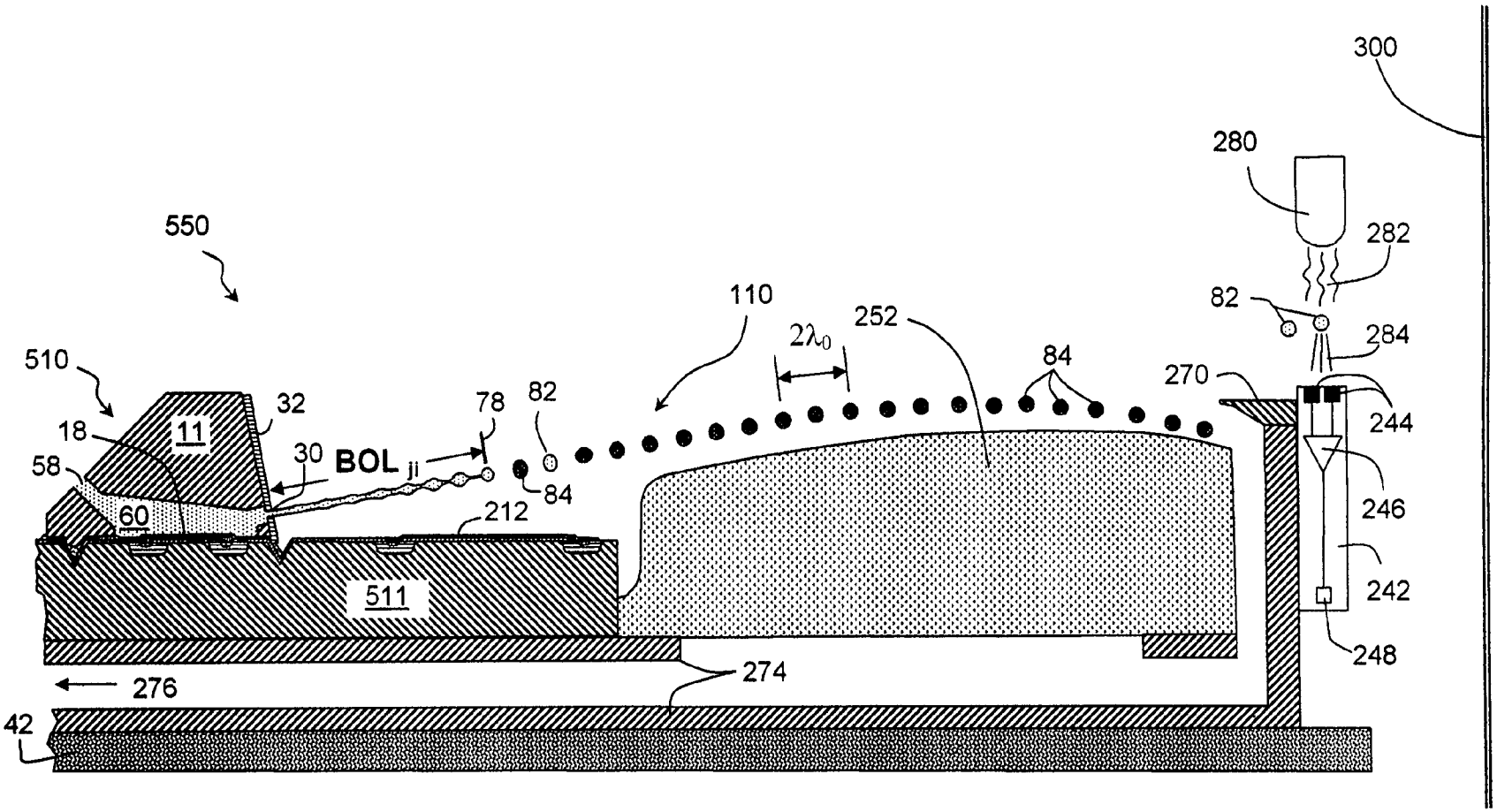
FIG. 15 is a side view illustration of an edgeshooter style liquid drop emitter as shown in FIG. 9 further illustrating drop deflection, guttering and optical sensing apparatus according to the present inventions.

FIG. 15 illustrates, in side view of one jet 110, a more complete liquid drop emission system 550 assembled on system support 42 comprising a drop emitter 510 of the edgeshooter type shown in FIG. 9. Drop emitter 510 with integrated inducting charging apparatus and MOS circuitry is further combined with a ground-plane style drop deflection apparatus 252, drop gutter 270 and optical sensor site 242. Gutter liquid return manifold 274 is connected to a vacuum source (not shown indicated as 276) that withdraws liquid that accumulates in the gutter from drops tat are not used to form the desired pattern at receiver plane 300.

Ground plane drop deflection apparatus 252 is a conductive member held at ground potential. Charged drops flying near to the grounded conductor surface induce a charge pattern of opposite sign in the conductor, a so-called "image charge" that attracts the charged drop. That is, a charged drop flying near a conducting surface is attracted to that surface by a Coulomb force that is approximately the force between itself and an oppositely charged drop image located behind the conductor surface an equal distance. Ground plane drop deflector 252 is shaped to enhance the effectiveness of this image force by arranging the conductor surface to be near the drop stream shortly following jet break-off. Charged drops 84 are deflected by their own image force to follow the curved path illustrated to be captured by gutter lip 270 or to land on the surface of deflector 252 and be carried into the vacuum region by their momentum. Ground plane deflector 252 also may be usefully made of sintered metal, such as stainless steel and communicated with the vacuum region of gutter manifold 274 as illustrated.

Uncharged drops are not deflected by the ground plane deflection apparatus 252 and travel along an initial trajectory toward the receiver plane 300 as is illustrated for a two drop pair 82. An optical sensing apparatus is arranged immediately after gutter 270 to sense the arrival or passage of uncharged "print" or calibration test drops. Optical drop sensors are known in the prior art; for example, see U.S. Pat. No. 4,136,345 to Neville, et al. and U.S. Pat. No. 4,255,754 to Crean, et al. Illumination apparatus 280 is positioned above the post gutter flight path and shines light 282 downward toward light sensing elements 244. Drops 82 cast a shadow 284, or a shadow pattern for multiple drop sequences, onto optical sensor site 242. Light sensing elements 244 within optical sensor site 242 are coupled to differential amplifying circuitry 246 and then to sensor output pad 248. Optical sensor site 242 is comprised at least of one or more light sensing elements 244 and amplification circuitry 246 sufficient to signal the passage of a drop. As discussed above for the case of an electrostatic drop sensor, light sensing elements 244 usefully have a physical size in the case of one element, or a physical gap between multiple sensing elements, that is less than a drop stream wavelength, $\lambda_0$.

An illumination and optical drop sensing apparatus like that illustrated in FIG. 15 may also be employed at a location behind the receiver plane 300 as was discussed with respect to the liquid drop emission system illustrated in FIG. 8. An optical drop sensing apparatus arranged as illustrated may be used to measure drop arrival and passage times to thereby determine a characteristic related to the break-off length of the measured stream. Also this arrangement may be used to perform a frequency jitter measurement on uncharged drops in analogous fashion to the measurement of frequency jitter for a charged drop stream discussed above with respect to FIG. 6.

Figure 16:
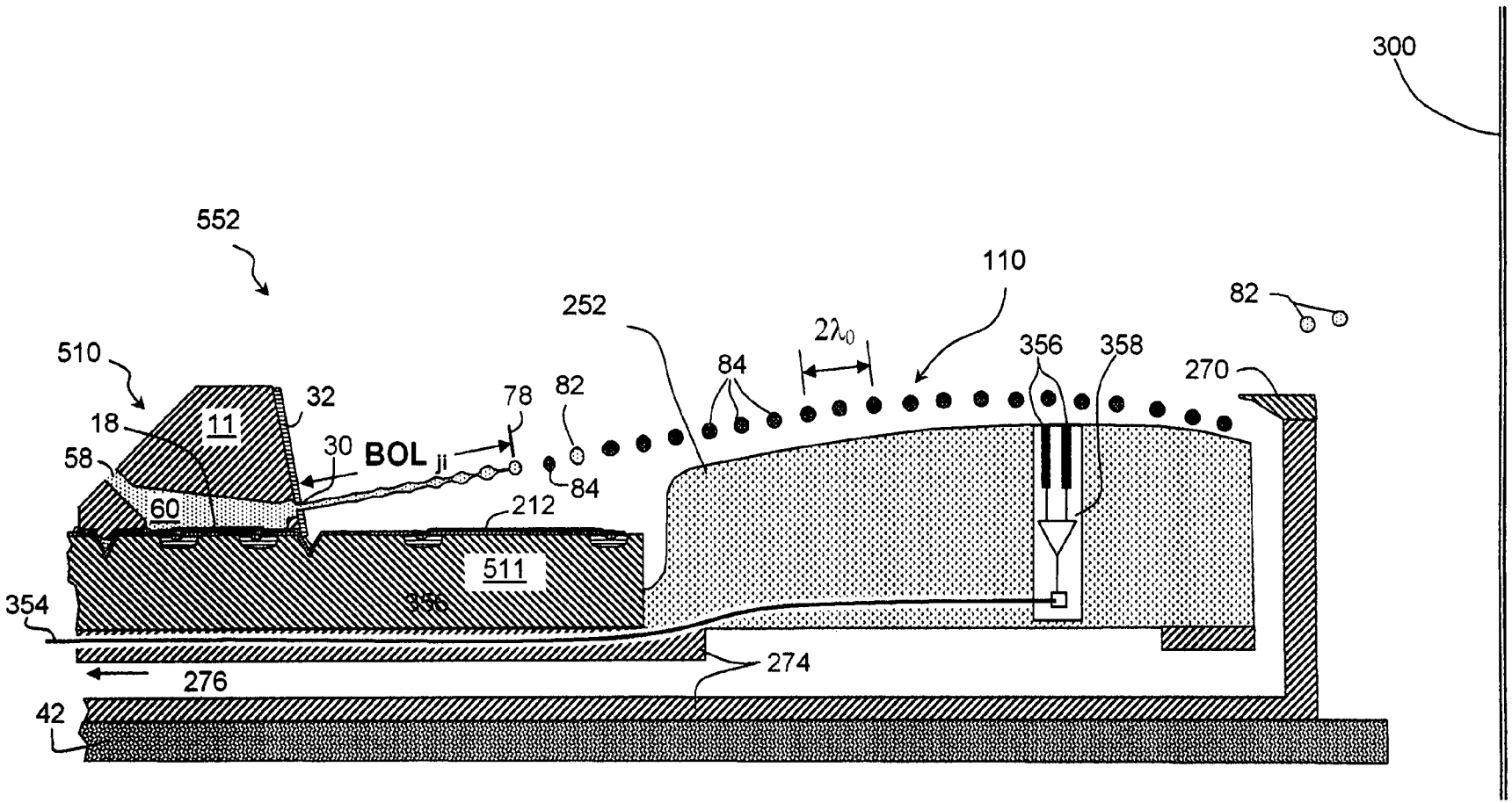
FIG. 16 is a side view illustration of an edgeshooter style liquid drop emitter as shown in FIG. 9 further illustrating drop deflection, guttering and having drop sensing apparatus located on the drop landing surface of the guttering apparatus according to the present inventions.

An alternate embodiment of a drop emission system 552 having a different location for the drop sensing apparatus is illustrated in FIG. 16. With the exception of the drop sensing apparatus, the elements of alternate drop emission system 552 are the same as those of drop emission system 550 shown in FIG. 15 and may be understood from the explanations previously given with respect to FIG. 15. Drop sensing apparatus 358 is located along the surface 353 of deflection ground plane 252 which also serves as a landing surface for drop that are deflected for guttering. Such gutter landing surface drop sensors are disclosed by Piatt, et al. in U.S. Pat. No. 4,631,550, issued Dec. 23, 1986.

Drop sensing apparatus 358 is comprised of sensor electrodes 356 that are connected to amplifier electronics. When charged drops land in proximity to the sensor electrodes a voltage signal may be detected. Alternately, sensor electrodes 356 may be held at a differential voltage and the presence of a conducting working fluid is detected by the change in a base resistance developed along the path between the sensor electrodes. Drop sensor apparatus 358 is a schematic representation of a n individual sensor, however it is contemplated that a sensor serving an array of jets may have a set of sensor electrode and signal electronics for every jet, or for a group of jets, or even a single set that spans the full array width and serves all jets of the array. Drop sensor apparatus sensor signal lead 354 is shown schematically routed beneath drop emitter semiconductor substrate 511. It will be appreciated by those skilled in the ink jet art that many other configurations of the sensor elements are possible, including routing the signal lead to circuitry within semiconductor substrate 511.

Figure 17:
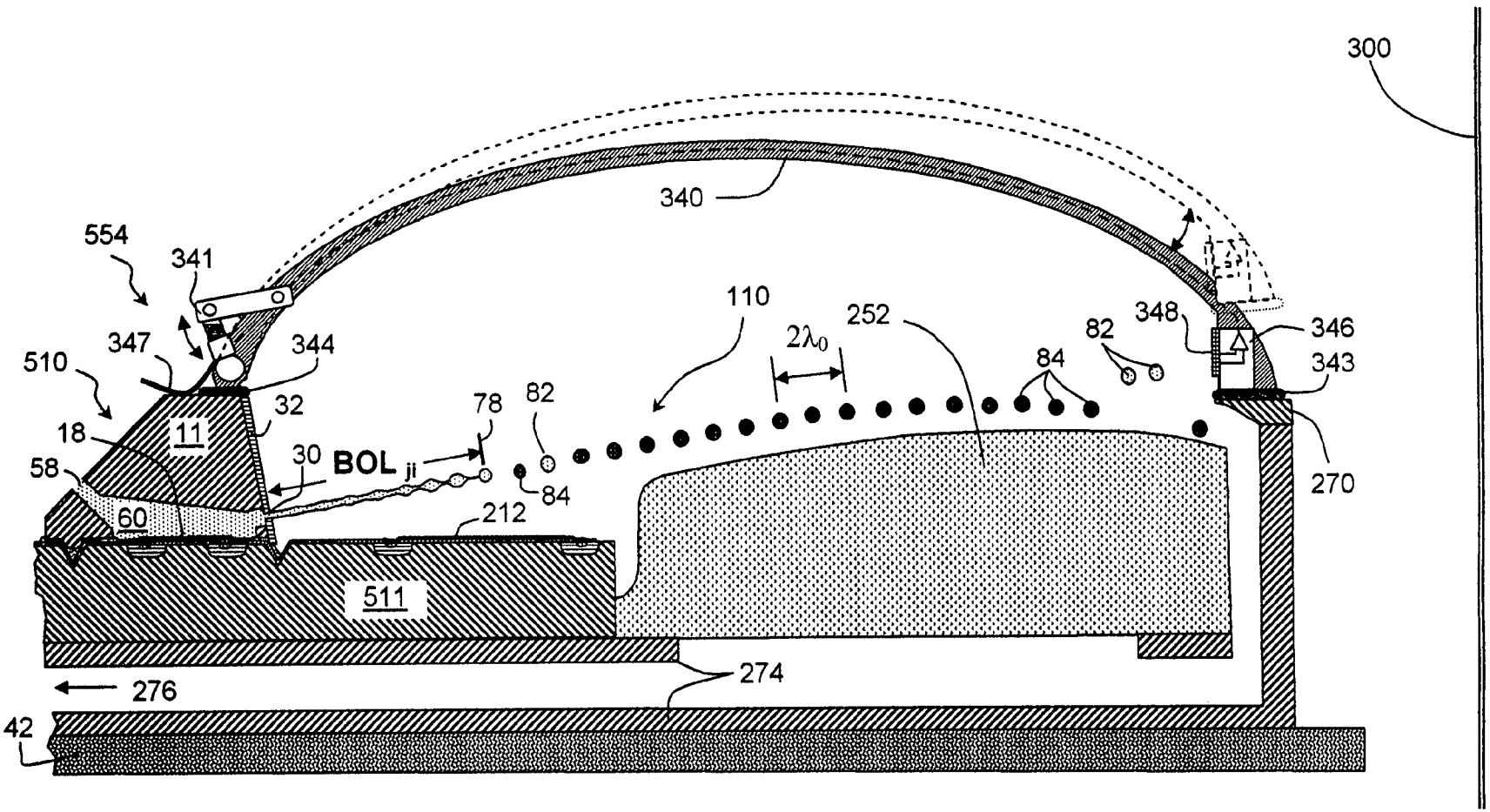
FIG. 17 is a side view illustration of an edgeshooter style liquid drop emitter as shown in FIG. 9 further illustrating drop deflection, guttering and having an eyelid sealing mechanism with drop sensing apparatus located on the eyelid apparatus according to the present inventions.

Another alternate embodiment of a drop emission system 554 having yet another location for the drop sensing apparatus is illustrated in FIG. 17. Drop emission system 554 is fitted with a shroud 340, termed an "eyelid", which is configured to hermetically seal the drop flight path region between nozzles 30 and drop gutter catcher 270. During certain non-printing, printhead maintenance, power-off, start-up and shut-down conditions of the system, eyelid 340 is positioned by means of mechanism 341 to form a fluid-tight seal. A seal formed by eyelid 340 in its "closed" position is illustrated schematically in FIG. 17, by means of seal material 343 forced against gutter catcher 270 and seal member 344 forced against the drop generator chamber element 11. During printing or ready-standby states, eyelid 340 is raised by mechanism 341 as indicated by the phantom outline and arrow in FIG. 17, permitting drops to travel to the receiving substrate 300.

Typically the eyelid sealing apparatus is configured to catch undeflected drops and a drop guttering apparatus is configured to catch deflected drops, as illustrated in FIG. 17. This is the case when undeflected drops are used for image printing or other liquid pattern deposition on a receiver surface. However the opposite arrangement wherein deflected drops are used for printing is also feasible and in this case an eyelid sealing apparatus is configured to catch deflected drops and a corresponding drop guttering apparatus catches undeflected drops. Eyelid apparatus and functions are disclosed by McCann et al. in U.S. Pat. No. 5,394,177, issued Feb. 28, 1995; and by Simon, et al., in U.S. Pat. No. 5,455,611, issued Oct. 3, 1995.

With the exception of the eyelid mechanism and drop sensing apparatus 346, the elements of alternate drop emission system 554 are the same as those of drop emission system 550 shown in FIG. 15 and may be understood from the explanations previously given with respect to FIG. 15. Drop sensing apparatus 346 is located at an inner surface of the eyelid 340 above the lip of gutter 270 when the eyelid is in a closed or nearly closed position. Eyelid drop sensor 346 is comprised of sensor element 348 which is further comprised of means of sensing the impact of a drop by any of the transducer mechanisms previously discussed above with respect to sensor sites 242 in FIG. 8 and to be further discussed below with respect to sensor sites 286 in FIG. 19. Sensor elements 348 may be configured to respond to the arrival of conducting fluid by altering a resistance or capacitive circuit value, to a charged drop, or to the pressure of a drop impact via well know pressure transducer mechanisms.

Sensor elements 348 are connected to amplifier electronics. When drops land in proximity to the sensor element a voltage signal may be detected. Eyelid drop sensor apparatus 346 is a schematic representation of an individual sensor, however, it is contemplated that an eyelid drop sensor serving an array of jets may have a set of sensor electrodes and signal electronics for every jet, or for a group of jets, or even a single set that spans the full printhead width and serves all jets of the printhead. Eyelid drop sensor apparatus signal lead 347 is shown schematically (in phantom line) routed through the eyelid shroud member 340 emerging at the top of drop generator chamber element 11. It will be appreciated by those skilled in the ink jet art that many other configurations of eyelid position, shape, sealing members, movement mechanism, sensor elements and electrical leads are workable.

Figure 18:
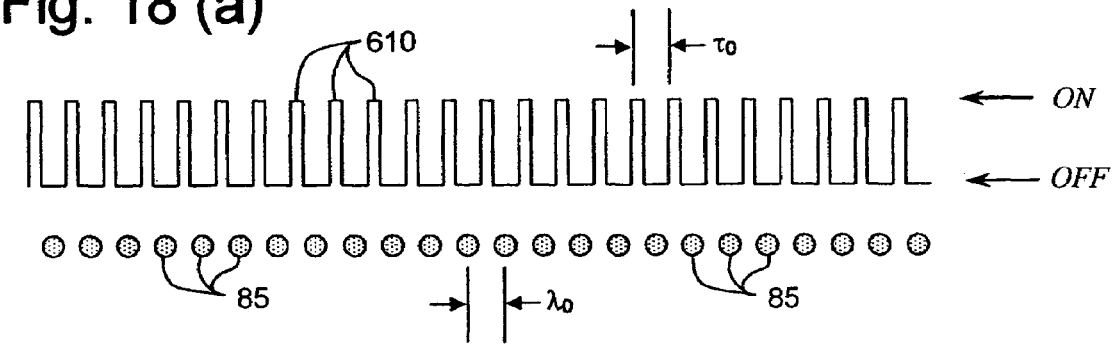
FIGS. 18(*a*), 18(*b*) and 1(*c*) illustrate electrical and thermal pulse sequences and the resulting stream break-up into drops of predetermined volumes according to the present inventions.
Figure 18B:
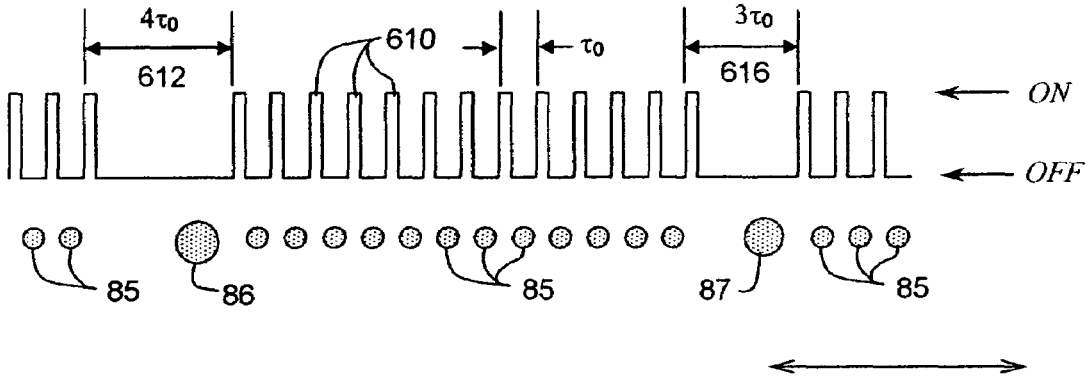
Figure 18C:
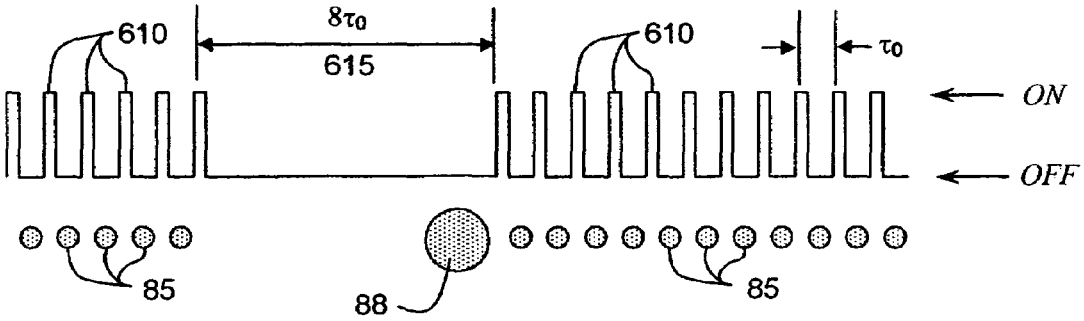

Thermal pulse synchronization of the break-up of continuous liquid jets is known to provide the capability of generating streams of drops of predetermined volumes wherein some drops may be formed having integer, m, multiple volumes, $mV_0$, of a unit volume, $V_0$. See for example U.S. Pat. No. 6,588,888 to Jeanmaire, et al. and assigned to the assignee of the present inventions. FIGS. 18(*a*)-18(*c*) illustrate thermal stimulation of a continuous stream by several different sequences of electrical energy pulses. The energy pulse sequences are represented schematically as turning a heater resistor "on" and "off" at during unit periods, $\tau_0$.

In FIG. 18(*a*) the stimulation pulse sequence consists of a train of unit period pulses 610. A continuous jet stream stimulated by this pulse train is caused to break up into drops 85 all of volume $V_0$, spaced in time by $\tau_0$ and spaced along their flight path by $\lambda_0$. The energy pulse train illustrated in FIG. 18(*b*) consists of unit period pulses 610 plus the deletion of some pulses creating a $4\tau_0$ time period for sub-sequence 612 and a $3\tau_0$ time period for sub-sequence 616. The deletion of stimulation pulses causes the fluid in the jet to collect into drops of volumes consistent with these longer that unit time periods. That is, sub-sequence 612 results in the break-off of a drop 86 having volume $4V_0$ and sub-sequence 616 results in a drop 87 of volume $3V_0$. FIG. 18(*c*) illustrates a pulse train having a sub-sequence of period $8\tau_0$ generating a drop 88 of volume $8V_0$.

The capability of producing drops in multiple units of the unit volume $V_0$ may be used to advantage in a break-off control apparatus and method according to the present inventions by providing a means of "tagging" the break-off event with a differently-sized drop or a predetermined pattern of drops of different volumes. That is, drop volume may be used in analogous fashion to the patterns of charged and uncharged drops used above to assist in the measurement of drop stream characteristics. Drop sensing apparatus may be provided capable of distinguishing between unit volume and integer multiple volume drops. The thermal stimulation pulse sequences applied to each jet of a plurality of jets can have thermal pulse sub-sequences that create predetermined patterns of drop volumes for a specific jet that is being measured whereby other jets receive a sequence of only unit period pulses.

Figure 19:
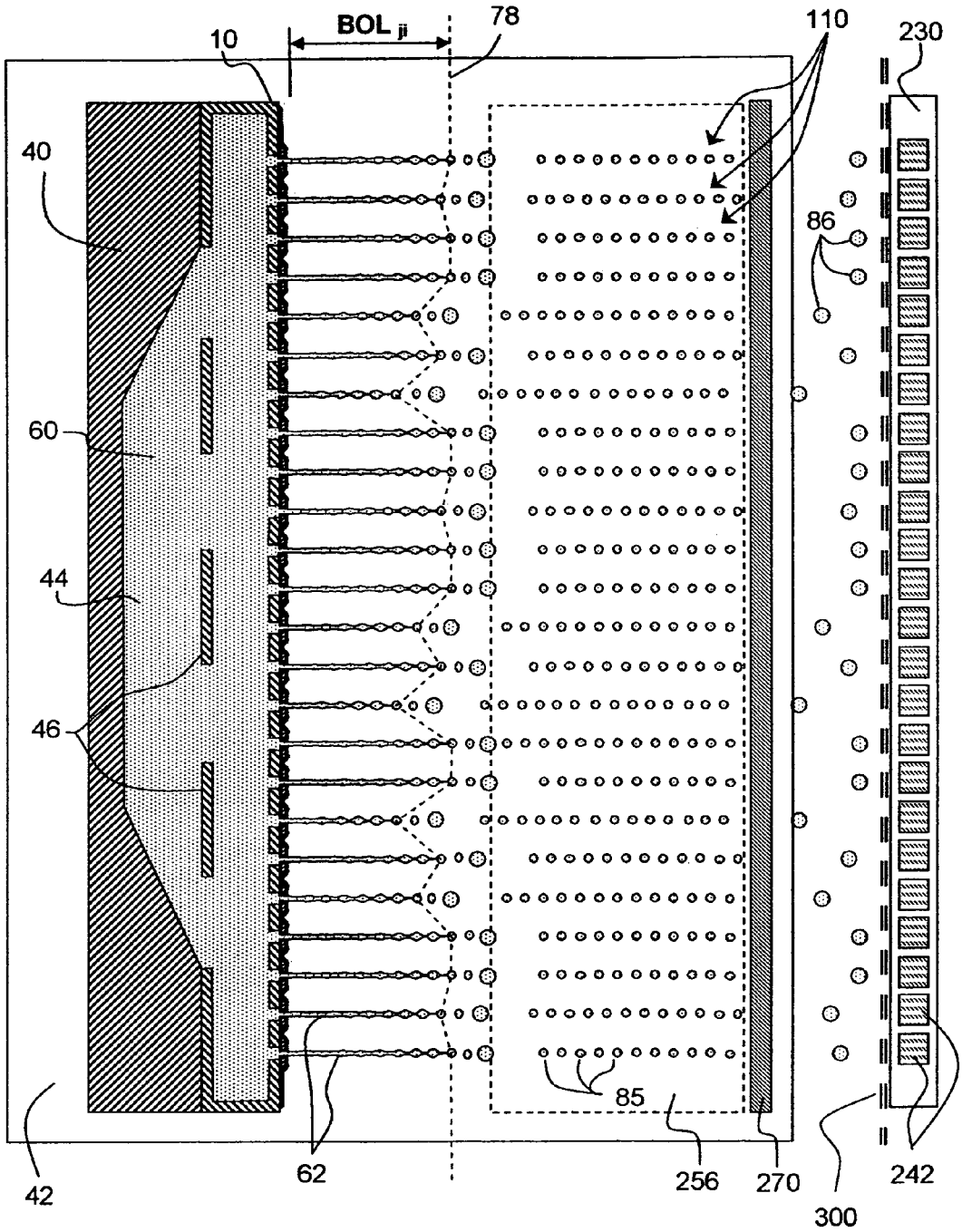
FIG. 19 is a top side view illustration of a liquid drop emitter system having a plurality of liquid streams and having individual drop sensing apparatus responsive to uncharged drops for each jet located after a non-electrostatic drop deflection apparatus according to the present inventions.

FIG. 19 illustrates a break-off control apparatus and method according to the present inventions wherein some drops 86 of volume $4V_0$ are being generated from each of the plurality of fluid streams 110. No inductive charging is being applied to the drops in this illustrated embodiment. An aerodynamic drop deflection zone 256 is schematically indicated along the flight paths after stream break-up at $BOL_{ji}$ 78 and before gutter 270. Aerodynamic drop deflection apparatus are known in the prior art; see, for example, U.S. Pat. No. 6,508,542 to Sharma, et al. and U.S. Pat. No. 6,517,197 to Hawkins, et al. assigned to the assignee of the present inventions.

Aerodynamic deflection consists of establishing a cross air flow perpendicular to the drop flight paths (away from the viewer of FIG. 19) having sufficient velocity to drag drops downward towards gutter 270. The velocity of the cross airflow and the length of the aerodynamic deflection zone may be adjusted so that unit volume drops 85 are deflected more than integer multiple volume drops (86, 87, 88). The gutter apparatus 270 may then be arranged to collect either the unit volume drops 85 or integer multiple volume drops 86. The guttering apparatus 270 has been arranged to collect unit volume drops in the configuration illustrated in FIG. 19.

Integer multiple volume drops 86 are used to detect a characteristic of each fluid stream 110 by measuring the time between break-off at the break-off point 78 and arrival at sensor 230 located behind receiver plane location 300. An optical sensor of the type discussed above with respect to FIG. 15 is illustrated in FIG. 19.

Figure 20:
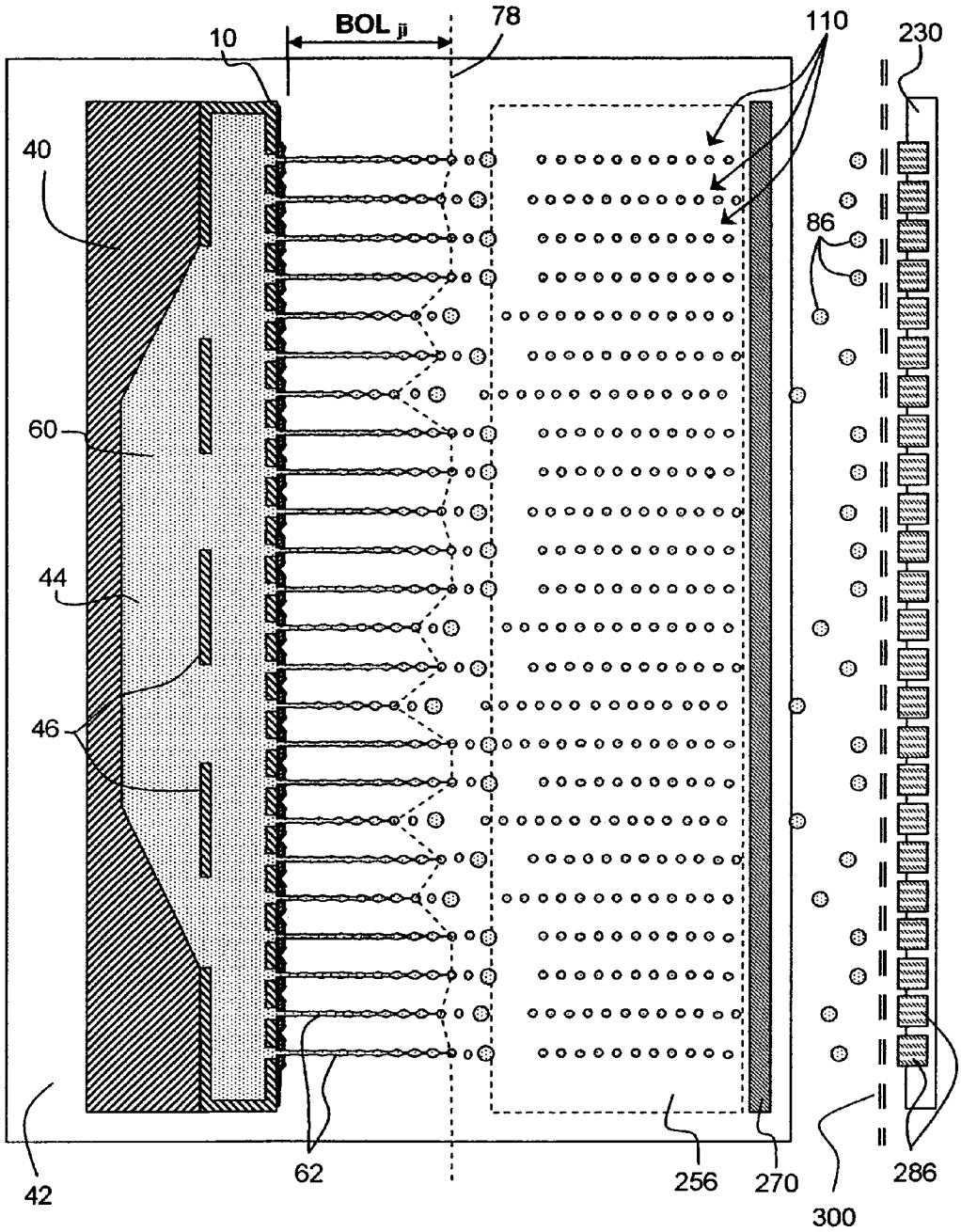
FIG. 20 is a top side view illustration of a liquid drop emitter system having a plurality of liquid streams and having individual drop sensing apparatus responsive to the impact of uncharged drops for each jet located after a non-electrostatic drop deflection apparatus according to the present inventions.

Sensing apparatus that respond to drop impact may also be used to detect drop arrival times according to the present inventions. FIG. 20 illustrates a break-off control apparatus and method that is similar to that shown in FIG. 19 except that a drop impact sensing apparatus is used. Individual drop impact sensor sites 286 are provided in sensing apparatus 230 located behind the receiver plane location 300. Drop impact sensors are known in the prior art based on a variety of physical transducer phenomena including piezoelectric and electrostrictive materials, moveable plate capacitors, and deflection or distortion of a member having a strain gauge. Drop impact sensors are disclosed, for example, in U.S. Pat. No. 4,067,019 to Fleischer, et al.; U.S. Pat. No. 4,323,905 to Reitberger, et al.; and U.S. Pat. No. 6,561,614 to Therien, et al.

Figure 21:
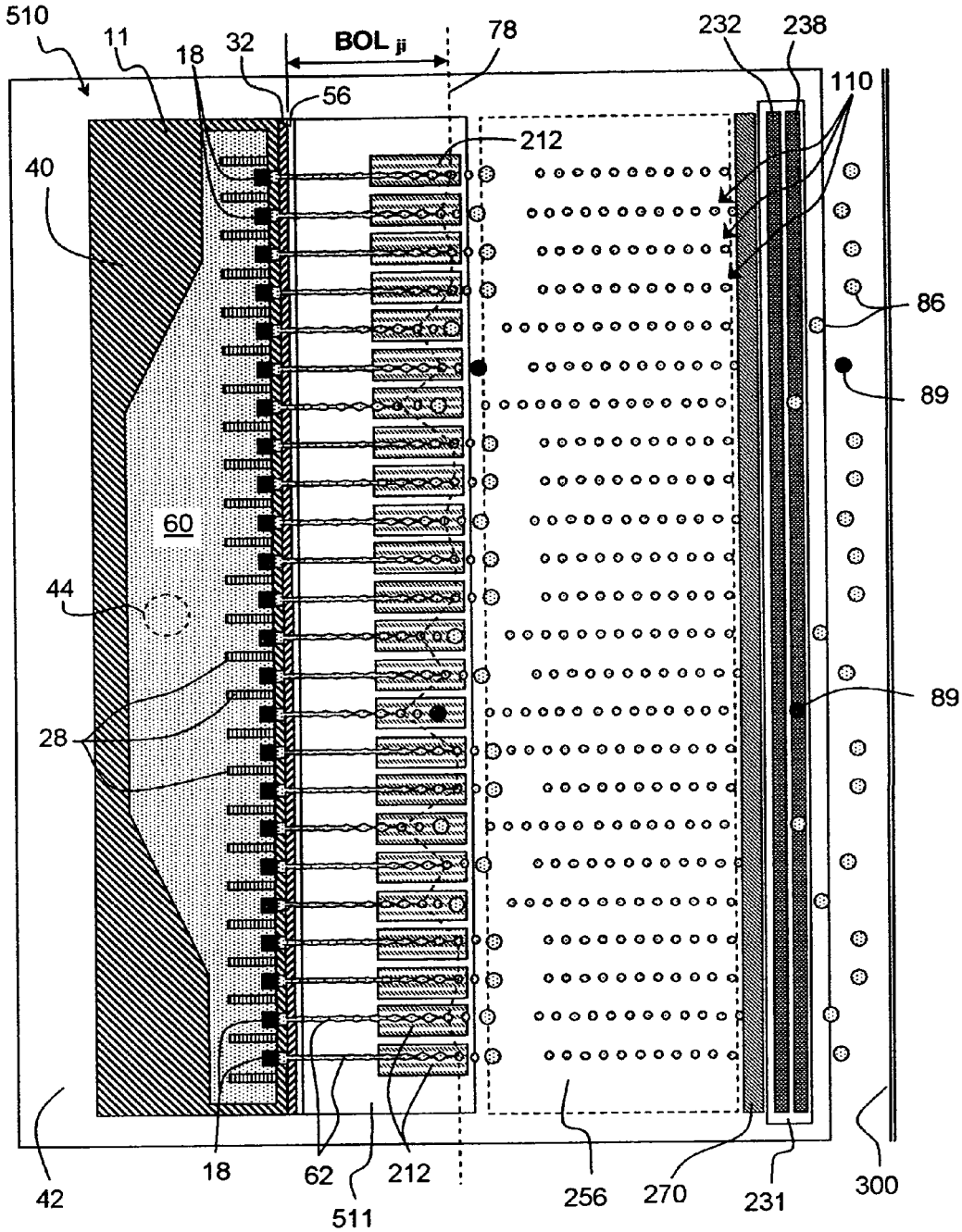
FIG. 21 is a top side view illustration of a liquid drop emitter system having a plurality of liquid streams and having individual drop charging and array-wide electrostatic drop sensing apparatus located after a non-electrostatic drop deflection apparatus according to the present inventions.

There are many combinations of inductive charging, drop deflection and sensing apparatus that may be selected according to the present inventions. For example, a configuration having an inductive charging apparatus with individually addressable charge electrodes for each jet of a plurality of jets may be used with an aerodynamic drop deflection system and an array-wide electrostatic drop sensing apparatus. This combination is illustrated in FIG. 21. Individual drop charging electrodes 212 are used to charge drops 89 from a particular jet for detection by the array-wide electrostatic sensing apparatus 231. The inductive drop charging function is not used for drop deflection but rather to assist in the measurement of stream characteristics for the purpose of break-off length control. The embodiment of the present inventions illustrated in FIG. 21 also depicts the use of an edge-shooter style drop emitter 510 and resistive heaters 18 integrated with charge electrodes 212 on common semiconductor substrate 511 as was discussed above with respect to FIG. 9.

Figure 22B:
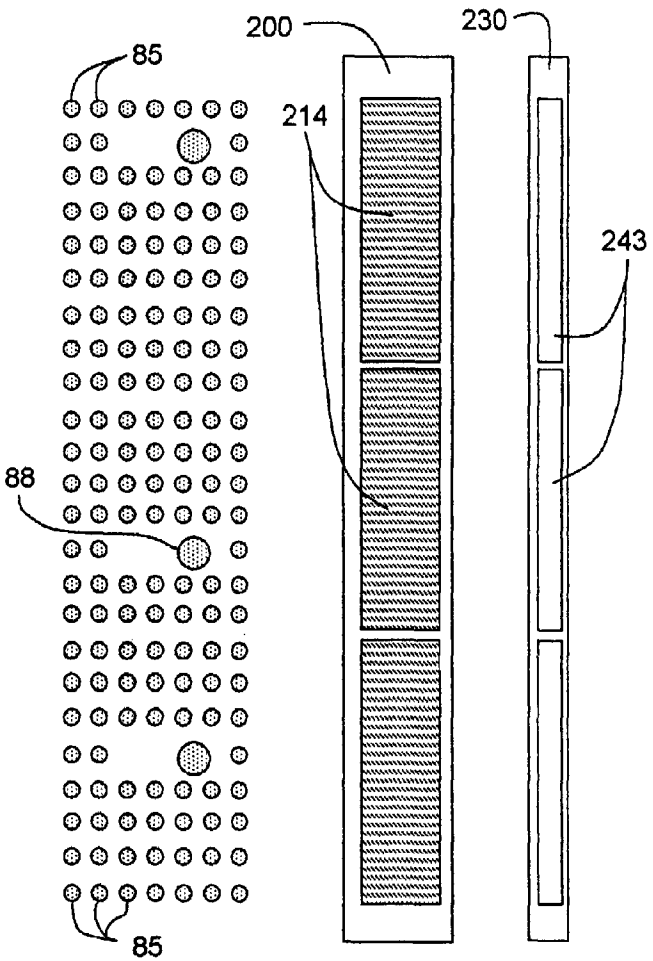
FIGS. 22(*a*) and 22(*b*) illustrate alternate configurations of the use of drop volumes, individual stream charging and sensing, and stream-group charging and sensing, respectively, according to the present inventions.
Figure 22:
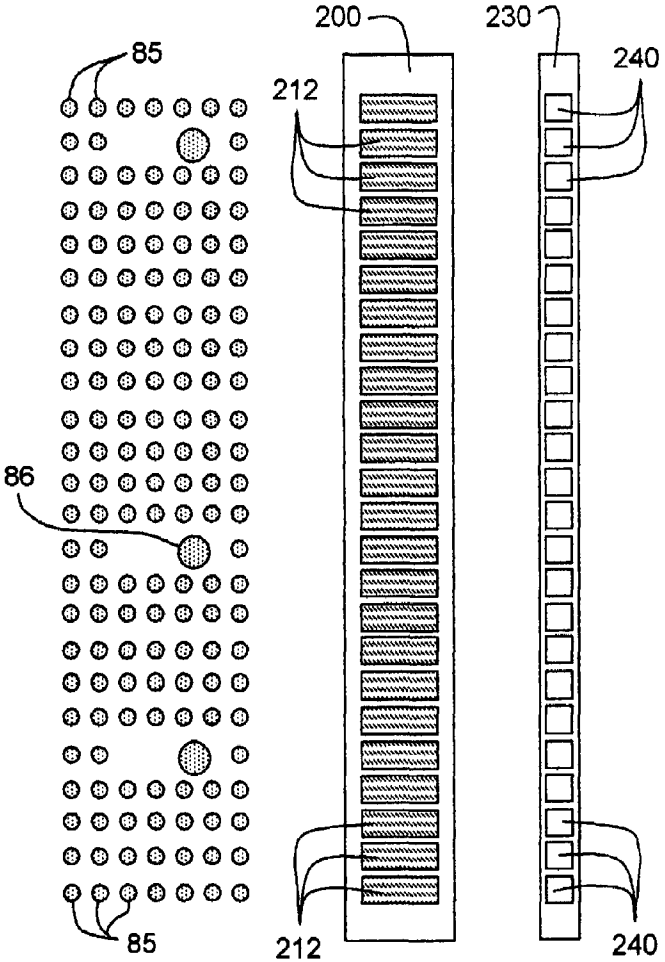

The many combinations of configurations of drop generation, charging and sensing that may be employed according to the present inventions are further elaborated schematically in FIGS. 22(*a*) and 22(*b*). FIG. 22(*a*) schematically illustrates a break-off length control apparatus and method that utilizes integer multiple volume drops 86, independent inductive charge electrodes 212 for each jet, and drop sensing using and electrostatic sensor site 240, one per jet.

FIG. 22(*b*) illustrates an alternate configuration according to the present inventions wherein a group charging electrode 214 is arranged to charge all drops within a group of jets and an electrostatic drop sensing apparatus has sensor sites 243 that serve to measure a group of drop streams. By generating integer volume drops 88 for specific jets within a group of drop streams that are commonly sensed, a characteristic for each drop stream may be decoded.

It will be apparent from the above discussion that many combinations may be utilized to provide apparatus for efficiently sensing a characteristic of each stream within a plurality of streams of drops of predetermined volumes while using drop charging and sensing apparatus that have active elements that serve each stream individually or various groupings of streams. All of these combinations are contemplated as preferred embodiments of the present inventions.

Figure 23:
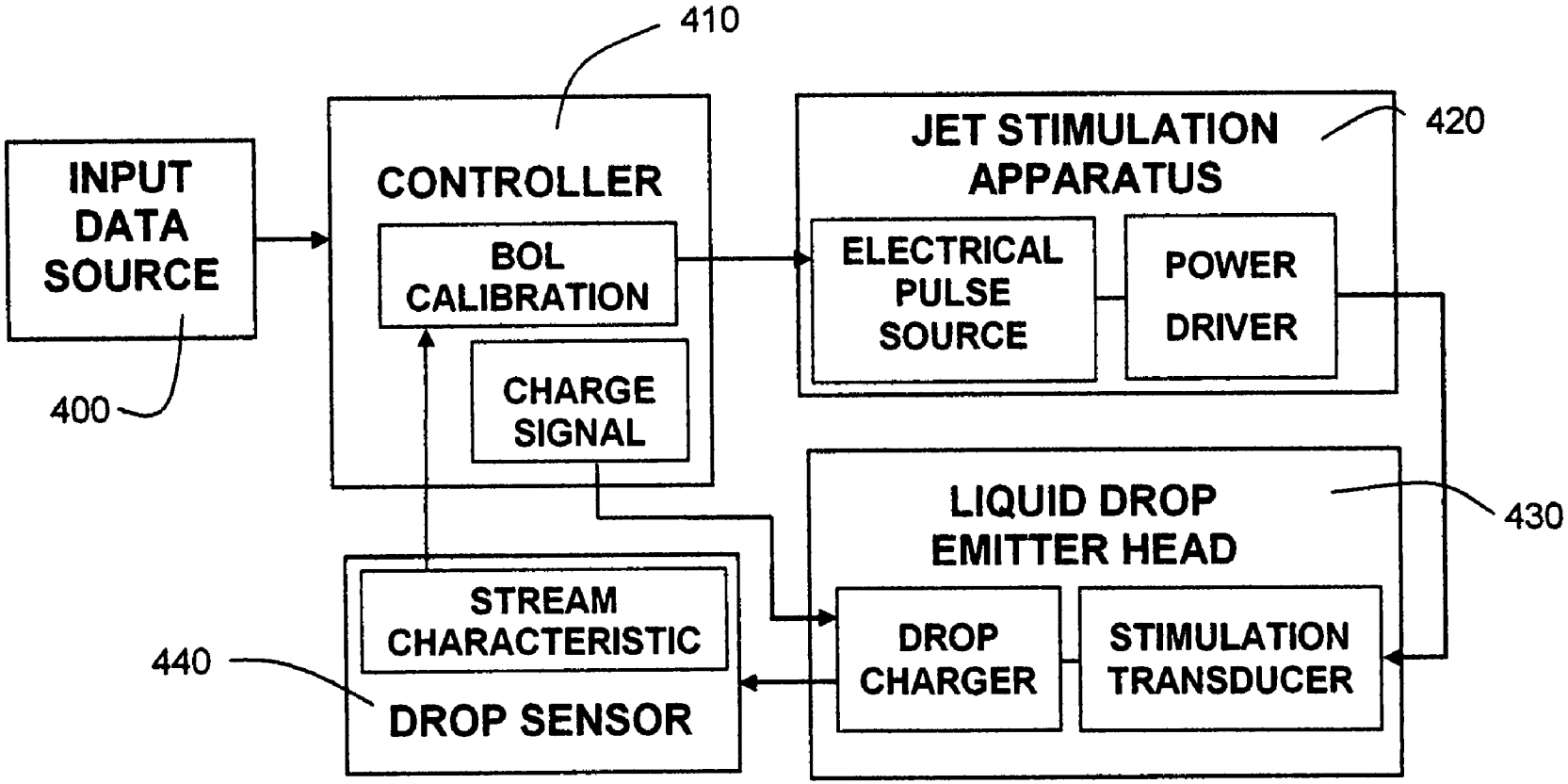
FIG. 23 illustrates a configuration of elements of a jet break-off length control apparatus according to the present inventions.

FIG. 23 illustrates in schematic form some of the electronic elements of a break-off control apparatus according to the present inventions. Input data source 400 represents the means of input of both liquid pattern information, such as an image, and system or user instructions, for example, to initiate a calibration program including break-off length measurements and break-off length adjustments. Input data source is for example a computer having various system and user interfaces.

Controller 410 represents computer apparatus capable of managing the liquid drop emission system and the break-off length control procedures according to the present inventions. Specific functions that controller 410 may perform include determining the timing and sequencing of electrical pulses to be applied for stream break-up synchronization, the energy levels to be applied for each stream of a plurality of streams to manage the break-off length of each stream, drop charging signals if utilized and receiving signals from sensing apparatus 440. Depending on the specific sensing hardware, drop patterns and methods employed, controller 410 may receive a signal from sensing apparatus 440 that characterizes a measured stream, or, instead, may receive lower level (raw) data, such as pre-amplified and digitized sensor site output. Controller 410 calculates an estimate of the break-off length $BOL_{ji}$ for each stream, j, and then determines a break-off length calibration signal that is used to adjust the break-off lengths to a selected target operating value, $BOL_0$.

Jet stimulation apparatus 420 applies pulses of thermal energy to each stream of pressurized liquid sufficient to cause Rayleigh synchronization and break-up into a stream of drops of predetermined volumes, $V_0$ and, for some embodiments, $mV_0$. Stimulation energy may be provided in the form of thermal or mechanical energy as discussed previously. Jet stimulation apparatus 420 is comprised at least of circuitry that configures the desired electrical pulse sequences for each jet and power driver circuitry that is capable of outputting sufficient voltage and current to the transducers to produce the desired amount of thermal energy transferred to each continuous stream of pressurized fluid.

Liquid drop emitter 430 is comprised at least of stimulation transducers (resistive heaters, electromechanical or thermomechanical elements) in close proximity to the nozzles of a multi-jet continuous fluid emitter and charging apparatus for some embodiments.

Figure 24:
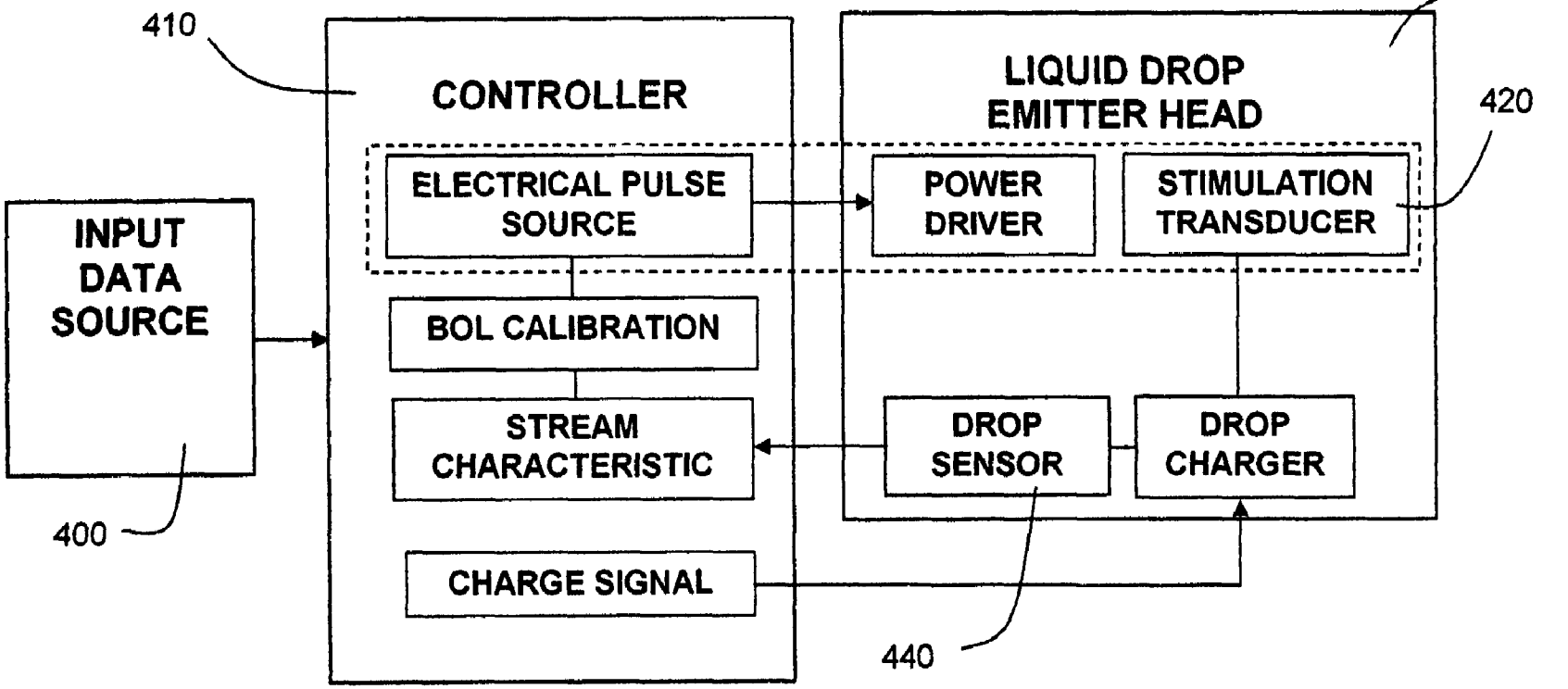
FIG. 24 illustrates an alternate configuration of elements of a jet break-off length control apparatus according to the present inventions.

The arrangement and partitioning of hardware and functions illustrated in FIG. 23 is not intended to convey all of many possible configurations of the present inventions. FIG. 24 illustrates an alternative configuration in which the drop sensor is integrated into a liquid drop emitter head 430 and all signal sourcing is determined and generated within controller 410.

Figure 25:
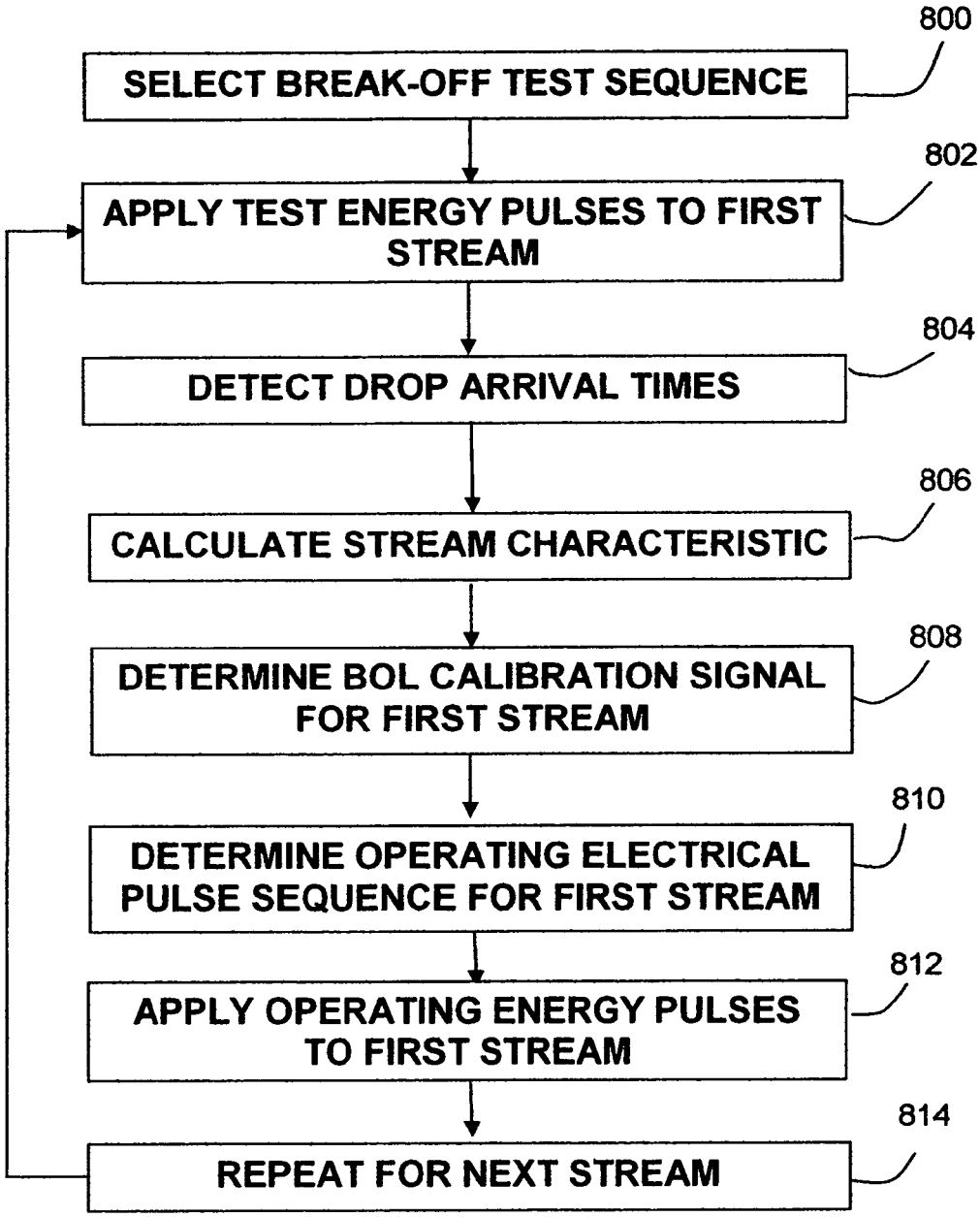
FIG. 25 illustrates a method of controlling the jet break-off length in a liquid drop emitter apparatus according to the present inventions.

Throughout the above discussions methods of operating the break-off length control apparatus described and illustrated have been disclosed and implied. FIG. 25 schematically illustrates one method of break-off length control according to the present inventions. The method illustrated begins with step 800, selecting a break-off test sequence. The selection may be made by the BOL controller or, potentially, explicitly by user or higher-level system data input. The BOL controller and the jet stimulation apparatus act to apply energy pulses to a first stream of a liquid drop emitter (802). Sensing apparatus responds to the break-off test sequence by making some form of a drop arrival time measurement (804). The drop arrival time data is then used to calculate some characteristic of the first drop stream that directly relates to the break-off length of that stream (805). A break-off length calibration signal is determined based on the calculated drop stream characteristic (808). Based on the BOL calibration signal, a new operating thermal pulse sequence is selected (810) and applied to the first continuous liquid stream (812) thereby causing the first stream to break-up into drops of predetermined volumes and at a selected operating break-off length. If the liquid drop emission system has a plurality of jets, the above procedure is repeated for all drop streams (812).

Step 804, detecting drop arrival times, may be understood to include the detection of patterns of drops, single drops or even the absence of drops from an otherwise continuous sequence of drops. In general, step 804 is implemented by sensing a drop after break-off from the continuous stream when it passes by a point along its flight pate detectable by optical or electrostatic sensor apparatus or when it strikes a detector and is sensed by a variety of transducer apparatus that are sensitive to the impact of the drop mass.

Step 806, calculating a stream characteristic, may be understood to mean the process of converting raw analog signal data obtained by a physical sensor transducer into a value or set of values that is related to the break-off point. Typically this value will be a time period that is larger for short break-off lengths and smaller for long break-off lengths. However the stream characteristic may also be a value such as the magnitude of frequency jitter $\delta f$ about the primary frequency of stimulation, $f_0$. Further, the stream characteristic may be a choice of a specific BOL table value arrived at by using a test sequence that includes a range of predetermined thermal stimulation pulse energies; sensing, therefore, drops produced at multiple break-off lengths; and then characterizing the stream by the choice of the pulse energy that causes the sensor measurement to most closely meet a predetermined target value.

It may be understood that the BOL calibration signal may have many forms. It is intended that the BOL calibration signal provide the information needed, in form and magnitude, to enable the adjustment of the sequence of electrical and thermal pulses to achieve both the synchronized break-up of each jet into a stream of drops of predetermined volume and a break-off length of a predetermined operating length including a predetermined tolerance. For example, the BOL calibration signal might be a look-up table address, an energy stimulation pulse width or voltage, or parameters of a BOL offset pulse that is added to a primary thermal stimulation pulse.

The electrical operating pulse sequence determined in step 810 contains the parameters necessary to cause drop break-up to occur at the chosen break-off length, $BOL_0$. The pulse sequences for each of the jets of a plurality of jets may be different in terms of the amount of applied energy per drop period but will all have a common fundamental repetition frequency, $f_0$. It is contemplated within the scope of the present inventions that the operating pulse sequences that are applied to individual jets may be selected from a finite set of options. That is, it is contemplated that acceptable break-off length control for all jets, that achieves a desired operating BOL within an acceptable tolerance range, may be realized by having, for example, only 8 choices of operating pulse energy that are selectable for the plurality of jets.

Figure 26A:
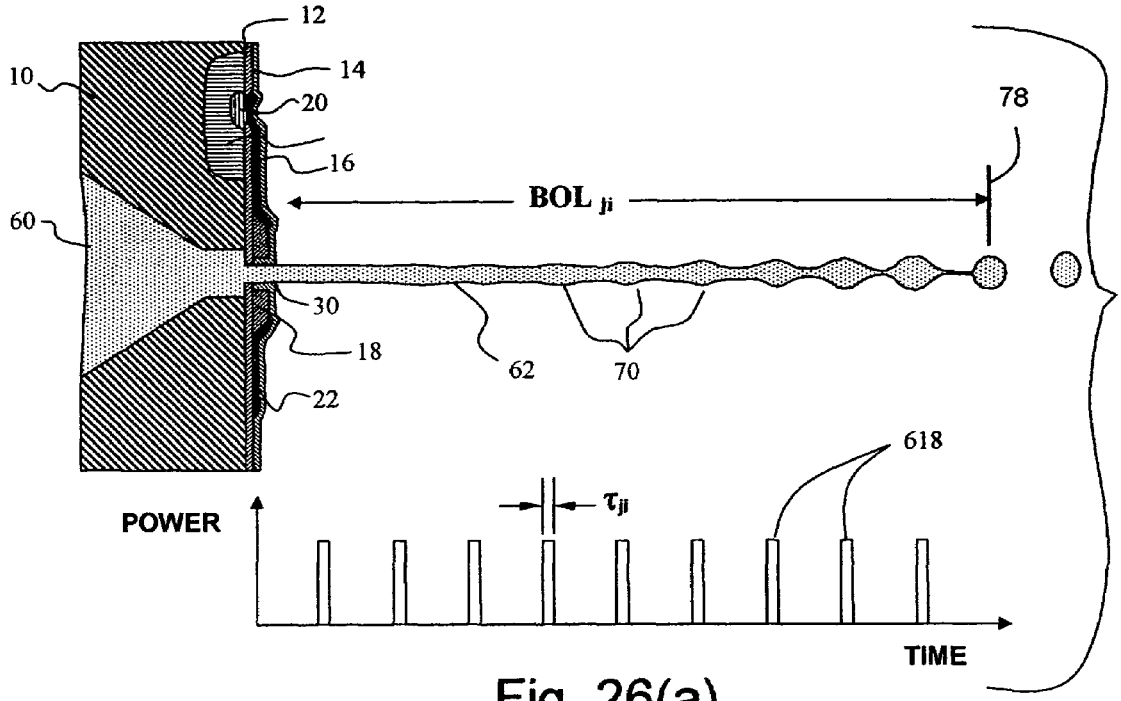
FIGS. 26(*a*) and 26(*b*) are side view illustrations of a continuous liquid stream undergoing thermally stimulated break up into drops of predetermined volumes and further illustrating sequences of electrical and thermal pulses that cause the stimulated break-up.
Figure 26B:
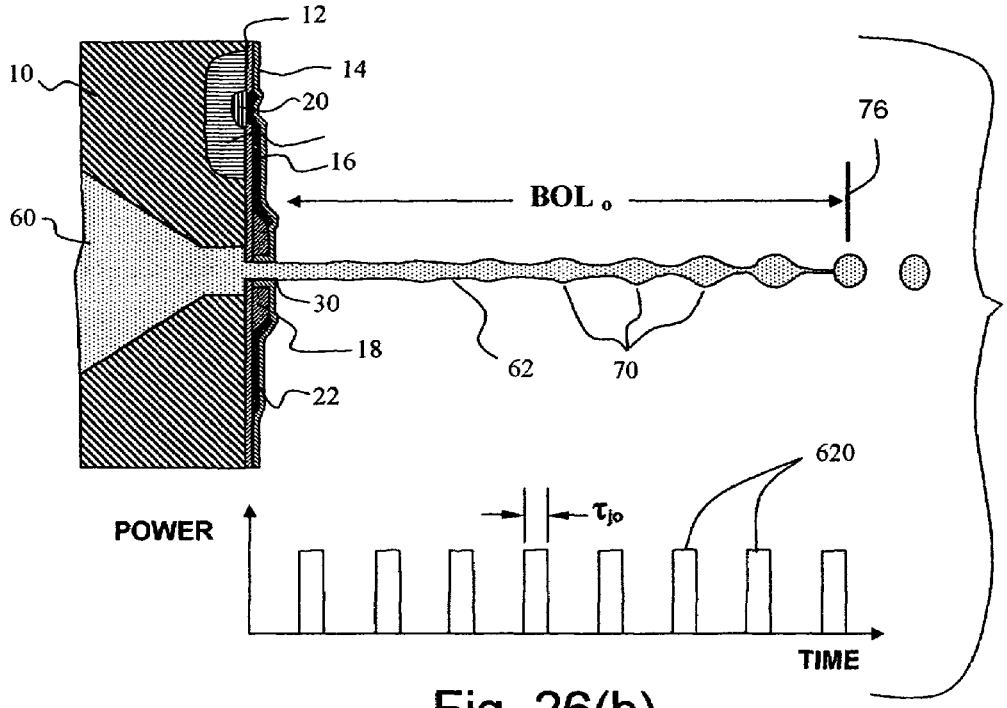

An example of the operation of the break-off control apparatus and methods of the present inventions is illustrated by FIGS. 26(*a*) and 26(*b*). FIG. 26(*a*) illustrates the $j^{th}$ jet among a plurality of jets in a multi-jet liquid drop emitter having an initial, pre-control break-off length $BOL_{ji}$ due to the application of a thermal pulse sequence having energy pulses 618 of a pulse width, $\tau_{jig}$. In the example of FIG. 26(*a*), $BOL_{ji}$ is determined to be longer than the desired or predetermined operating break-off length, BOL0.

In FIG. 26(*b*) the break-off length control apparatus and methods of the present inventions apply a sequence of thermal stimulation pulses 620 of wider pulse width, $\tau_{j0}$, raising the stimulation energy and restoring the break-off length to the desired target length, $BOL_0$. The break-off length control apparatus and method may result in having many different values of thermal pulse widths, $\tau_{j0}$, for each of a plurality of N jets in a liquid drop emission system (i.e., for j=1 to N) when operating at the target $BOL_0$.

Figure 27:
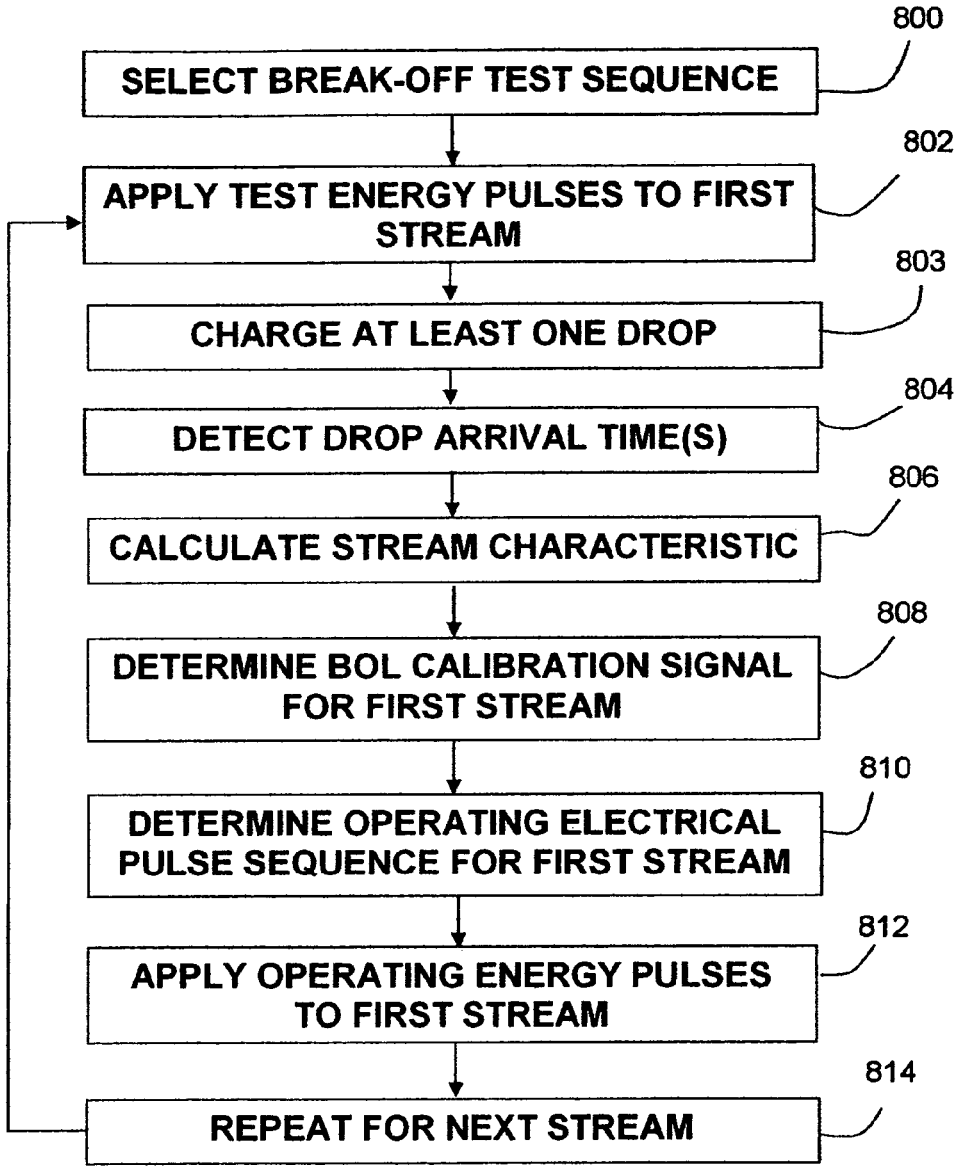
FIG. 27 illustrates another method of controlling the jet break-off length in a liquid drop emitter apparatus according to the present inventions.

FIG. 27 schematically illustrates another method of break-off length control according to the present inventions. The method illustrated by FIG. 27 is similar to the FIG. 25 method above discussed except that an additional step 803, charging at least one drop, is added. This additional step is introduced for configurations wherein drop charging is used in some fashion by the break-off control apparatus. Drop charging may be used, for example for the purpose of tagging a drop with charge so that its arrival at a sensor location may be distinguished from the arrival of other drops. Drop charging may also be used to allow the use of electrostatic drop sensing apparatus rather than optical or impact sensing. Further, drop charging may be used to allow Coulomb force deflection apparatus to be used to direct some drops over or to a sensor location and others to a gutter apparatus.

All of the other steps of the method illustrated by FIG. 27 have the same purpose as those having the same number identification and may be understood from the above discussion.

It should be appreciated that the apparatus and methods of drop detection disclosed above, such as measurement of time of flight of drop pairs, can be used to detect and compensate even large deviations in break-off lengths from one jet to another, specifically deviations exceeding the average drop-to-drop spacing of drops 84. However, for some printheads this ability is not required because the deviations in break-off lengths from one jet to another may be small, specifically smaller than the drop-to-drop spacing, λ. This could be the case, for example, if the large deviations have already have been partially corrected so as to produce nozzles displaying only small deviations, that is deviations less than the drop-to-drop spacing. It is also possible that deviations in break-off lengths in a particular printhead are less than the drop-to-drop spacing even with no corrections applied.

Figure 28:
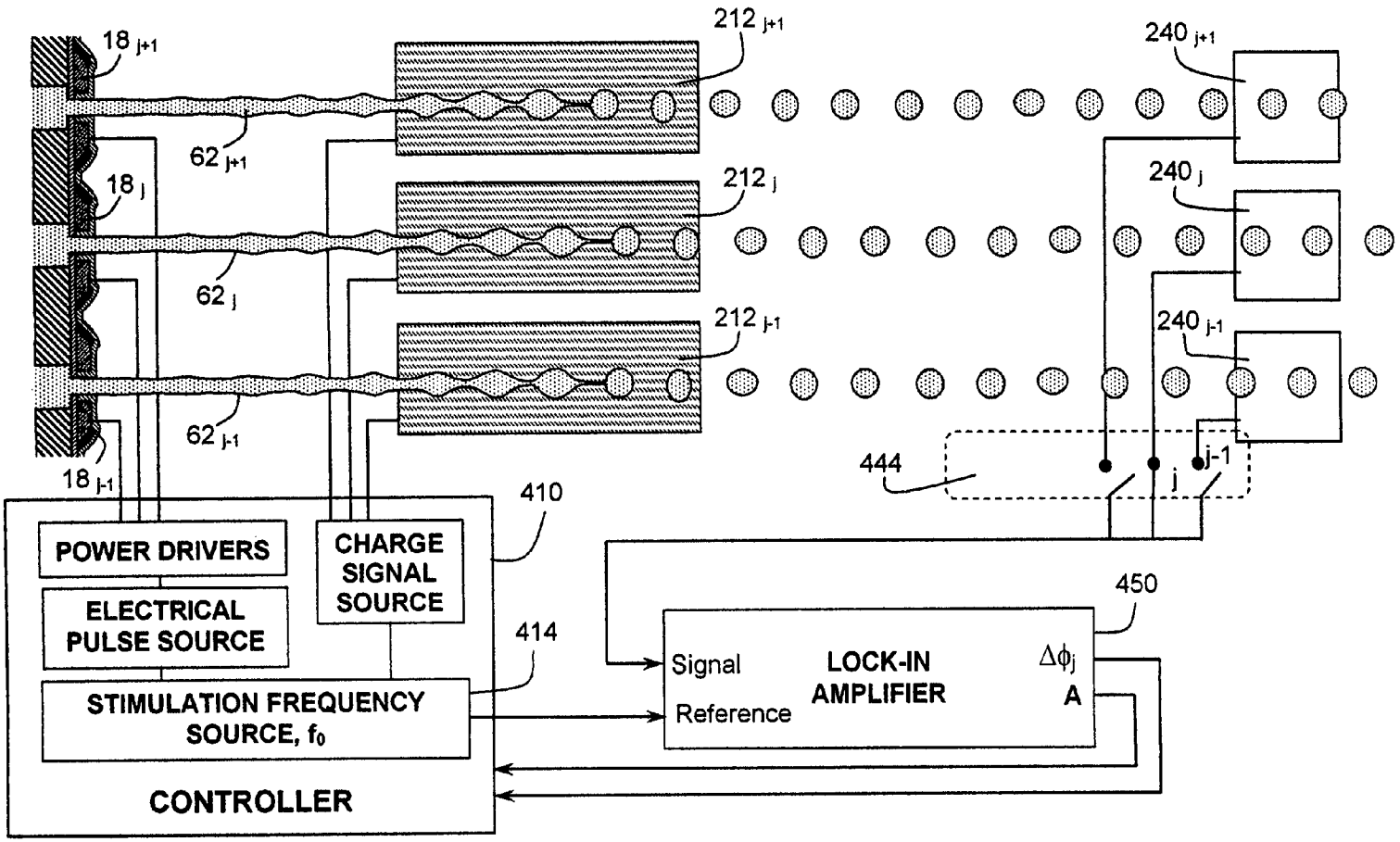
FIG. 28 is a top side view illustration of a liquid drop emitter system having a plurality of liquid streams and having a phase sensitive amplifier circuit.

In cases where the deviations are small, it is nonetheless desirable to detect and correct them; and it is advantageously found that an apparatus and method of detection that utilizes phase-sensitive signal processing techniques may be employed for such small deviations. One preferred embodiment, illustrated in FIG. 28, uses a lock-in amplifier 450 to process signals from individual stream charged drop stream detectors 240. FIG. 28 illustrates an expanded view portion showing the emission from nozzles of only three drop streams $\mathbf{62}_j$ of the plurality of the streams drawn in FIG. 7. Heater resistors $\mathbf{18}_j$, charge electrodes $\mathbf{212}_j$, and charge sensor elements $\mathbf{240}_j$ are also included in the expanded view portion.

According to this present embodiment all drops of a stream $\mathbf{62}_j$ are continuously charged at electrode $\mathbf{212}_j$ and a voltage response signal is generated for stream $\mathbf{62}_j$ by individual stream drop charge detector $\mathbf{204}_j$ as the drops pass over the detector. A first switch array 444 is provided so that the voltage signal from each individual drop charge detector $\mathbf{240}_j$, may be connected to lock-in amplifier 450 at an input terminal denoted "Signal". In FIG. 28, the $j^{th}$ switch of first switch array 444 is closed while the $j-1^{th}$ and $j+1^{th}$ switches for the drop charge detectors ($\mathbf{240}_{j-1}$, $\mathbf{240}_{j+1}$) on either side are open, setting the system up to measure a characteristic of stream $\mathbf{62}_j$. A second input to lock-in amplifier 450, denoted "Reference", is provided with a voltage signal, by controller 410 that exactly tracks the stimulation frequency ($f_0$) signal used to control the electrical pulses applied to heater resistor $\mathbf{18}_j$.

The circuitry of lock-in amplifier 450 compares the signals at its two input terminals, i.e. the voltage from charged drop sensor 240*j* and the reference stimulation frequency voltage from controller 410. Lock-in amplifier 450 measures both the amplitude and the phase difference of the signal from sensing element $\mathbf{240}_j$ relative to the signal from a reference frequency source 414 and produces an amplitude output, A, and a phase difference output, Δϕ, as is well known in the art of signal processing.

Lock-in amplifier 450 is illustrated as a separate circuit unit in FIG. 28; however there are many implementations of phase sensitive amplification and detection that may be employed. Integration of the lock-in amplifier function within controller 410 or with circuitry associated with the charged drop sensor array 240 are also contemplated as embodiments of the present inventions. For the purposes of the present inventions, i.e., measuring a useful characteristic of a thermally stimulated stream, a circuit that determines only phase differences between the reference and the drop stream signal is sufficient and may be implemented as a simplification. A digital comparator design that determines a digital representation of the time phase difference between digitized stimulation frequency and a drop stream detector signals may also be used to perform the functions of lock-in amplifier 450. Finally, while only a single lock-in amplifier 450 is illustrated, a plurality of lock-in amplifiers or other phase sensitive signal detection circuits may be employed so that measurements may be made for a plurality of drop steams simultaneously.

The phase difference $\Delta\phi_j$ measured by lock-in amplifier 450 between the signal from drop charge detector $\mathbf{240}_j$ and the reference stimulation frequency uniquely characterizes the break-off length $BOL_j$ of stream $\mathbf{62}_j$. Phase difference $\Delta\phi_j$ may be set to a specific value for each jet, by adjusting the break-off length of each jet. This adjustment may be accomplished, for example, by varying a parameter controlling the break-off length, such as the thermal stimulation energy, for each jet until the phase differences measured by the lock-in amplifier are identical for all jets, $\Delta\phi_0$, thereby ensuring the uniformity of break-off lengths.

Figure 29:
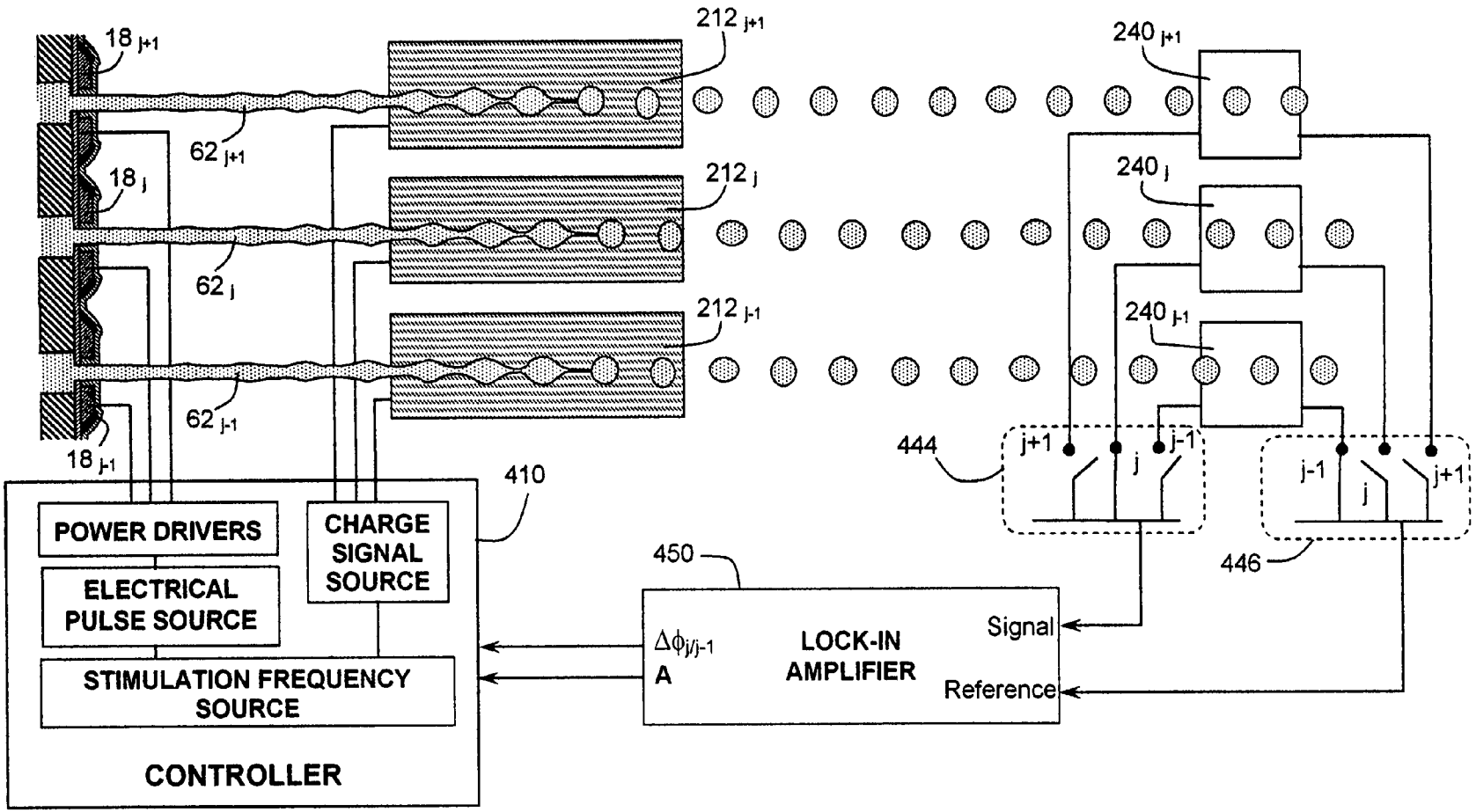
FIG. 29 is a top side view illustration of a liquid drop emitter system having a plurality of liquid streams and having a phase sensitive amplifier circuit comparing two drop streams.

Alternatively, phase differences between an arbitrarily selected reference jet and other jets may be measured by inputting the signals from the corresponding pair of nozzle-specific sensing electrodes to a phase sensitive lock-in amplifier. This embodiment is illustrated in FIG. 29. In order to use the voltage signal from one charged drop detector as a reference, a second switch array 446 is needed. In FIG. 29, the signal from drop charge detector $\mathbf{240}_{j-1}$ is shown switched to the Reference input terminal of lock-in amplifier 450. The signal from drop charge detector $\mathbf{240}_j$ is switched to the Signal input terminal. The phase difference $\Delta\phi_{j/j-1}$ measured by amplifier in this case is directly proportional to the deviation of the break-off lengths between streams $\mathbf{62}_{j/j-1}$.

Break-off lengths may be equalized by adjusting the stimulation pulse energy of one stream relative to the other until the phase difference $\Delta\phi_{j/j-1}$ is zero. The BOL values of the entire array of jets are made uniform by repeating the process for all jets. This process of adjusting the break-off lengths to be the same as another jet may be implemented by choosing one steam as a reference jet for the entire array, by cascading the adjustment in sequential linked pairs of jets, or some combination of these. Multiple copies of the lock-in amplifier circuitry may be employed so that groups of streams may be measured and adjusted simultaneously and the size of first and second switch arrays 444, 446 reduced.

In a related embodiment, the responses of all drop sensing electrodes may be summed to form a lock-in input signal or, alternatively, the signal from a drop sensing electrode sensing all jets simultaneously can be used as an input signal to a lock-in amplifier referenced to the stimulation frequency. In this case, the phase of the reference is first adjusted to maximize the amplitude output of the lock-in amplifier. Then, the break-off length of individual jets, one jet at a time, is adjusted either to maximize the amplitude output of the lock-in amplifier or to minimize the phase difference as measured by the phase output of the lock-in amplifier. This method is advantaged in that stream specific sensors are not required.

Figure 30:
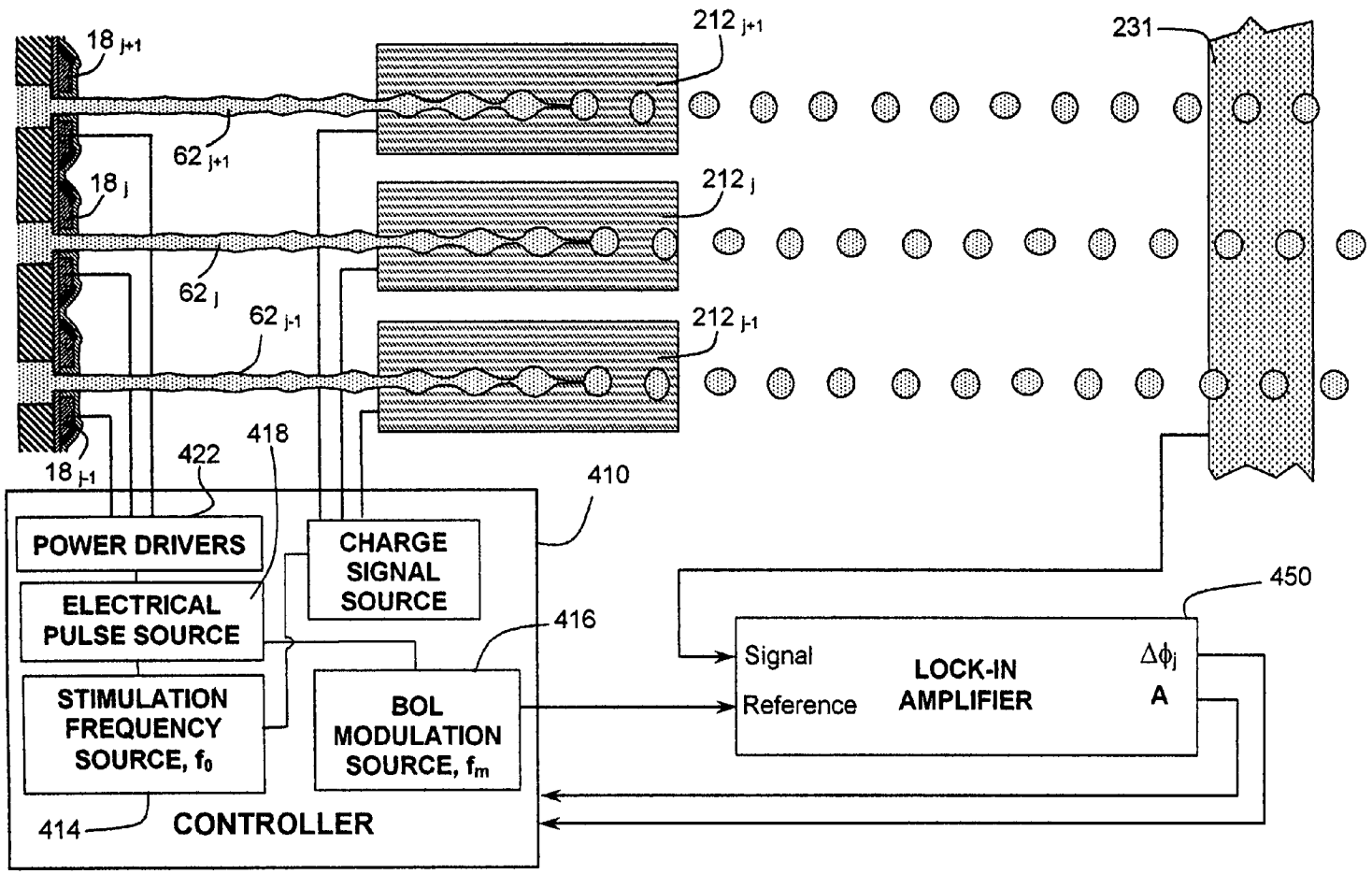
FIG. 30 is a top side view illustration of a liquid drop emitter system having a plurality of liquid streams and having a phase sensitive amplifier circuit and an array wide drop sensor.

In yet another related embodiment, a low-amplitude, periodic, frequency modulation of the break-off length is imposed on a particular selected jet, at a low frequency, $f_m$, that is well below that of the fundamental drop generation frequency, $f_0$. This embodiment is illustrated in FIG. 30 wherein an additional BOL modulation signal source 416 is added to controller 410. Also illustrated in FIG. 30 is a charged drop sensor 231 that spans the array, detecting all drop streams simultaneously. Examining the amplitude output of the lock-in amplifier using a reference signal at the low frequency, $f_m$, ensures that only the break-off length of the selected jet is observed. The break-off length of the selected jet may then be adjusted on a time scale much longer than the period of the low frequency modulation until the amplitude output from the lock-in amplifier is maximal. Under this condition, the break-off length deviation of the selected jet is minimized, as may be appreciated by one skilled in the art of phase detection electronics.

The modulation of break-off lengths can be achieved in many ways, for example by superimposing a pulse energy variation at frequency $f_m$ on the break-off stimulation pulses being applied at a frequency of $f_0$. The pulse energy modulation of the $j^{th}$ stream could be accomplished by changing the pulse voltage or the time width of the pulses applied to heater resistor $\mathbf{18}_j$. In the embodiment illustrated in FIG. 30, an electrical pulse source functional element 418 receives input from the stimulation frequency source 414 and the BOL modulation source 416 and supplies the proper pulses to the heaters via output to a set of heater resistor power drivers 422.

Figure 31A:
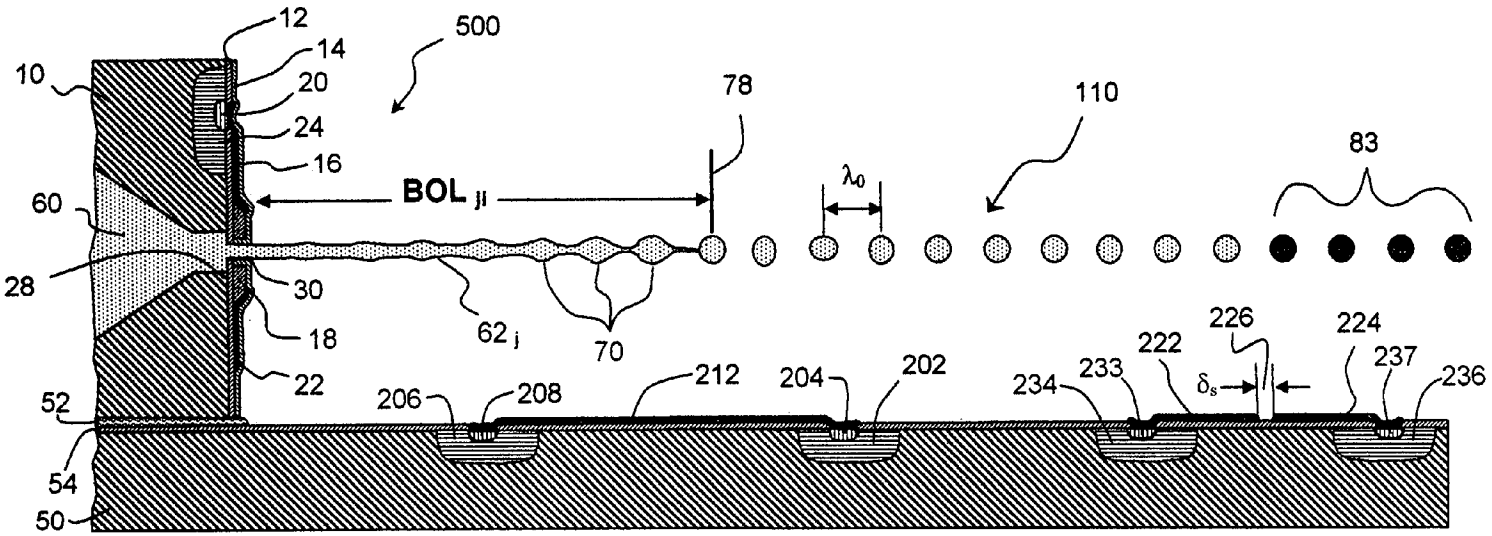
FIGS. 31(*a*) and 31(*b*) are a side view illustration of a liquid drop emitter system and using a sampling integration circuit.
Figure 31B:
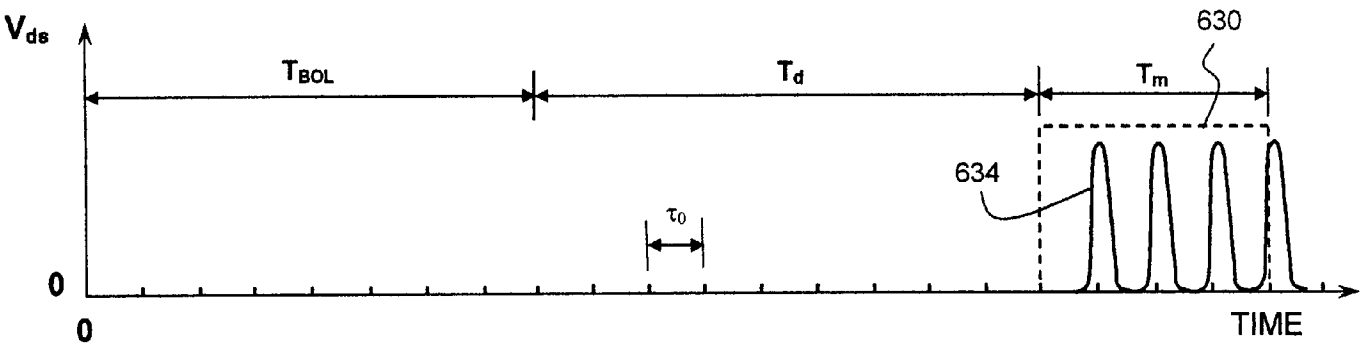

In another preferred embodiment, not all drops are charged, but rather only a sequence of N drops is charged, for example N=4 drops are charged, as illustrated in FIGS. 31(*a*) and 31(*b*). The response of charge sensing electrodes 232 and 238 to the N=4 charged drops is measured by integrating the response of all signals during a measurement time window 630 whose duration, $T_m$, is longer than the time between drops, $\tau_0$. A measurement time window 630 wherein $T_m=4\tau_0$ is illustrated in FIG. 31(*b*). The beginning of time window 630 is delayed an amount $T_d$ set equal to the time-of-flight of a drop from a target point of stream break-off to drop sensor electrode gap 226. The position of the charged drop sensor electrode gap 226 is precisely known with respect to the nozzle exit 30. If the break-off length is equal to the target value then the sequence of N charged drops will arrive at the sensor electrode gap 226 at the beginning of the time window.

By observing the result of all signals integrated during the time window, it is possible to determine both the break-off length and the dependence of break-off length on the stimulation parameters for any jet, even if the deviation in break-off lengths is large, that is greater than the drop-to-drop spacing. This may be understood by noting that the measured response during time window 630 is generally less than N times the response expected from a single charged drop, because deviations in the break-off length may cause one or more of the N charged drops to pass by the sense electrode gap at times before (after) the measurement window opens (closes). The occurrence illustrated in FIG. 31(*b*) has three full drop sensor voltage pulses of the four-charged-drop sequence signal 634 captured during time measurement window 630, indicating that the break-off length was longer than the targeted value so that the first charged drop of the sequence arrived before the time measurement window was open.

Figure 32:
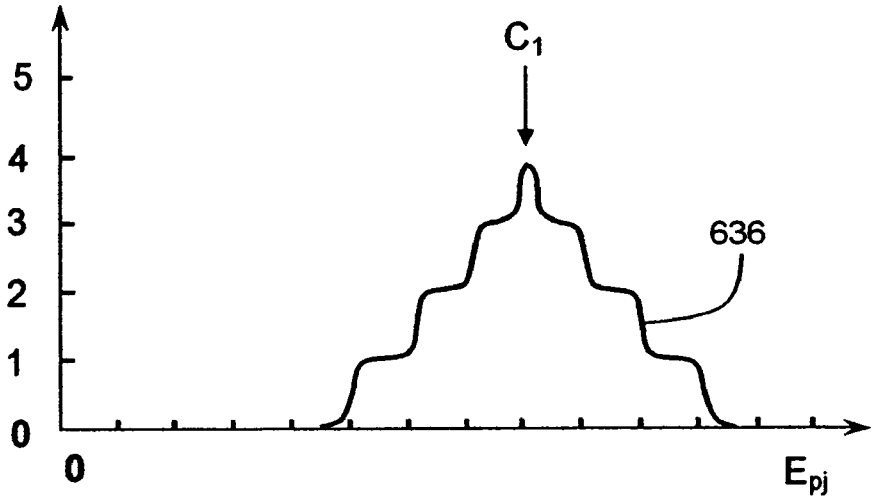
FIG. 32 illustrates the output of a drop stream measurement using a sampling integration circuit.

Ideally, the break-off length for each jet is adjusted so as to maximize the response of the sense electrode by varying at a parameter that controls the break-off length, for example the stimulation pulse energy, $E_{pj}$. The stimulation pulse energy for the $j^{th}$ jet may be changed by changing, the stimulation pulse voltage, $V_{pj}$, or the pulse duration, $\tau_j$, or both, as was discussed previously. Alternatively, the time delay, $T_d$, for opening the time measurement window may be varied to determine the present actual break-off length, $BOL_{ji}$, and then an adjustment in the stimulation pulse energy, $E_{pj}$, made based on a predetermined algorithm, look-up table, or the like. As shown in FIG. 32, the integrated value 636 of the sensor voltage over the measurement time window, as a function of the break-off length control parameter, $E_{pj}$, not only displays a maximum but also displays steps which characterize the dependence of the break-off length on the parameter that controls it, each step corresponding to a change in break-off length equal to the drop-to-drop spacing. The centroid, $C_1$, of the integrated sensor voltage 636 may be conveniently used as a stream characteristic for setting uniform break-off lengths.

Figure 33:
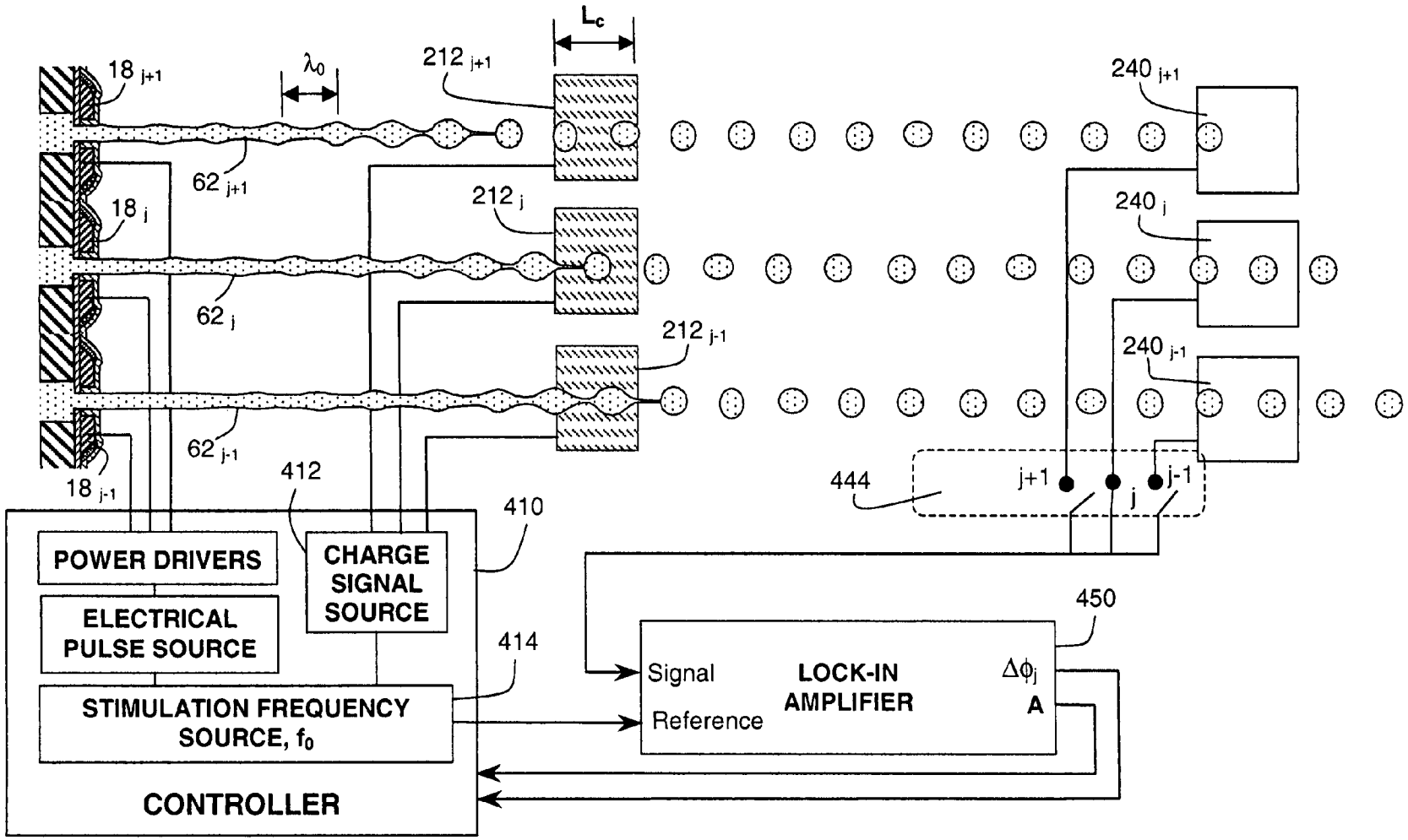
FIG. 33 is a top side view illustration of a liquid drop emitter system having a plurality of liquid streams and short drop charging electrodes.

In yet another preferred embodiment, the charging electrode is configured to be very short in terms of its extent along the direction of the fluid streams. Such a configuration is illustrated in FIG. 33 wherein the system depicted is the same as that of FIG. 28 except that charging electrodes 212 extend a length $L_c$ that is on the order of a stimulation wavelength, $\lambda_0$. Charging electrodes 212 are positioned such that the point of break-off of the associated jet can be adjusted to occur further from the printhead than the position of the electrode. It is thereby possible to correct deviations in break-off lengths and to determine the dependence of break-off length on the break-off length control parameter for each jet, even if the deviation in break-off is large, that is greater than the drop-to-drop spacing.

According to this embodiment, the charging voltage pulse applied to the charging electrode is characterized by a time width, $\tau_c$, and a starting time, $T_{dc}$. The charging voltage pulse width, $\tau_c$, is preferably very short, shorter than the time interval between drop break-off events, i.e. $\tau_c<\tau_0$. The starting time, $T_{dc}$, of the voltage pulse applied to the charging electrode is varied according to this method and, if a drop is charged in response to the charging voltage pulse applied to the charging electrode, the resulting charged drop is later detected by a charge sensing electrode of any type. The method may be understood by noting that even for a very short charging pulse and a very narrow charging electrode, it is always possible to adjust the starting time of the voltage pulse applied to the charging electrode and the break-off length so that a single charged drop will be formed.

Figure 34:
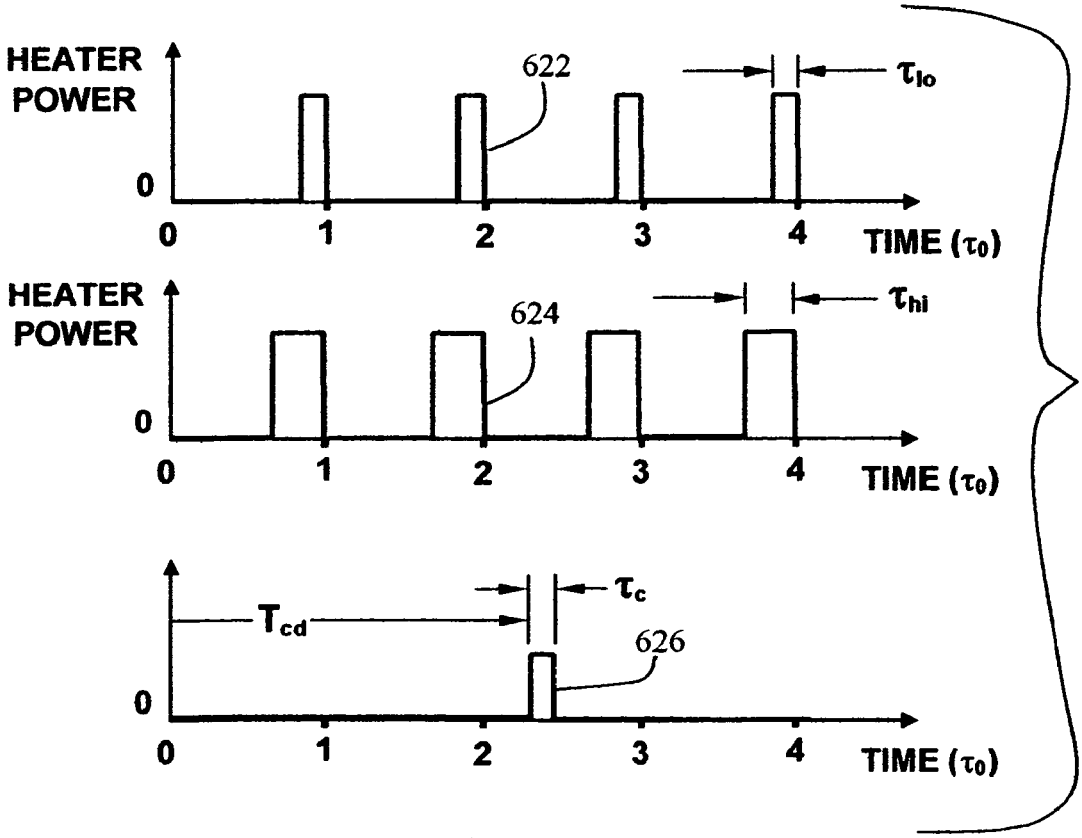
FIG. 34 illustrates a timing relationship between thermal stimulation pulses and a drop charging pulse.

The timing relationships involved among charge voltage pulses and thermal stimulation heater power pulses are illustrated in FIG. 34. Heater energy pulse sequence 622 in FIG. 34 represents a low energy stimulation case and heater energy pulse sequence 624 represents a high energy stimulation case. The two energy pulse sequences 622, 624 have the same period, $\tau_0$, between pulses, however different pulse widths, $\tau_{lo}$ and $\tau_{hi}$, respectively where $\tau_{lo}<\tau_{hi}$. Low energy stimulation pulse sequence 622 will result in a long break-off length, such as stream $\mathbf{62}_{j-1}$ in FIG. 33, and high energy stimulation pulse sequence 624 will result in a short break-off length, such as stream $\mathbf{62}_{j+1}$ in FIG. 33. By varying the pulse energy of the heater pulses, the break-off point may be moved relative to the position of the charging electrodes 212. For example, in FIG. 33, stream $\mathbf{62}_{j+1}$ is breaking up well before charging electrode $\mathbf{212}_{j+1}$, stream $\mathbf{62}_{j-1}$ is breaking slightly beyond charging electrode $\mathbf{212}_{j-1}$ and stream $\mathbf{62}_j$ is breaking up just over charging electrode $\mathbf{212}_j$.

An example drop charging voltage signal 626 is also illustrated in FIG. 34. The illustrated signal has one voltage pulse of duration $\tau_c$ that is applied to a charge electrode beginning at a time $T_{cd}$ after a synchronizing time=0. FIG. 34 illustrates the time relationship between a charging voltage and thermal stimulation energy pulses 622, 624 that are applied to synchronized stream break-up into predetermined droplets. One droplet of a train of four droplets will be charged according to signal 626 if two conditions are present: (1) the break-off point of the associated stream is near to the charge electrode that is energized, and (2) the charging voltage is "on" at the time of break-off.

It may be appreciated from FIG. 34 that the timing of when the voltage pulse is applied may be varied over a drop break-off time cycle, $\tau_0$, by varying $T_{cd}$. The timing of the charging voltage is said to be proper for charging, i.e. in phase, if it is held on the charging electrode shortly before the final fluid ligament forms and severs the drop from electrical connection to the conducting ink fluid reservoir. If the charging voltage is applied slightly too early or slightly too late, respectively, it is always possible to achieve a condition in which no drop is fully charged even when the drop is next to the electrode at the moment of break-off, either because the filament connecting the drop to the ink column is not yet broken when the timing pulse terminates or has broken just prior to the start of the charging pulse. Thus there is provided a very sharply defined transition as a function of the start time, $T_{cd}$, of the charging pulse between a charging and a non-charging condition for drops as they break-off adjacent the charging electrode 212.

Figure 35A:
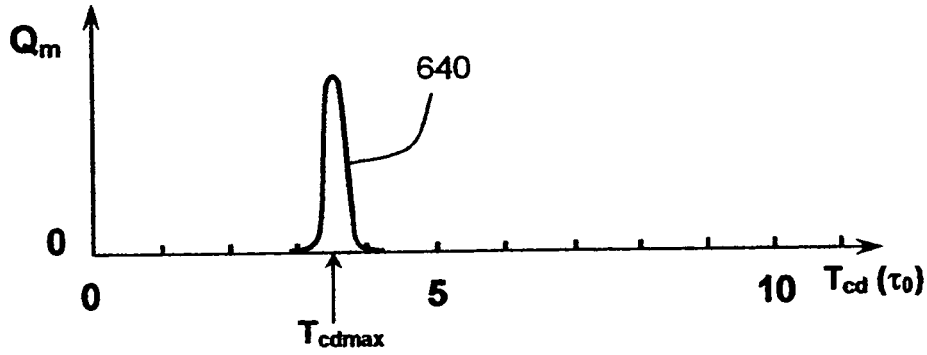
FIGS. 35(*a*) and 35(*b*) illustrate the output of a drop charge detector and FIG. 35(*c*) illustrates a relationship between drop charging and the energy of thermal stimulation pulses.
Figure 35B:
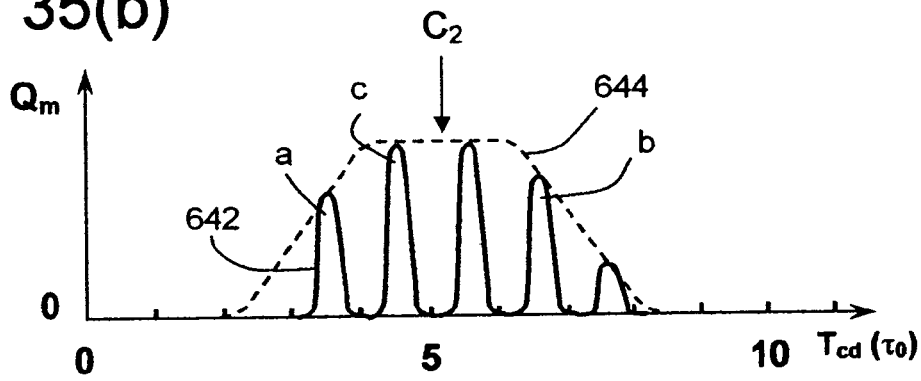
Figure 35C:
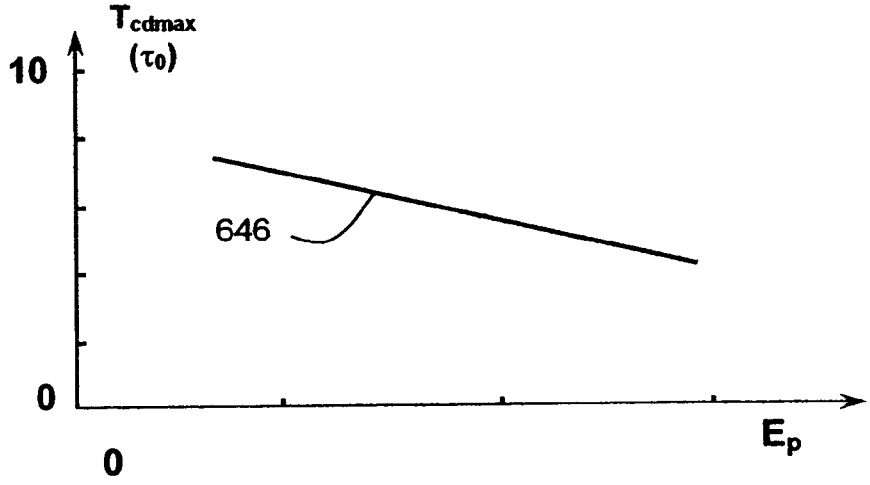

FIGS. 35(*a*) and 35(*b*) illustrate the output of a charged drop detector 240 located downstream of the break-off point of the stream being measured as a function of the starting time, $T_{cd}$. The charge detector response curve 640 in FIG. 35(*a*) plots the maximum drop charge, $Q_m$, calculated from the voltage induced by a drop passing a detector 240. The peak of the maximum charge, $Q_m$, in FIG. 35 occurs at a value $T_{cdmax}$, which represents the best phasing of the charge voltage pulse with the final stages of drop formation and separation as previously noted.

The magnitude of the maximum drop charge $Q_m$ that is measured also is a function of the break-off length as is illustrated in FIG. 35(*b*). That is, maximum drop charging will occur when the drop break-off point is centered on charge electrode 212 and the timing of the application of the charging voltage is proper with respect to the final drop separation moment. Plot 642 in FIG. 35(*b*) is a composite superposition of five charge detector response curves captured as the thermal stimulation pulse energy, $E_p$, is reduced from a high to a low value. That is, the $Q_m$ peak in plot 642 labeled "a" results from a stream that is short with respect to the charge electrode, such as stream $\mathbf{62}_{j+1}$ in FIG. 33; the peak labeled "b" results from a stream that is long with respect to the charge electrode, such as stream $\mathbf{62}_{j-1}$ in FIG. 33; and the peak labeled "c" results from a stream that is well aligned with respect to the charge electrode, such as stream $\mathbf{62}_j$ in FIG. 33. The $Q_m$ peaks move out in time along the $T_{cd}$ axis since the charging pulse must "follow" the break-off time which increases as the BOL increases, and as the applied thermal stimulation pulse energy is decreased.

An envelope curve 644 is plotted in FIG. 35(*b*) to show the superposition result of a large number of drop charging experiments as a function of many values of the BOL, i.e. of the thermal stimulation pulse energy. The "flat-top" nature of this plot is caused by the finite length of the charge electrode, $L_c$. If the charge electrode were made longer (shorter), then the range of BOL's yielding maximum drop charging increases (decreases) accordingly.

As the break-off point is advanced into (or out of) the fringing electric field from the charging electrode, the drop charge response magnitude varies as indicated by the $Q_m$ envelope curve 644. However, the break-off length itself may be correlated with the time position of the maximum drop charge value as a linear function of $T_{cdmax}$. FIG. 35(*c*) illustrates the linear relationship 646 between the time position of maximum drop charging, $T_{cdmax}$, and a break-off length control parameter, such as the heater pulse energy. The slopes (positive and negative) of the $Q_m$ envelope curve 644 may be used to determine the BOL position, before or after the charge electrode and the rate of break-off length change with thermal stimulation pulse energy, $E_p$, from line 646.

In accordance with this method a very accurate determination of the location of break-off relative to the charging electrode is possible as well as an accurate determination of the dependence of break-off length on the break-off length control parameters. For example, if the break-off length is changed a small amount, $\delta_B$, by changing the thermal stimulation pulse energy, then the change in the starting time for which a maximum charge is sensed, $\Delta T_{cdmax}$, is equated to the ratio of $\delta_B$ to the jet velocity, $v_0$, i.e., $\Delta T_{cdmax}=\delta_B/v_0$. As illustrated in FIG. 35(*c*), the rate of change in break-off length per unit change in stimulation energy can be computed by taking the product of jet velocity times the slope $dT_{cdmax}/dE_p$ of plot 646.

The centroid, $C_2$, of envelope curve 644 in FIG. 35(*b*) can be used as a measure of the position of the break-off length of any jet relative to the charging electrode. Additionally, the knowledge of the rate of change in break-off length per unit change in thermal stimulation energy can then be used to correct deviations in break-off length as discussed previously. These parameters can be used to set the break-off length to a predetermined value by first determining the stimulation energy and timing conditions for break-off to occur adjacent the charging electrode and then using the known the dependence of break-off length on stimulation voltage to deliberately alter the position of break-off relative to the charging electrode.

Many variants of this method are possible and within the scope of the current invention. For example, the length of the charging electrode may be extended toward the printhead by several multiples of the drop-to-drop spacing so that a charged drop can be formed at multiple locations along the electrode length for multiple timing conditions for the charging electrode pulse, each separated by the drop-to-drop time interval. Alternatively, the timing pulse duration can be extended so that multiple charged drops are produced for a single pulse in the case of the extended electrode. In all such cases, it is possible to determine both the break-off length and the dependence of break-off length on the break-off length control parameter for any jet.

The methods and apparatus discussed above all rely on means of sensing drops downstream of the break-off point, for example, by light shadow, impact or induced voltage detection. However, optical means of detection and control of break-off lengths can be also be practiced which do not rely on the downstream detection of drops but instead more directly characterize the position of drop break-off. For example, high-quality visualization of jets provides a straightforward, although time consuming, method of determination of break-off length; high resolution images taken with a high-speed CMOS image sensor at closely stepped time intervals can be used for directly observing the position of break-off.

Optical methods which avoid the need to sample high resolution images at many different time intervals, such as the use of light scattered from the drop break-off point have been realized by the present inventors. In one preferred embodiment, a source of light, such as high intensity laser light, is located within the printhead directed such that a portion of the light travels along the jets, the jets thereby acting as "light pipes." The light near the end of the jet just before break-up is refracted at the top surface of the drop poised for break-off, and a portion of this light is refracted substantially perpendicular to the jets. In accordance with this embodiment, the detection apparatus senses or images the light refracted perpendicular to the jets providing a measure of the break-off position. An example configuration is illustrated in FIG. 36

Figure 36:
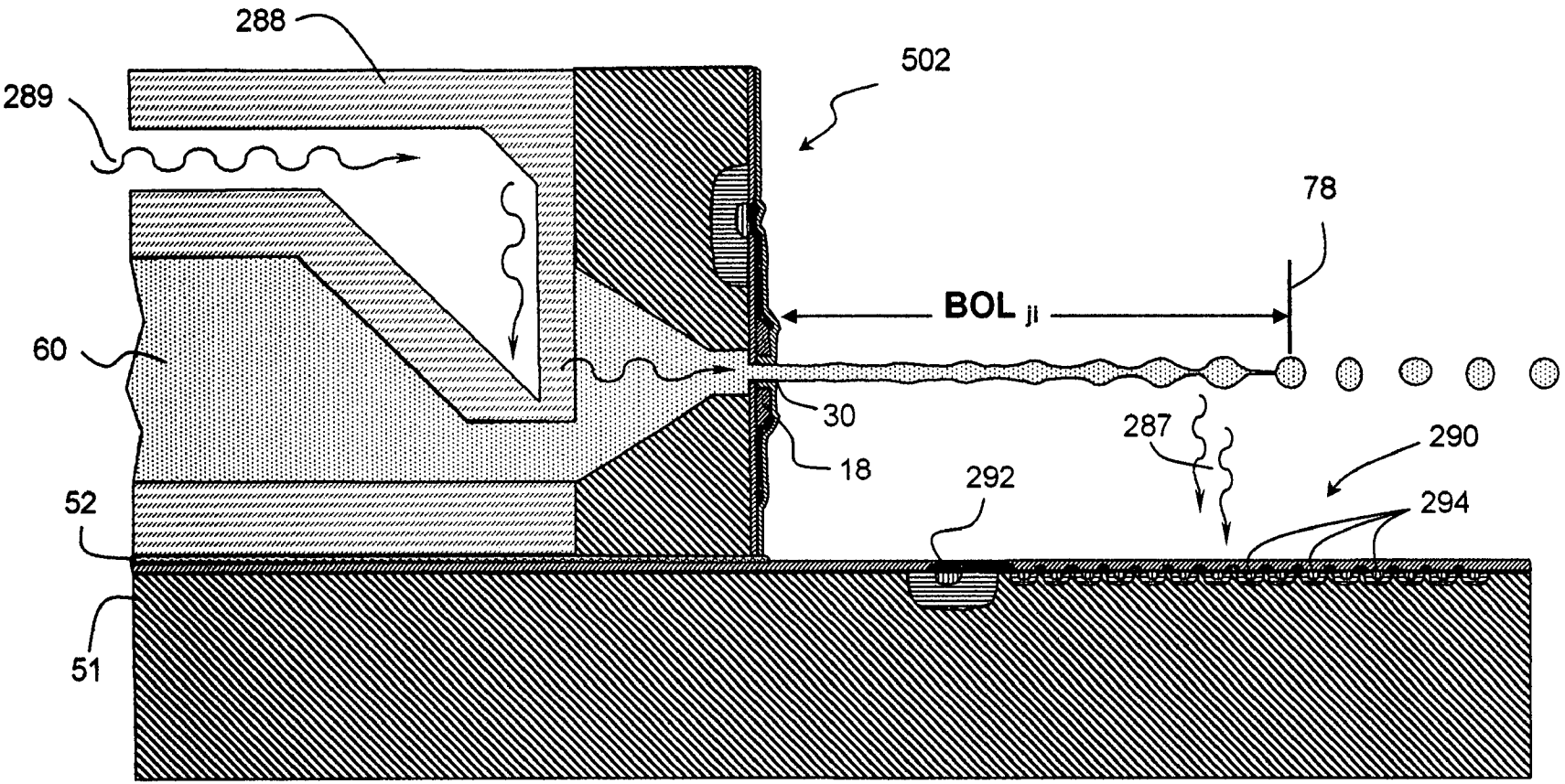
FIG. 36 is a side view illustration of a liquid drop emitter system configured for the injection of light energy.

In the embodiment shown in FIG. 36 case, thermally stimulated liquid drop emitter 502 has been fitted with a transparent manifold 288 that facilitates the introduction of both pressurized ink 60 as well as intense light energy 286, such as from a laser (not shown). Light energy 286 reflects off internal surfaces in the transparent manifold, emerging to illuminate the liquid cavity behind nozzle 30. Light energy 286 is partially confined to the jet by internal reflections at the liquid-air boundary of the fluid stream, in the fashion of a "light pipe". Near the end of the fluid column, light energy 287 is emitted in many directions, including into an optical detector 290 position near the point of intended break-off. Refraction stops when the fluid filament spanning the drop to be ejected from ink column is broken, i.e. at break-off. Optical detector 290 is configured with a plurality of finely spaced sensor sites 294 arrayed along the direction of the projected fluid jet, for example a multi-celled charge coupled device sensor integrated into a semiconductor substrate 51. The sensor sites 294 are connected to underlying MOS circuitry via descending connector 292.

The light energy 287 being sensed from the last drop being still connected to the "light pipe" jet is observed at a position that moves downstream with time until break-off. However, the furthest extent of the light being imaged corresponds to the top of the drop breaking off and, since no light is sensed further from the printhead than this position, the output of the optical sensor sits 294 can be continuously averaged over time avoiding the need for capturing a sequence of the emitted light signal image in time. In other words, even though the break-off condition is maintained only briefly, the time average of the sensed signal of the light reveals the position of the drop undergoing break-off. Sensing this location and knowing the size and separation of the drops breaking off allows an accurate determination of the break-off point, since the separation of drops is generally known.

In a related method, the input light energy 286 may be pulsed so as to require a precise timing relation between the optical pulse and the break-off event to improve the detection efficiency. Pulsing the input light energy 286 at a reference frequency also permits the use of lock-in amplifier techniques such as those discussed above with respect to charged drop detection. Alternatively, light may impinge from a directed beam substantially orthogonal to the direction of propagation of the jets onto the break-off region and be subsequently scattered or reflected into the nozzle region where detection occurs. In this embodiment, the optical path is essentially reversed in comparison to the previous embodiment. It should be noted that in the embodiments using optical detection described, the break-off position can be sensed in two dimensions provided light is collected from two substantially orthogonal directions, thereby enabling other jet parameters such as jet straightness to be measured.

Figure 37:
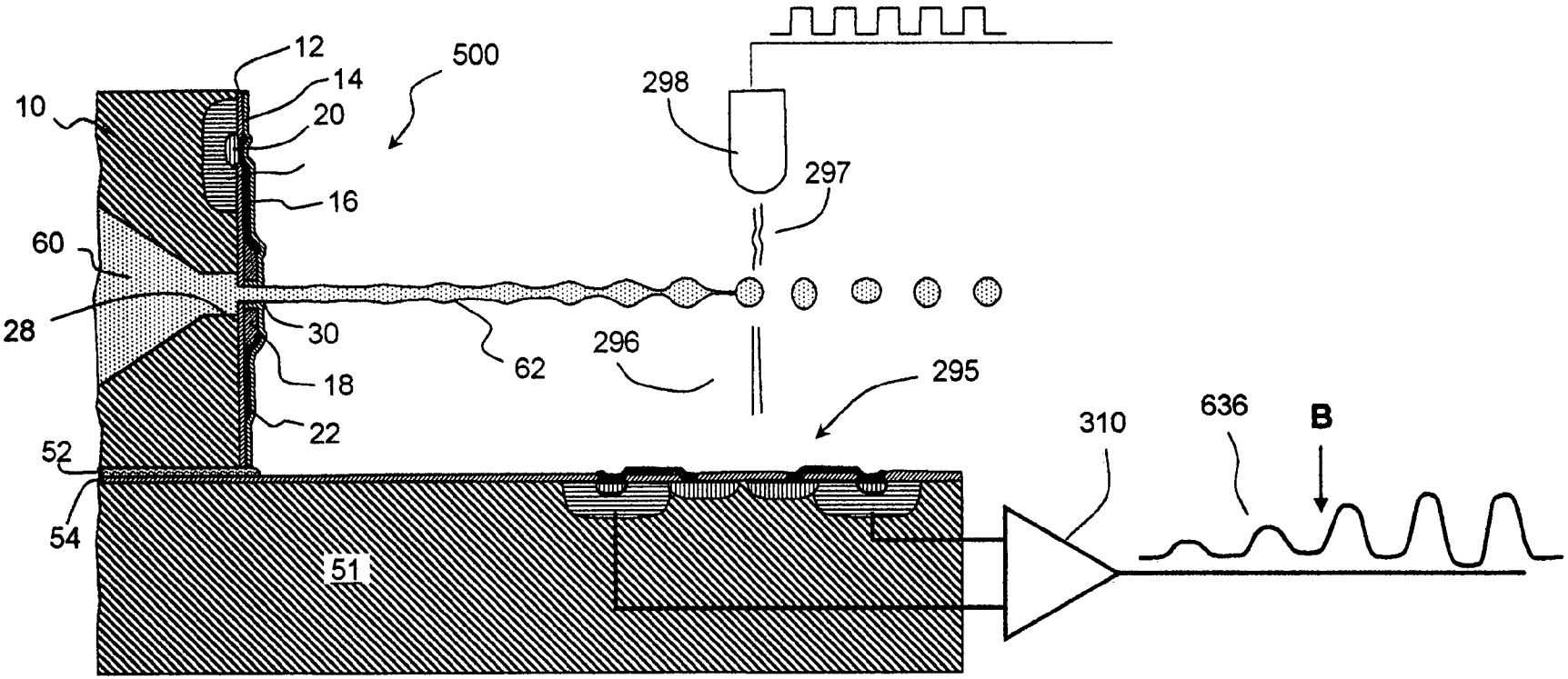
FIG. 37 is a side view illustration of a liquid drop emitter system configured for the light illumination and optical detection of the point of drop break-off.

In another related embodiment, the transmission of a narrowly defined optical beam 297 as illustrated in FIG. 37 is measured as a function of time to reveal the pattern of time dependent drops jetted. The light emitter or other modulator 296 is pulsed at the fundamental frequency of formation and the light transmission 296 is detected by detector 295 the output of signal processing amplifier is plotted 636 as a function of the control parameter for drop break-off, for example the stimulation energy. A precise determination of the break-off length of one jet in comparison with another can obtained by adjusting the break-off length energy for both jets to a value corresponding to any particular feature in the detected signal plot, for example the feature marked by the arrow B, and corresponding to the filament connecting the fluid column to the drop breaking off, as illustrated in FIG. 37.

Figure 38:
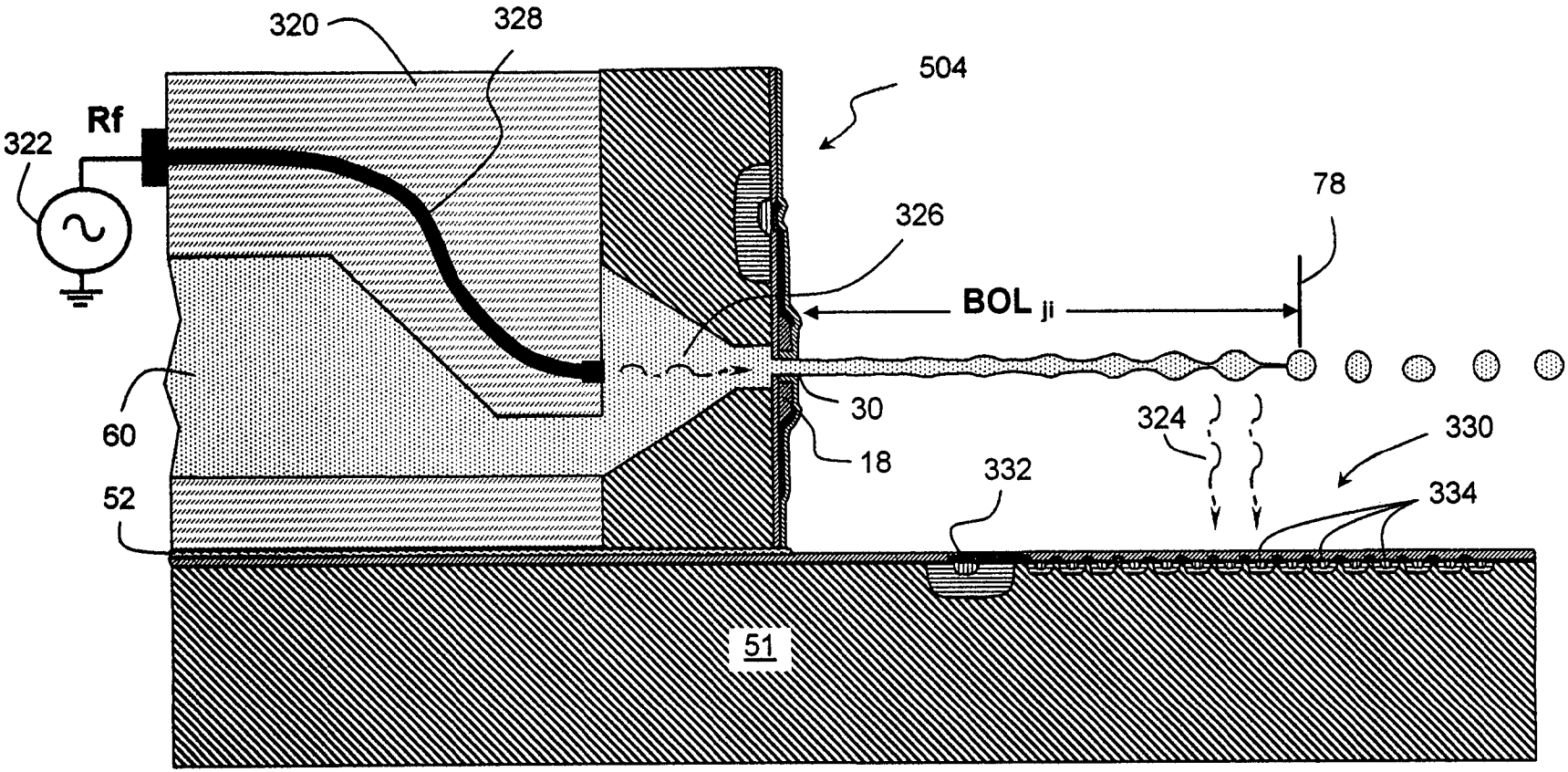
FIG. 38 is a side view illustration of a liquid drop emitter system configured for the injection of radio frequency energy.

In yet another related embodiment, measurement of microwave emissions, rather than optical emissions, from the fluid column portions of jets can be used to detect the break-off position, in analogy to electrostatic coupling of drops to charge sensing electrodes. In FIG. 38 radio frequency (RF) fields can be generated by connecting electrically an RF generator 322 to the body of the printhead via RF transmission line 323, in which case RF energy travels along the jets until the break-off point, that is, along the contiguous portions of the jets. In the case of RF fields, the contiguous portions of the jets couple RF energy 324 to an electrostatic sensing apparatus 330 in close proximity to the jets.

The electrostatic sensing apparatus 330 is configured with a plurality of electrode sites 334 arrayed along the direction of stream projection as illustrated in FIG. 38. Sensing electrodes 334 adjacent drops already having broken off receive no RF energy. For RF fields, sensing electrodes comprise simple metal lines electrically connected to an RF amplifier which detects RF radiation coupled between the contiguous fluid jets and the sensing electrodes. By having multiple sensing electrodes 334 spaced along the projection of the jets, the position of the last electrode to receive coupled RF energy determines the break-off length, that is, the break-off length may be determined directly by observing the location beyond which no coupling occurs to sensing electrodes 334 underlying the jets.

As can be appreciated by one skilled in the art of RF electronics, other related methods of measuring break-off length are possible within the scope of the present invention. For example, the standing wave ratio SWR of very high frequency electromagnetic radiation propagating along jets and reflected from their break-off points can be monitored to determine the position of drop break-off. Also, the RF signal may be further modulated at a reference frequency that is used by phase sensitive amplifier circuitry to improve detection efficiency, in a fashion similar to that discussed previously with respect to lock-in amplifier use with charged drop detection.

Many other methods of measurement and control may be realized as applying to the many apparatus configurations previously discussed and illustrated by FIGS. 1 through 36. For example, groups of jets may be tested simultaneously, all jets may be tested simultaneously, or a single jet liquid drop emitter may be controlled according to the present inventions. Methods that combine stream or drop illumination and charging, and special sequences of drop volumes may be also be developed from the teachings and disclosures herein.

The inventions have been described in detail with particular reference to certain preferred embodiments thereof, but it will be understood that variations and modifications can be effected within the spirit and scope of the inventions.

Parts List

10 substrate for heater resistor elements and MOS circuitry
11 drop generator chamber and flow separation member
12 insulator layer
13 assembly location feature formed on drop generator chamber member 11
14 passivation layer
15 thermo-mechanical stimulator, one per jet
16 interconnection conductor layer
17 movement cavity beneath microelectromechanical stimulator
18 resistive heater for thermal stimulation via liquid heating
19 piezo-mechanical stimulator, one per jet
20 contact to underlying MOS circuitry
22 common current return electrical conductor
24 underlying MOS circuitry for heater apparatus
28 flow separator
30 nozzle opening
32 nozzle plate
40 pressurized liquid supply manifold
42 liquid drop emission system support
44 pressurized liquid inlet in phantom view
46 strength members formed in substrate 10
48 pressurized liquid supply chamber
50 microelectronic integrated drop charging and sensing apparatus
51 microelectronic integrated drop sensing apparatus
52 bonding layer joining components
54 insulating layer
56 alignment feature provided in a microelectronic material substrate
58 inlet to drop generator chamber for supplying pressurized liquid
60 positively pressurized liquid
62 continuous stream of liquid
64 natural surface waves on the continuous stream of liquid
66 drops of undetermined volume
70 stimulated surface waves on the continuous stream of liquid
76 operating break-off length
77 natural break-off length
78 break-off length line across a stimulated array before break-off control
80 drops of predetermined volume
82 drop pair used for drop arrival measurement
84 inductively charged drop(s)
85 drop(s) having the predetermined unit volume $V_o$
86 drop(s) having volume $mV_o$, m=4
87 drop(s) having volume $mV_o$, m=3
88 drop(s) having volume $mV_o$, m=8
89 inductively charged drop(s) having volume $mV_o$, m=4
91 dielectric and chemical passivation layer
92 electrically conducting layer
93 electroactive material, for example, PZT, PLZT or PMNT
94 electrically conducting layer
95 dielectric and chemical passivation layer
95 thermomechanical material, for example, titanium aluminide
100 stream of drops of undetermined volume from natural break-up
110 stream of drops of predetermined volume
120 stream of drops of predetermined volume and operating break-off length
200 schematic drop charging apparatus
202 underlying MOS circuitry for inductive charging apparatus
204 contact to underlying MOS circuitry
206 underlying MOS circuitry for inductive charging apparatus
208 contact to underlying MOS circuitry
210 charging electrode for inductively charging stream 62
212 inductive charging apparatus elements, one per jet
214 inductive charging apparatus elements, one per group of jets
222 first electrode of a charged drop sensor for stream $\mathbf{62}_j$
224 second electrode of a charged drop sensor for stream $\mathbf{62}_j$
226 gap between first and second electrodes of charged drop sensor
230 schematic drop sensing apparatus
231 array wide electrostatic drop sensor
232 first array wide electrode of a charged drop sensor
233 contact to underlying MOS circuitry
234 underlying MOS circuitry for drop sensing apparatus
236 underlying MOS circuitry for drop sensing apparatus
237 contact to underlying MOS circuitry
238 second array wide electrode of a charged drop sensor
240 electrostatic drop sensing apparatus elements, one per jet
241 drop sensor element, one per jet
242 optical drop sensing apparatus elements, one per jet
243 drop sensor element, one per group of jets
244 light sensing elements
246 schematic representation of optical detector amplification circuitry
248 schematic representation of optical detector output pad (s)
250 Coulomb force deflection apparatus
252 porous conductor ground plane deflection apparatus
254 upper plate (partially cut away) of a Coulomb force deflection apparatus
256 aerodynamic cross flow deflection zone
270 gutter to collect drops not used for deposition on the receiver
274 guttered liquid return manifold
276 to vacuum source providing negative pressure to gutter return manifold
280 drop illumination source
282 light impinging on test drop pair 82
284 drop shadow cast on optical detector
286 drop impact sensing apparatus elements, one per jet
287 light energy refracted by the illuminated liquid stream
288 transparent liquid supply manifold facilitating light energy input
289 intense light energy input for stream illumination
290 multi-element light sensor
292 connection of optical detector 290 to electronics in substrate 50
294 individual light detector sites
295 differential optical detector
296 pulsed light energy shadowed by stimulated stream 62
297 focused illumination directed at stream in BOL region
298 pulsed stream illumination source

300 print or deposition plane
300 print or drop deposition plane
310 signal processing amplifier, low noise or phase sensitive
320 liquid supply manifold facilitating radio frequency energy input
322 radio frequency (RF) energy source
324 RF energy emitted in the region of drop break-off
326 RF energy injected into liquid supply prior to nozzle exit
328 RF energy transmission conduit
330 multi-element RF energy detector
332 connection of RF energy detector 330 to electronics in substrate 50
334 individual RF energy detector sites
340 eyelid cover to seal printhead during not-printing periods
341 eyelid closing mechanism
343 seal of eyelid against printhead drop catch gutter 270
344 seal of eyelid against printhead drop generator chamber portion 11
346 drop sensor signal processing circuitry
347 output electrical lead for eyelid drop sensor
348 drop impact sensor located on eyelid inner surface
354 output electrical lead for drop sensor on gutter landing surface
356 drop impact sensor located on gutter landing surface
358 drop sensor signal processing circuitry
400 input data source
410 controller
412 charge signal source
414 stimulation frequency source
416 BOL modulation source
418 electrical pulse source
420 resistive heater apparatus
430 liquid drop emitter
440 drop sensing apparatus
444 first switch array for sensor per jet sensor array
446 second switch array for sensor per jet sensor array
450 lock-in amplifier
500 liquid drop emitter having a plurality of jets or drop streams
502 liquid drop emitter having internal stream illumination means
504 liquid drop emitter having internal RF signal input
510 edgeshooter configuration drop emitter and individual heaters per jet
511 integrated heaters per jet and drop charging apparatus
514 drop emitter having an individual piezo-mechanical stimulator per jet
515 integrated piezo-mechanical stimulators and drop charging apparatus
516 drop emitter having an individual thermo-mechanical stimulator per jet
517 integrated thermo-mechanical stimulators and drop charging apparatus
550 liquid drop emission system having an optical sensor after the drop the gutter collection point
552 liquid drop emission system having drop sensor apparatus located along the gutter landing surface
554 liquid drop emission system having drop sensor apparatus located on a print head sealing eyelid
610 representation of stimulation thermal pulses for drops 85
612 representation of deleted stimulation thermal pulses for drop 86
615 representation of deleted stimulation thermal pulses for drop 88
616 representation of deleted stimulation thermal pulses for drop 87
618 thermal pulses for the $j^{th}$ jet before BOL control
620 thermal pulses for the $j^{th}$ jet to achieve the operating BOL
630 measurement time window for integrating drop sensor output
634 voltage signal, $V_{ds}$, for a four-charged-drop sequence
636 voltage signal output versus thermal stimulation energy

The invention claimed is:

1. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus adapted to transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus adapted to detect the stream of drops of predetermined volumes and generate a detected signal;

control apparatus adapted to determine a characteristic of the stream of drops of predetermined volumes detected by the sensing apparatus and that is related to the break-off length from the nozzle, and a circuit that receives the detected signal and a reference signal derived from the pulses of thermal energy transferred to the liquid and generates an output that is dependent on at least the detected signal and the reference signal to the control apparatus.

2. The jet break-off length measurement apparatus of claim 1 wherein the sensing apparatus comprises an impact detector that senses the impact of a drop.

3. The jet break-off length measurement apparatus of claim 2 wherein the impact detector comprises a piezoelectric transducer.

4. The jet break-off length measurement apparatus of claim 2 wherein the impact detector comprises an electrostatic capacitor.

5. The jet break-off length measurement apparatus of claim 2 wherein the impact detector comprises an electrostrictive transducer.

6. The jet break-off length measurement apparatus of claim 1 wherein the sensing apparatus comprises illumination apparatus adapted to illuminate at least one drop of predetermined volume casting a drop shadow and an optical detector that detects the drop shadow.

7. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus configured transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus configured detect the stream of drops of predetermined volumes; and control apparatus configured determine a characteristic of the stream of drops of predetermined volumes that is related to the break-off length, wherein the sensing apparatus comprises illumination apparatus adapted to illuminate at least one drop of predetermined volume casting a drop shadow and an optical detector that detects the drop shadow, and wherein the sensing apparatus is further configured sense the continuous stream of fluid before break-up into drops of predetermined volumes detects by arranging the illumination apparatus to illuminate a first side of the continuous stream of liquid adjacent a predetermined break-off length from the nozzle, locating the optical detector opposite the first side, and restricting the illumination apparatus and optical detector to respond to a narrow length, $L_s$, along the continuous stream of fluid, wherein drops of predetermined volume are separated by a nominal inter drop-spacing in flight, $\lambda_0$, and $L_s<\lambda_0$.

8. The jet break-off length measurement apparatus of claim 1 wherein the sensing apparatus comprises illumination apparatus adapted to illuminate a pattern of drops of predetermined volumes casting a pattern shadow and an optical detector that detects the pattern shadow.

9. The jet break-off length measurement apparatus of claim 1 wherein the characteristic of the stream of drops of predetermined volumes that is calculated includes a time of flight of a drop of predetermined volume.

10. The jet break-off length measurement apparatus of claim 1 wherein the predetermined volumes of drops include drops of a unit volume, $V_0$, and drops having volumes that are integer multiples of the unit volume, $mV_0$, wherein m is an integer.

11. The jet break-off length measurement apparatus of claim 10 wherein the characteristic of the stream of drops of predetermined volumes that is calculated includes a time of flight of a drop of predetermined volume $mV_o$ wherein $m \geqq 3$.

12. The jet break-off length measurement apparatus of claim 1 wherein the characteristic of the stream of drops of predetermined volumes that is calculated includes a time period between two drops of predetermined volumes.

13. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus configured to transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus configured to detect the stream of drops of predetermined volumes; and control apparatus configured to determine a characteristic of the stream of drops of predetermined volumes that is related to the break-off length, wherein the characteristic of the stream of drops of predetermined volumes that is calculated includes a time period between two drops of predetermined volumes, and wherein a pair of adjacent drops in the stream of drops of predetermined volumes has an inter-drop time period and the characteristic of the stream of drops of predetermined volumes that is calculated includes a deviation in the inter-drop time periods.

14. The jet break-off length measurement apparatus of claim 1 wherein the liquid is an ink and the liquid drop emitter is an ink jet printhead.

15. The jet break-off length measurement apparatus of claim 1 wherein the sensing apparatus generates a detected signal, and the jet break-off length measurement apparatus further comprises a phase sensitive amplification circuit that receives a reference signal and the detected signal and generates an output that is dependent on at least the reference signal and the detected signal.

16. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus configured to transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus configured to detect the stream of drops of predetermined volumes; and control apparatus configured to determine a characteristic of the stream of drops of predetermined volumes that is related to the break-off length, wherein the sensing apparatus generates a detected signal, and the jet break-off length measurement apparatus further comprises a phase sensitive amplification circuit that receives a reference signal and the detected signal and generates an output that is dependent on at least the reference signal and the detected signal, and wherein the reference signal has a reference frequency and the phase sensitive amplification circuit generates an output representative of the phase difference between the detected signal and the reference signal.

17. The jet break-off length measurement apparatus of claim 16 wherein the reference signal has a reference frequency and the phase sensitive amplification circuit is a lock-in amplifier further generating an output representative of the amplitude of the detected signal at the reference frequency.

18. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus configured to transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus configured to detect the stream of drops of predetermined volumes; and control apparatus configured to determine a characteristic of the stream of drops of predetermined volumes that is related to the break-off length, wherein the sensing apparatus generates a detected signal, and the jet break-off length measurement apparatus further comprises a phase sensitive amplification circuit that receives a reference signal and the detected signal and generates an output that is dependent on at least the reference signal and the detected signal, and wherein the reference signal is derived from the pulses of thermal energy.

19. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus configured to transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus configured to detect the stream of drops of predetermined volumes; and control apparatus configured to determine a characteristic of the stream of drops of predetermined volumes that is related to the break-off length, wherein the sensing apparatus generates a detected signal, and the jet break-off length measurement apparatus further comprises a phase sensitive amplification circuit that receives a reference signal and the detected signal and generates an output that is dependent on at least the reference signal and the detected signal, and wherein the pulses of thermal energy are provided at a nominal drop generation frequency, $f_0$; said pulses of thermal energy are further modulated by a thermal stimulation modulation signal having a modulation frequency, $f_m$, less than one-tenth of $f_0$; and wherein the reference signal is derived from the thermal stimulation modulation signal.

20. A jet break-off length measurement apparatus for a continuous liquid drop emission system comprising:

a liquid drop emitter containing a positively pressurized liquid in flow communication with at least one nozzle for emitting a continuous stream of liquid;

resistive heater apparatus configured to transfer pulses of thermal energy to the liquid in flow communication with the at least one nozzle sufficient to cause the break-off of the at least one continuous stream of liquid into a stream of drops of predetermined volumes, and wherein said break-off occurs at a break-off length from the nozzle;

sensing apparatus configured to detect the stream of drops of predetermined volumes; and control apparatus configured to determine a characteristic of the stream of drops of predetermined volumes that is related to the break-off length, wherein the sensing apparatus generates a detected signal, and the jet break-off length measurement apparatus further comprises a phase sensitive amplification circuit that receives a reference signal and the detected signal and generates an output that is dependent on at least the reference signal and the detected signal, and wherein the reference signal comprises a measurement time window duration, $T_m$, and a window starting time, $T_{cd}$, and the phase sensitive amplification circuit generates an output dependent on the integration of the detected signal over the time $T_m$, commencing at the window starting time, $T_{cd}$.

21. The jet break-off length measurement apparatus of claim 20 wherein the reference signal is derived at least from the pulses of thermal energy.

* * * * *